US008324836B2

(12) United States Patent
Crawford et al.

(10) Patent No.: US 8,324,836 B2
(45) **Date of Patent: *Dec. 4, 2012**

(54) LIGHTING DEVICE HAVING CROSS-FADE AND METHOD THEREOF

(75) Inventors: John D. Crawford, Avon, OH (US); David A. Spartano, Brunswick, OH (US); Peter F. Hoffman, Avon, OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/009,091

(22) Filed: Jan. 19, 2011

(65) Prior Publication Data

US 2011/0115397 A1 May 19, 2011

Related U.S. Application Data

(63) Continuation of application No. 12/113,339, filed on May 1, 2008, now Pat. No. 7,888,883.

(60) Provisional application No. 61/023,632, filed on Jan. 25, 2008.

(51) Int. Cl.
*H05B 37/02* (2006.01)

(52) U.S. Cl. ..... 315/292; 315/299; 315/324

(58) Field of Classification Search ..... 315/291, 315/292, 294, 299, 7, 312, 324, 360, 362
See application file for complete search history.

(56) References Cited

U.S. PATENT DOCUMENTS 5,994,791 A 11/1999 Rayner
5,998,928 A 12/1999 Hipp
6,095,661 A 8/2000 Lebens et al.
6,386,730 B1 5/2002 Matthews
6,441,558 B1 8/2002 Muthu et al.
6,567,009 B2 5/2003 Ohishi et al.
6,641,294 B2 11/2003 Lefebvre
6,722,771 B1 4/2004 Stephens
6,737,814 B2 5/2004 Guthrie et al.
6,880,950 B2 4/2005 Chan
6,979,098 B2 12/2005 Petzi et al.
6,979,099 B2 12/2005 Harris, Jr. et al.
6,984,900 B1 1/2006 Bruwer
7,033,036 B2 4/2006 Pederson
7,135,664 B2 11/2006 Vornsand et al.

(Continued)

FOREIGN PATENT DOCUMENTS

JP 08-305035 A 11/1996

(Continued)

OTHER PUBLICATIONS

Patent Cooperation Treaty (PCT), International Search Report and Written Opinion for Application No. PCT/US2009/000287, filed Jan. 20, 2009, mailed Apr. 30, 2009, Korean Intellectual Property Office, Korea.

(Continued)

*Primary Examiner* — Thuy Vinh Tran

(74) *Attorney, Agent, or Firm* — Michael C. Pophal

(57) ABSTRACT

A lighting device includes a first lighting source, a second lighting source, and a controller. The first lighting source yields a first illumination pattern. The second lighting source yields a second illumination pattern. The patterns overlay to yield a third illumination pattern. The controller shifts available power between the first lighting source and the second lighting source.

18 Claims, 36 Drawing Sheets

U.S. PATENT DOCUMENTS

| | | | | |
|---|---|---|---|---|
| 7,148,632 | B2 | 12/2006 | Berman et al. | |
| 7,157,866 | B2 | 1/2007 | Komiya et al. | |
| 7,173,383 | B2 | 2/2007 | Vornsand et al. | |
| 7,186,000 | B2 | 3/2007 | Lebens et al. | |
| 7,202,613 | B2 * | 4/2007 | Morgan et al. | 315/312 |
| 7,281,820 | B2 | 10/2007 | Bayat et al. | |
| 7,293,898 | B2 | 11/2007 | Kumthampinij et al. | |
| 7,387,405 | B2 * | 6/2008 | Ducharme et al. | 362/231 |
| 7,510,294 | B2 | 3/2009 | Steele et al. | |
| 7,671,542 | B2 | 3/2010 | Chang et al. | |
| 7,718,942 | B2 | 5/2010 | Lim et al. | |
| 2003/0137834 | A1 | 7/2003 | Jigamian et al. | |
| 2004/0052076 | A1 | 3/2004 | Mueller et al. | |
| 2005/0040773 | A1 | 2/2005 | Lebens et al. | |
| 2005/0104542 | A1 | 5/2005 | Ito et al. | |
| 2005/0122710 | A1 | 6/2005 | Kim | |
| 2005/0122712 | A1 | 6/2005 | Kim | |
| 2007/0145912 | A1 | 6/2007 | Spartano et al. | |
| 2007/0159815 | A1 | 7/2007 | Bayat et al. | |
| 2007/0159816 | A1 | 7/2007 | Bayat et al. | |
| 2007/0195552 | A1 | 8/2007 | Park | |
| 2007/0236154 | A1 | 10/2007 | Lee | |
| 2007/0268150 | A1 | 11/2007 | Fraser | |
| 2008/0180032 | A1 | 7/2008 | Kim et al. | |
| 2011/0204819 | A1 * | 8/2011 | Isely | 315/294 |

FOREIGN PATENT DOCUMENTS

| | | | |
|---|---|---|---|
| JP | 2004-097658 | A | 4/2004 |
| JP | 2007-179770 | A | 7/2007 |

OTHER PUBLICATIONS

Patent Cooperation Treaty (PCT), International Search Report and Written Opinion for Application No. PCT/US2008/067703, filed Jun. 20, 2008, mailed Sep. 26, 2008, European Patent Office, Netherlands.

* cited by examiner

FIG. 11A
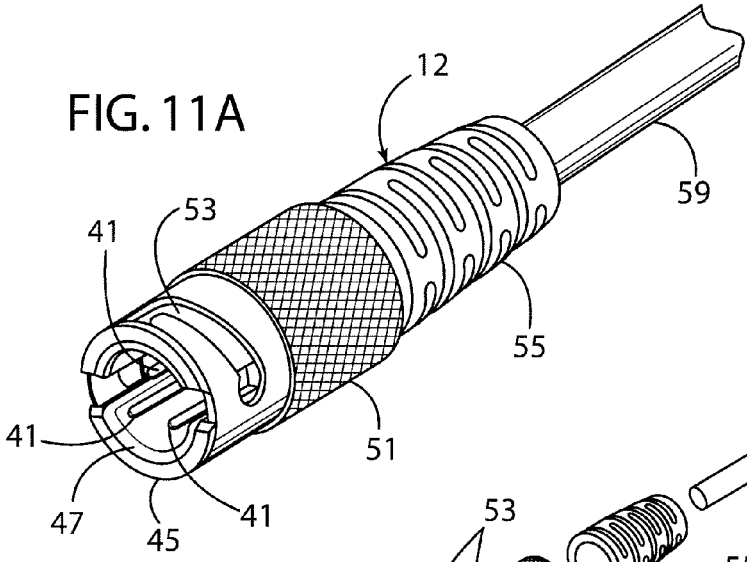
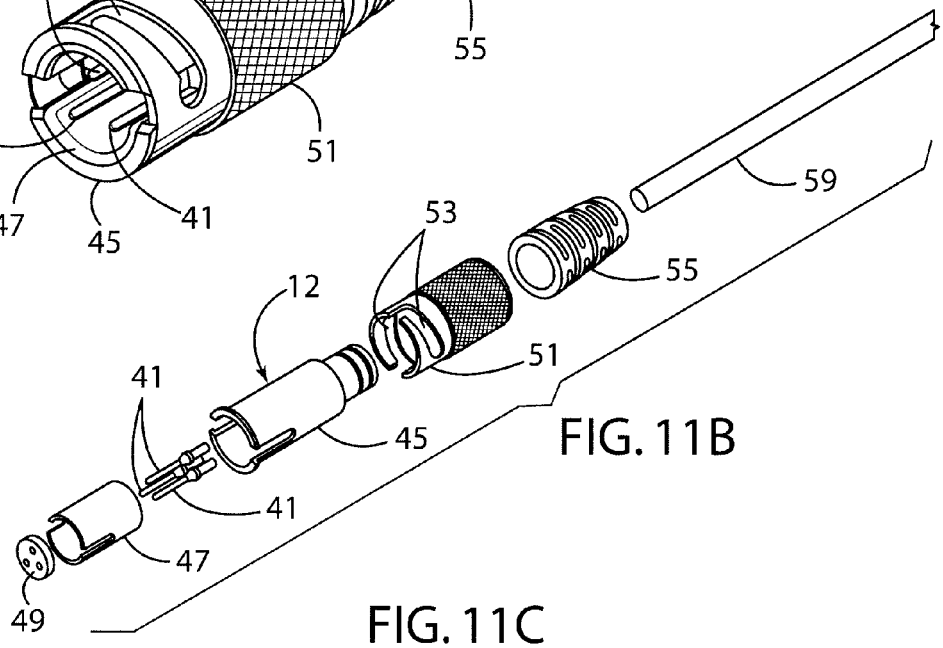
FIG. 11B
FIG. 11C
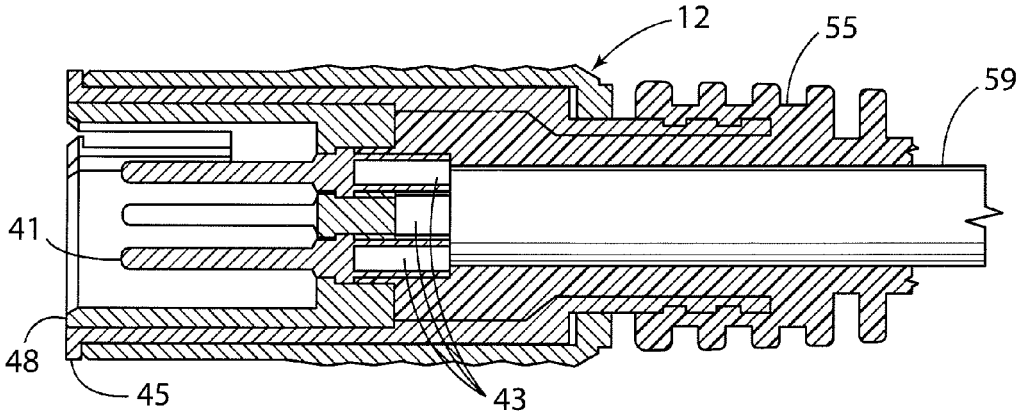

FIG. 14A
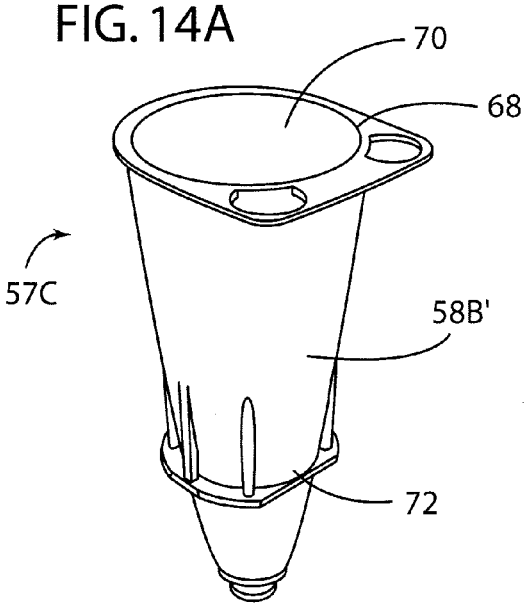
FIG. 14B
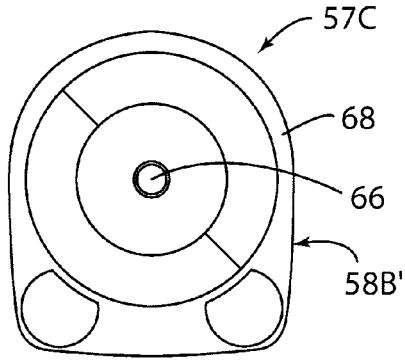
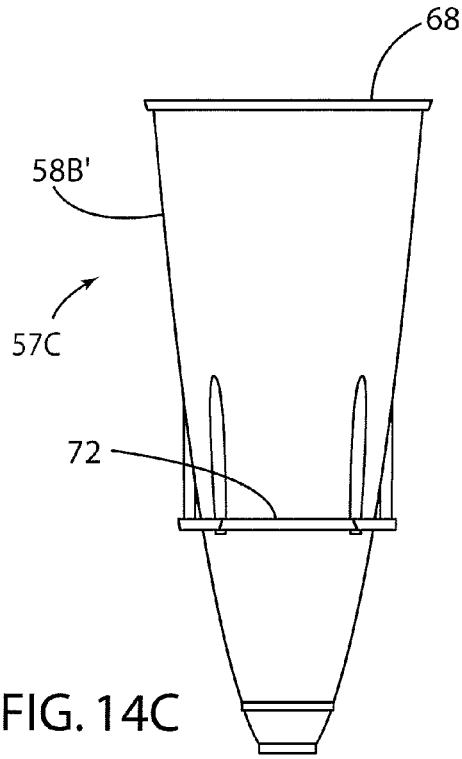
FIG. 14C
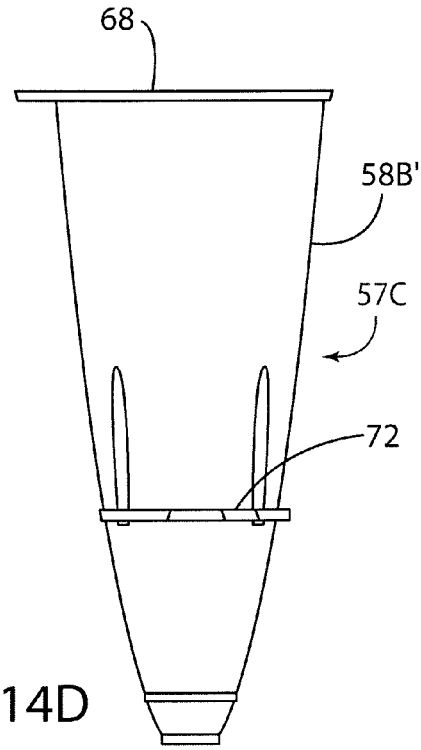
FIG. 14D

LIGHTING DEVICE HAVING CROSS-FADE AND METHOD THEREOF

CROSS-REFERENCE TO RELATED APPLICATION

This application is a continuation of U.S. application Ser. No. 12/113,339, filed May 1, 2008, which is now U.S. Pat. No. 7,888,883 B2, which claimed the benefit under 35 U.S.C. §119(e) of U.S. Provisional Patent Application No. 61/023,632, filed on Jan. 25, 2008, the entire disclosures of which are incorporated herein by reference.

FIELD OF THE INVENTION

The present invention generally relates to a lighting device, and more particularly, to a lighting device that cross-fades illumination patterns and method thereof.

BACKGROUND OF THE INVENTION

Generally, a mobile lighting device, such as a flashlight, is powered by a power source that is internal to the flashlight, such as a battery. Typically, the batteries of the flashlight device can be replaced when the state of charge of the batteries is below an adequate state of charge for providing electrical power for the light source of the flashlight. Since the flashlight is being powered by batteries, the flashlight can generally emit light while not being electrically connected to a power source that is external to the flashlight, such as an alternating current (AC) wall outlet.

Additionally, when the batteries of the flashlight have a state of charge that is below an adequate state of charge level, the batteries can be replaced with other batteries. If the removed batteries are rechargeable batteries, then the removed batteries can be recharged using an external recharging device, and re-inserted into the flashlight. When the removed batteries are not rechargeable batteries, then the non-rechargeable batteries are replaced with new batteries.

Alternatively, a flashlight may contain an electrical connector in order to connect to a specific type of power source, such as the AC wall outlet, in addition to the batteries. Typically, when the flashlight is connected to the stationary external power supply, the flashlight can continue to illuminate light, but the mobility of the flashlight is now hindered. If the flashlight is directly connected to the AC wall outlet, then the mobility of the flashlight is generally eliminated. When the flashlight is not directly connected to the AC wall outlet, such as by an extension cord, the flashlight has limited mobility.

SUMMARY OF THE INVENTION

In accordance with one aspect of the present invention, a lighting device is provided that includes a plurality of lighting sources and a controller. The plurality of lighting sources include a first lighting source, wherein the first lighting source emits light in a first illumination pattern, and a second lighting source, wherein the second lighting source emits light in a second illumination pattern that is different from the first illumination pattern, and the first and second illumination patterns at least partially overlap to yield a third illumination pattern. The controller controls first and second intensities of the first and second illumination patterns of the first and second lighting sources, respectively, wherein the third illumination pattern is altered when the controller alters the intensity of the first and second lighting sources.

In accordance with another aspect of the present invention, a lighting device is provided that includes a plurality of lighting sources and a controller. The plurality of lighting sources include a flood lighting source configured to emit light in a flood illumination pattern, and a spot lighting source configured to emit light in a spot illumination pattern. The controller controls first and second electrical powers supplied to the flood and spot lighting sources, respectively, to alter the intensities thereof, such that an intensity of the light emitted from the flood and spot lighting sources is altered substantially proportionally with respect to one another, wherein the first electrical power supplied to the flood lighting source is increased by a substantially equal amount with respect to a decrease in the second electrical power supplied to the spot lighting source.

In accordance with yet another aspect of the present invention, a method of cross-fading illumination patterns of light emitted by a plurality of lighting sources is provided that includes the steps of emitting light at a first intensity from a first lighting source, and emitting light at a second intensity from a second lighting source. The method further includes the step of illuminating a target with the emitted light at the first and second intensities, and cross-fading the first and second lighting sources, wherein the cross-fading includes altering the first and second intensities with respect to one another, such that when the first intensity increases, the second intensity decreases, and when the first intensity decreases, the second intensity increases.

These and other features, advantages, and objects of the present invention will be further understood and appreciated by those skilled in the art by reference to the following specification, claims, and appended drawings.

BRIEF DESCRIPTION OF THE DRAWINGS

The present invention will now be described, by way of example, with reference to the accompanying drawings, in which:

FIG. 11A is a front perspective view of an electrical connector of a lighting system, in accordance with one embodiment of the present invention;

FIG. 11B is an exploded view of the electrical connector of the lighting system, in accordance with one embodiment of the present invention;

FIG. 11C is a cross-sectional view of the electrical connector of the lighting system, in accordance with one embodiment of the present invention;

FIG. 14A is a side perspective view of an optic pack of a spotlight lighting device of a lighting system, in accordance with one embodiment of the present invention;

FIG. 14B is a top plan view of the optic pack of the spotlight lighting device of the lighting system, in accordance with one embodiment of the present invention;

FIG. 14C is a front plan view of the optic pack of the spotlight lighting device of the lighting system, in accordance with one embodiment of the present invention;

FIG. 14D is a side plan view of the optic pack of the spotlight lighting device of the lighting system, in accordance with one embodiment of the present invention;

DETAILED DESCRIPTION OF PREFERRED EMBODIMENTS

Figure 1:
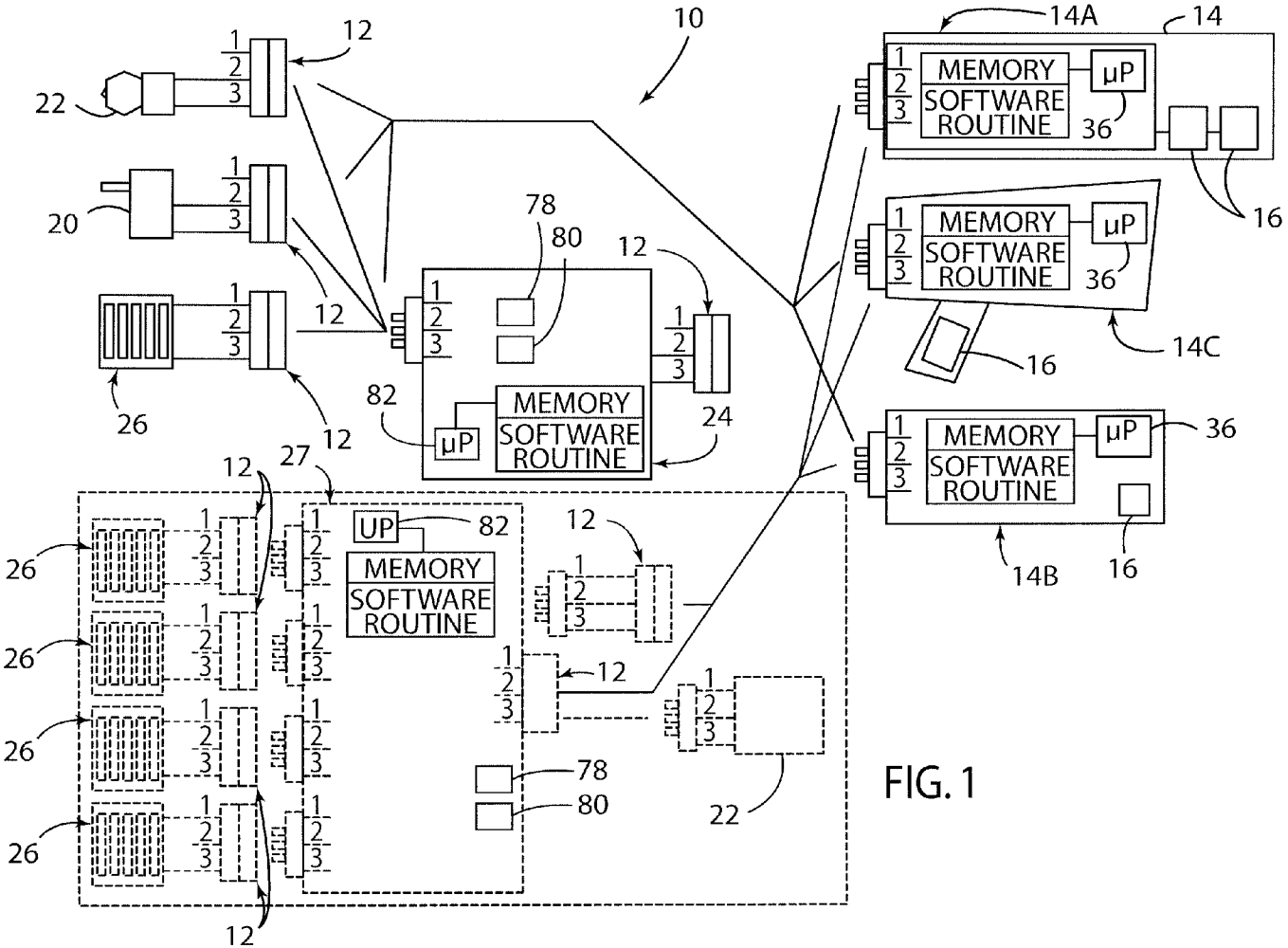
FIG. 1 is a schematic view of a lighting system having a plurality of lighting devices and a plurality of external power sources, in accordance with one embodiment of the present invention.

Before describing in detail embodiments that are in accordance with the present invention, it should be observed that the embodiments include combinations of method steps and apparatus components related to a lighting system and method of operating thereof. Accordingly, the apparatus components and method steps have been represented, where appropriate, by conventional symbols in the drawings, showing only those specific details that are pertinent to understanding the embodiments of the present invention so as not to obscure the disclosure with details that will be readily apparent to those of ordinary skill in the art having the benefit of the description herein. Further, like reference characters in the description and drawings represent like elements.

In this document, relational terms, such as first and second, top and bottom, and the like, may be used to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

I. Lighting System

In reference to FIGS. 1-11, a lighting system is generally shown at reference identifier 10. The lighting system 10 includes at least one lighting device 14, at least one electrical connector generally indicated at 12, and one or more power sources 16,20,22,24,26,27. According to one embodiment, the at least one lighting device includes a handheld lighting device generally indicated at 14A, a headlight lighting device generally indicated at 14B, and a spotlight lighting device generally indicated at 14C. For purposes of explanation and not limitation, the invention is generally described herein with regards to the at least one lighting device including the handheld lighting device 14A, the headlight lighting device 14B, and the spotlight lighting device 14C; however, it should be appreciated by those skilled in the art that the lighting system 10 can include a combination of the lighting devices 14A,14B,14C and/or additional lighting devices. The at least one lighting device typically includes at least one lighting source and an internal power source, generally indicated at 16, that supplies a first electrical current to illuminate the at least one lighting source, as described in greater detail herein. However, it should be appreciated by those skilled in the art that other embodiments include devices that emit the at least one lighting device 14A,14B,14C and/or the internal power source 16. According to one embodiment, the lighting system 10 can include non-lighting devices, such as, but not limited to, a weather radio, a global positioning satellite (GPS) system receiver, an audio player, a cellular phone, the like, or a combination thereof.

According to one embodiment, the at least one lighting source includes a white flood light emitting diode (LED) 18A, a white spot LED 18B, and a red flood LED 18C. Typically, the white flood LED 18A and white spot LED 18B emit a white light having two different illumination patterns, wherein the white flood LED 18A illumination pattern disperses the emitted light over a greater area than the white spot LED 18B, as described in greater detail below. It should be appreciated by those skilled in the art that the white flood LED 18A, white spot LED 18B, and red flood LED 18C can be any desirable color, such as, but not limited to, white, red, blue, suitable colors of light in the visible light wavelength spectrum, infrared, suitable colors of light in the non-visible light wavelength spectrum, the like, or a combination thereof.

According to one embodiment, the flood beam pattern illuminates a generally conical shaped beam having a circular cross-section with a target size in diameter of approximately two meters (2 m) or greater at a target distance of approximately one hundred meters (100 m), and the spot beam pattern illuminates a generally conical shaped beam having a circular cross-section with a target size in diameter of approximately less than one meter (1 m) at a target distance of two meters (2 m). Thus, the flood beam pattern can be defined as the light being emitted at a half angle of twelve degrees (12°) or greater with respect to the lighting source 18A, and the spot beam pattern can be defined as the light being emitted at a half angle of less than twelve degrees (12°) with respect to the lighting source 18B. According to one embodiment, the spot lighting source 18B can have a half angle of less than or equal to approximately five degrees (5°) for the handheld and headlight lighting devices 14A,14B, and a half angle of less than or equal to approximately two degrees (2°) for the spotlight lighting device 14C. The red flood LED 18C can have a similar illumination pattern to the white flood LED 18A while emitting a red-colored light. According to one embodiment, the term illumination pattern generally refers to the size and shape of the illuminated area at a target distance, angles of the emitted light, the intensity of the emitted light across the beam, the illuminance of the beam (e.g., the total luminous flux incident on a surface, per unit area), or a combination thereof. The shape of the illumination pattern can be defined as the target area containing approximately eighty percent to eighty-five percent (80%-85%) of the emitted light.

It should be appreciated by those skilled in the art that the flood and/or the spot illumination patterns can form or define shapes other than circles, such as, but not limited to, ovals, squares, rectangles, triangles, symmetric shapes, non-symmetric shapes, the like, or a combination thereof. It should further be appreciated by those skilled in the art that the lighting sources 18A,18B,18C can be other combinations of lighting sources with different illumination patterns, such as, but not limited to, two or more flood lighting sources, two or more spot lighting sources, or a combination thereof.

For purposes of explanation and not limitation, the invention is generally described herein with regards to the at least one lighting source including the white flood LED 18A, the white spot LED 18B, and the red flood LED 18C. However, it should be appreciated by those skilled in the art that the lighting system 10 can include lighting devices 14A,14B,14C having a combination of lighting sources 18A,18B,18C and/or additional lighting sources. According to one embodiment, the light sources 18A,18B,18C are connected to a LED circuit board 19, as described in greater detail below.

The plurality of power sources include a plurality of external power sources, wherein the plurality of external power sources include at least first and second external power sources that are adapted to be electrically connected to the at least one lighting device by the at least one electrical connector 12. Typically, the electrical connector 12 electrically connects the external power source to the lighting device 14A, 14B,14C. By way of explanation and not limitation, the plurality of external power sources can include an alternating current (AC), such as a 120 Volt wall outlet, power source 20, a direct current (DC) power source 22, such as an outlet in a vehicle, an energy storage system generally indicated at 24, a solar power source 26, a solar power energy storage system 27, the like, or a combination thereof. It should be appreciated by those skilled in the art that other types of external power sources can be configured to connect with the lighting device 14A,14B,14C.

For purposes of explanation and not limitation, the handheld lighting device 14A can be adapted to be held by a single hand of a user, wherein the hand of the user wraps around the longitudinally extending handheld lighting device 14A. Thus, a thumb of the user's hand is positioned to actuate at least one switch SW1,SW2,SW3, or SW4, which alters the light emitted by the handheld lighting device 14A, as described in greater detail herein. The headlight lighting device 14B can be adapted to be placed over a user's head using a headband 21, wherein the user actuates the at least one switch SW1,SW2,SW3, or SW4 using one or more fingers of the user's hand in order to alter the light emitted from the headlight lighting device 14B, as described in greater detail herein. Thus, a user generally directs the light emitted by the headlight lighting device 14B by moving their head. Additionally or alternatively, the spotlight lighting device 14C is adapted to be held in the hand of a user, wherein the user's hand wraps around a handle portion 17 of the spotlight lighting device 14C. Typically, a user's hand is positioned on the handle portion 17, such that an index finger of the user's hand can actuate switches SW1,SW2, or SW3, and a middle finger of the user's hand can be used to actuate switch SW4, which alters the light emitted by the spotlight lighting device 14C, as described in greater detail herein. Generally, the spotlight lighting device 14C illuminates objects with the light emitted from the lighting source 18B at a greater distance than objects illuminated by light emitted from the handheld lighting device 14A and headlight lighting device 14B.

Typically, the lighting devices 14A,14B,14C include the internal power source 16, and are electrically connected to the external power sources 20,22,24,26, or 27 by the electrical connector 12. The lighting devices 14A,14B,14C can be electrically connected to the external power sources 20,22,24,26, or 27 at the discretion of the user of the lighting system 10, such that the lighting devices 14A,14B,14C are not consuming electrical power from the internal power source 16 when the lighting devices 14A,14B,14C are electrically connected to one of the external power sources 20,22,24,26, or 27. Thus, if a user does not desire to consume the electrical power of the internal power source 16 or the state of charge of the internal power source 16 is below an adequate level, the user can electrically connect one of the external power sources 20,22, 24,26, or 27 to the lighting device 14A,14B,14C, such that the electrically connected power source 20,22,24,26, or 27 supplies an electrical current to the lighting source 18A,18B, 18C, according to one embodiment. Further, one or more of the external power sources can be a rechargeable power source that can be charged by other external power sources of the lighting system 10, or other power sources external to the lighting system 10.

According to one embodiment, the first external power source supplies a second electrical current to the at least one lighting device to illuminate the at least one lighting source 18,18B,18C, and the second external power source supplies a third electrical current to illuminate the at least one lighting source 18A,18B,18C, such that the internal power source 16 and one of the plurality of external power sources each supply electrical current to illuminate the at least one lighting source 18A,18B,18C at different times, as described in greater detail herein. The first, second, and third electrical currents are supplied at at least two different voltage potentials. According to one embodiment, the AC power source 20 receives electrical current from an AC source at a voltage potential ranging from substantially ninety Volts (90 VAC) to two hundred forty Volts (240 VAC) at fifty hertz (50 Hz) or sixty hertz (60 Hz), and supplies an electrical current to the lighting devices 14A,14B,14C at a voltage potential of about substantially 12 Volts, the DC power source 22 supplies the electrical current at a voltage potential of about substantially 12 Volts, the energy storage system 24 and solar power energy storage system 27 supply the electrical current at a voltage potential of about substantially 3.6 Volts, and the solar power source 26 supplies the electrical current at a voltage potential of substantially 8 Volts. According to one embodiment, the internal power source 16 can be an electrochemical cell battery configured as a 1.5 Volt power source, such as, but not limited to, an alkaline battery, a nickel metal hydride (NiMH) battery, or the like. Alternatively, the internal power source 16 can be an electrochemical cell battery configured as a 3.6 Volt-3.7 Volt power source, such as a lithium ion (Li-Ion) battery, or the like. Thus, the lighting devices 14A,14B,14C can be supplied with an electrical current having a voltage potential ranging from and including approximately 1.5 Volts to 12 Volts in order to illuminate the lighting sources 18A,18B,18C.

Figure 2A:
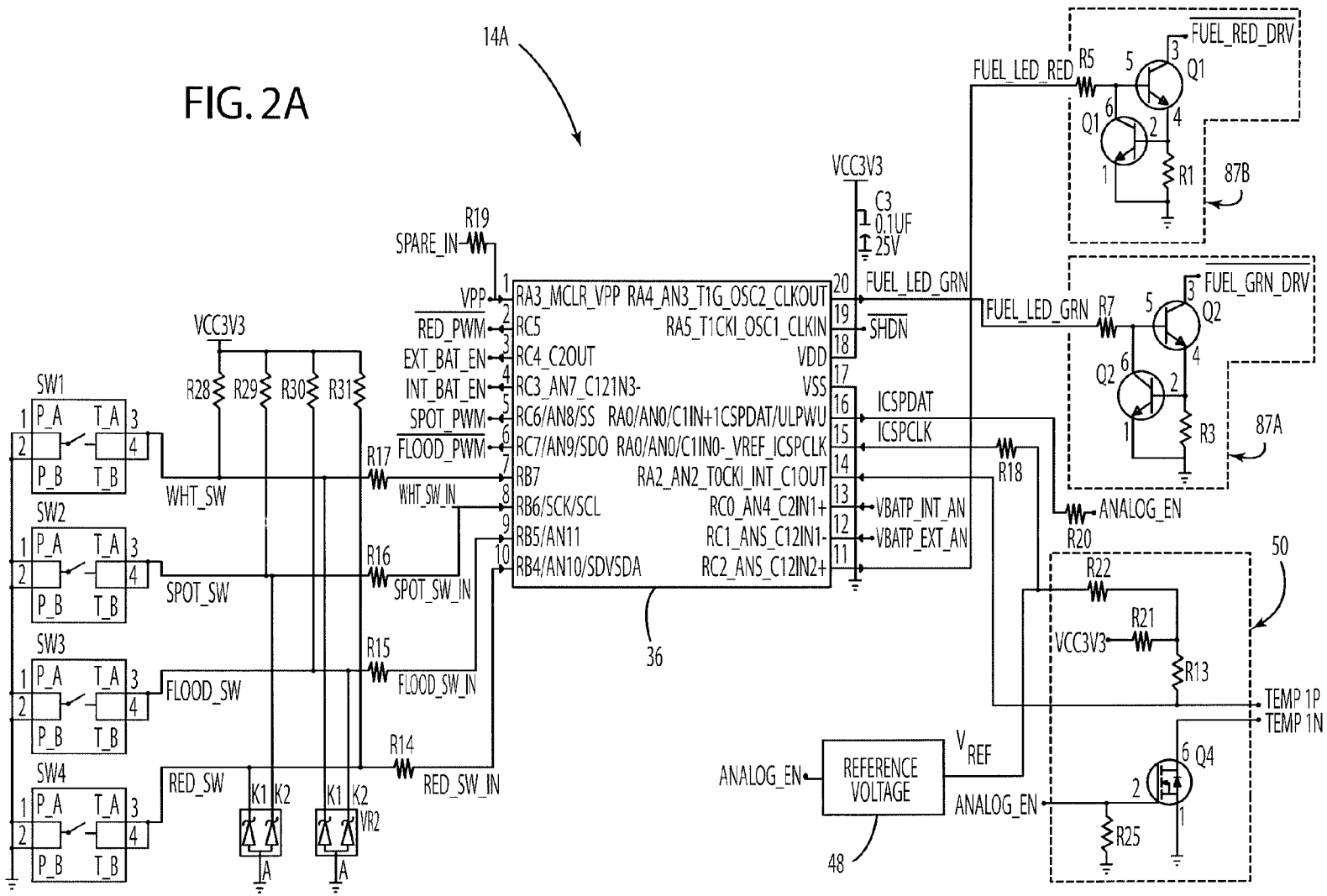
FIG. 2A is a circuit diagram of a handheld lighting device of a lighting system, in accordance with one embodiment of the present invention.
Figure 2B:
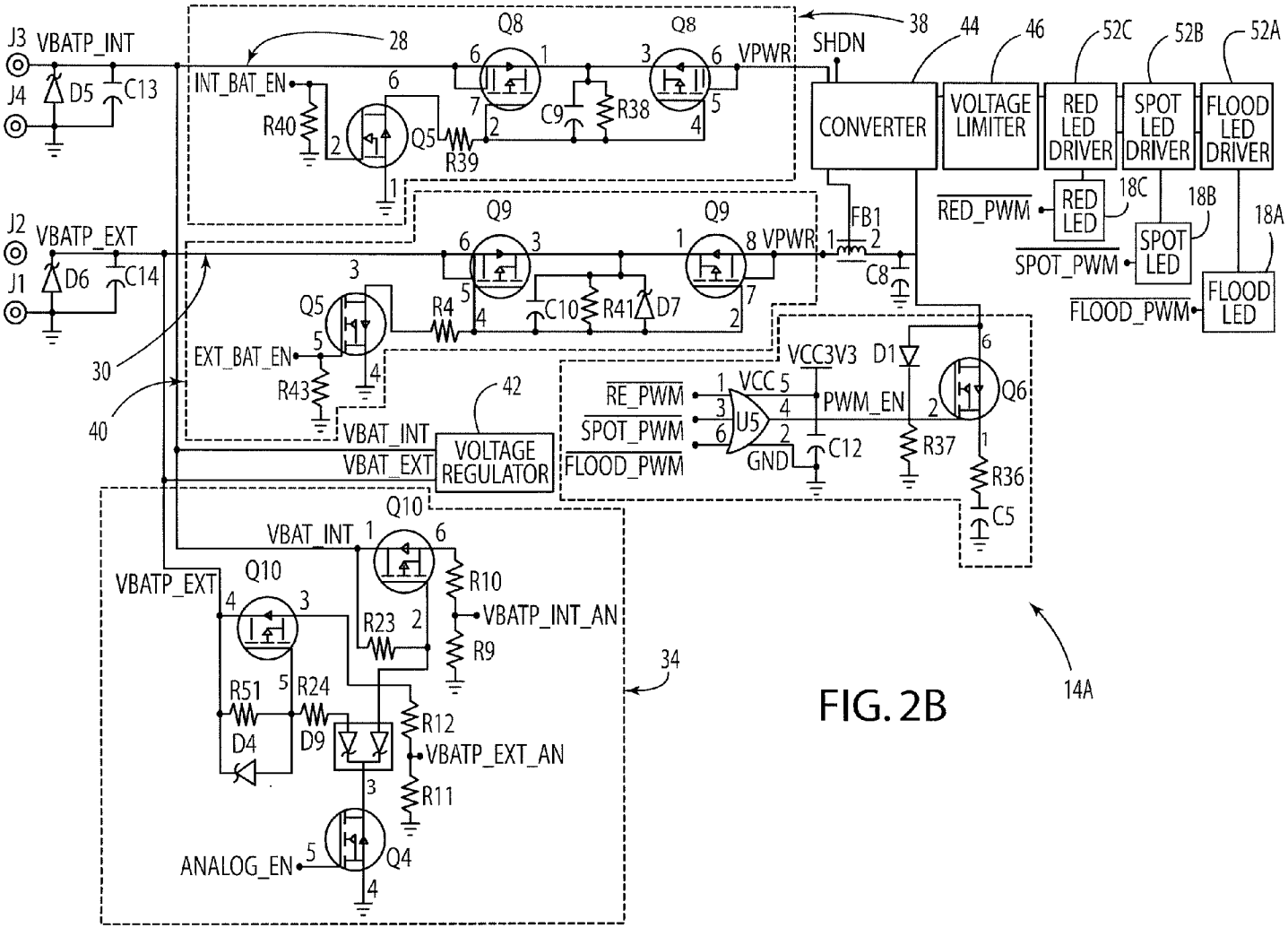
FIG. 2B is a circuit diagram of the handheld lighting device of the lighting system, in accordance with one embodiment of the present invention.
Figure 3A:
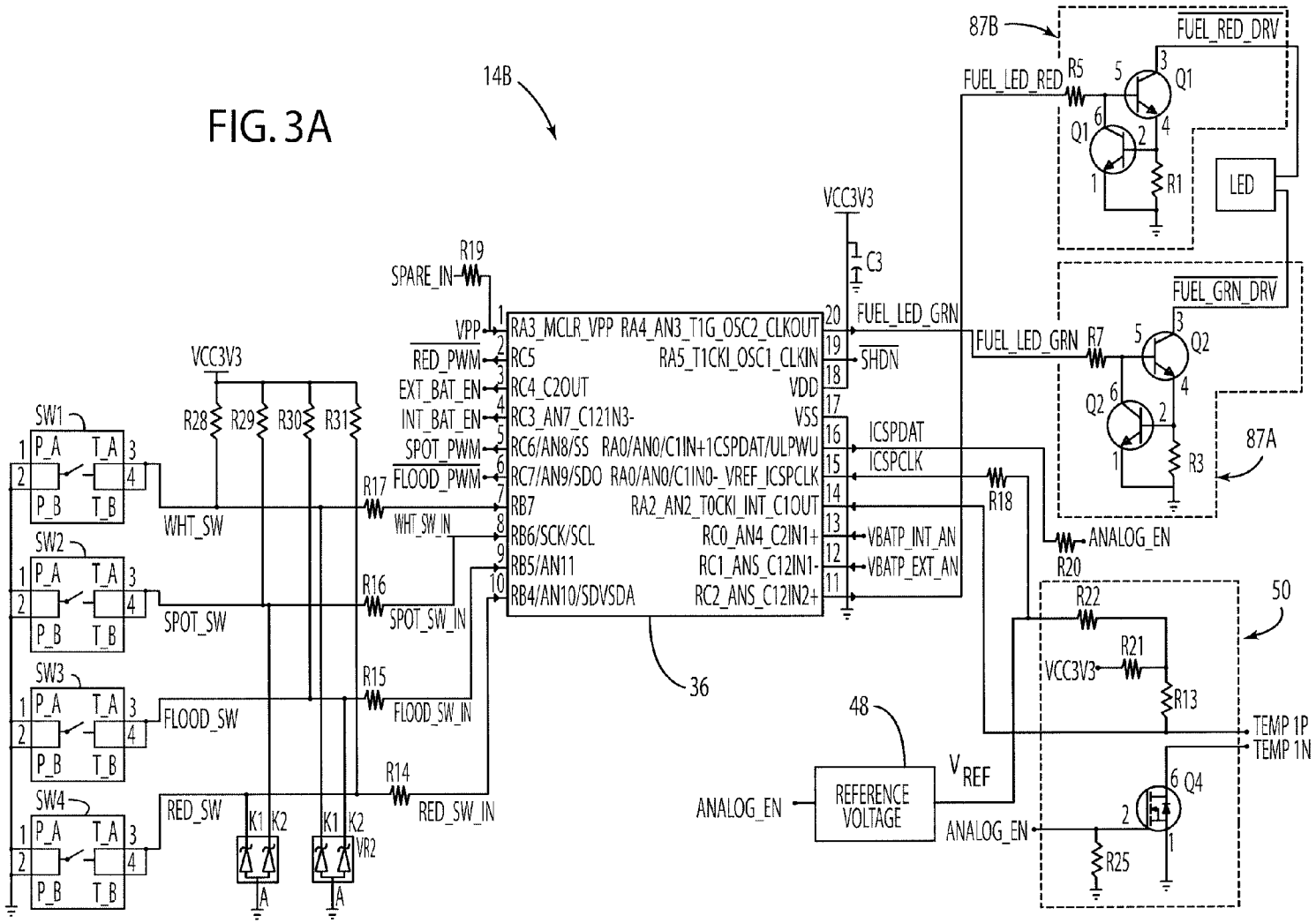
FIG. 3A is a circuit diagram of a headlight lighting device of a lighting system, in accordance with one embodiment of the present invention.
Figure 3B:
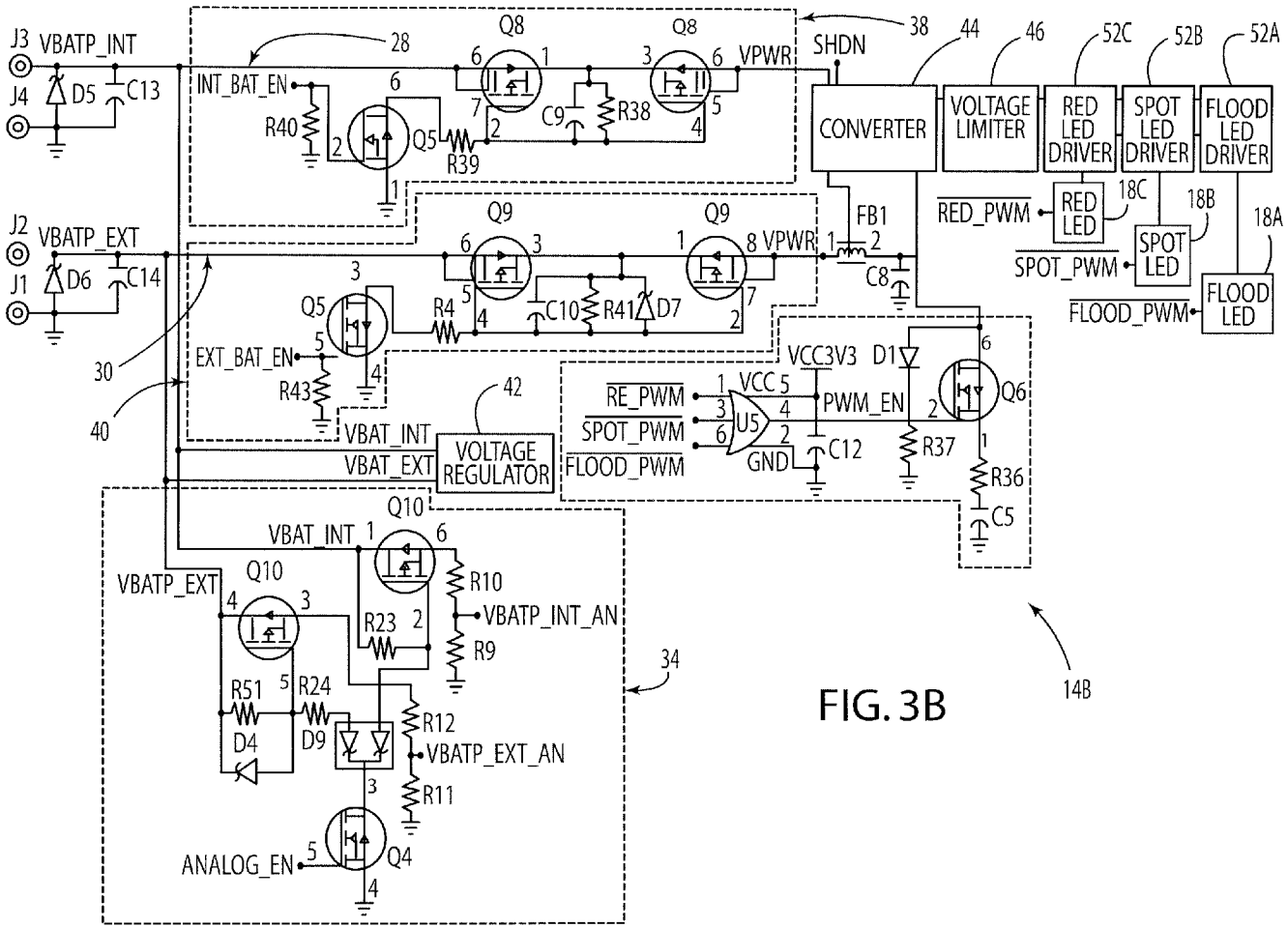
FIG. 3B is a circuit diagram of the headlight lighting device of the lighting system, in accordance with one embodiment of the present invention.
Figure 4A:
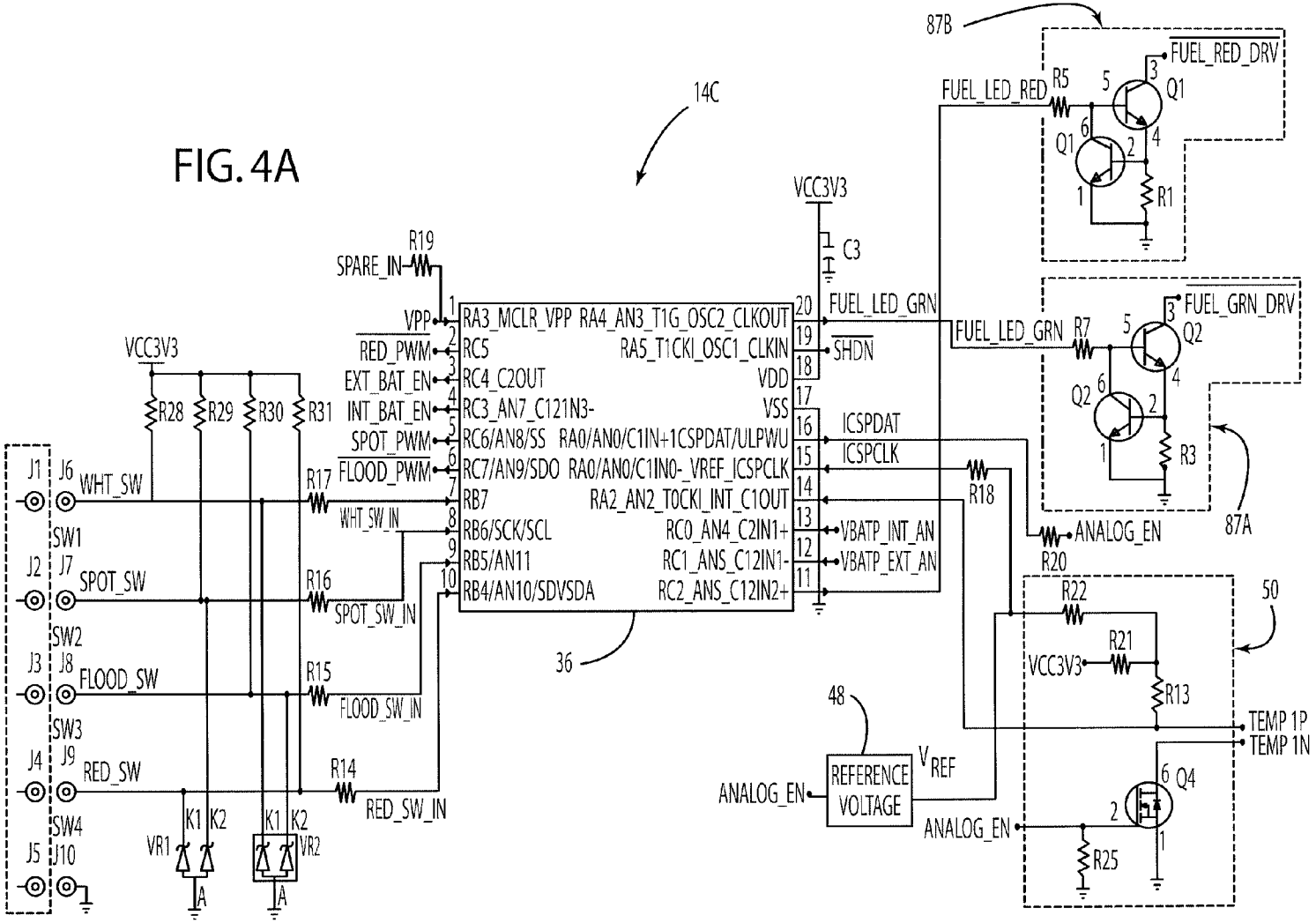
FIG. 4A is a circuit diagram of a spotlight lighting device of a lighting system, in accordance with one embodiment of the present invention.
Figure 4B:
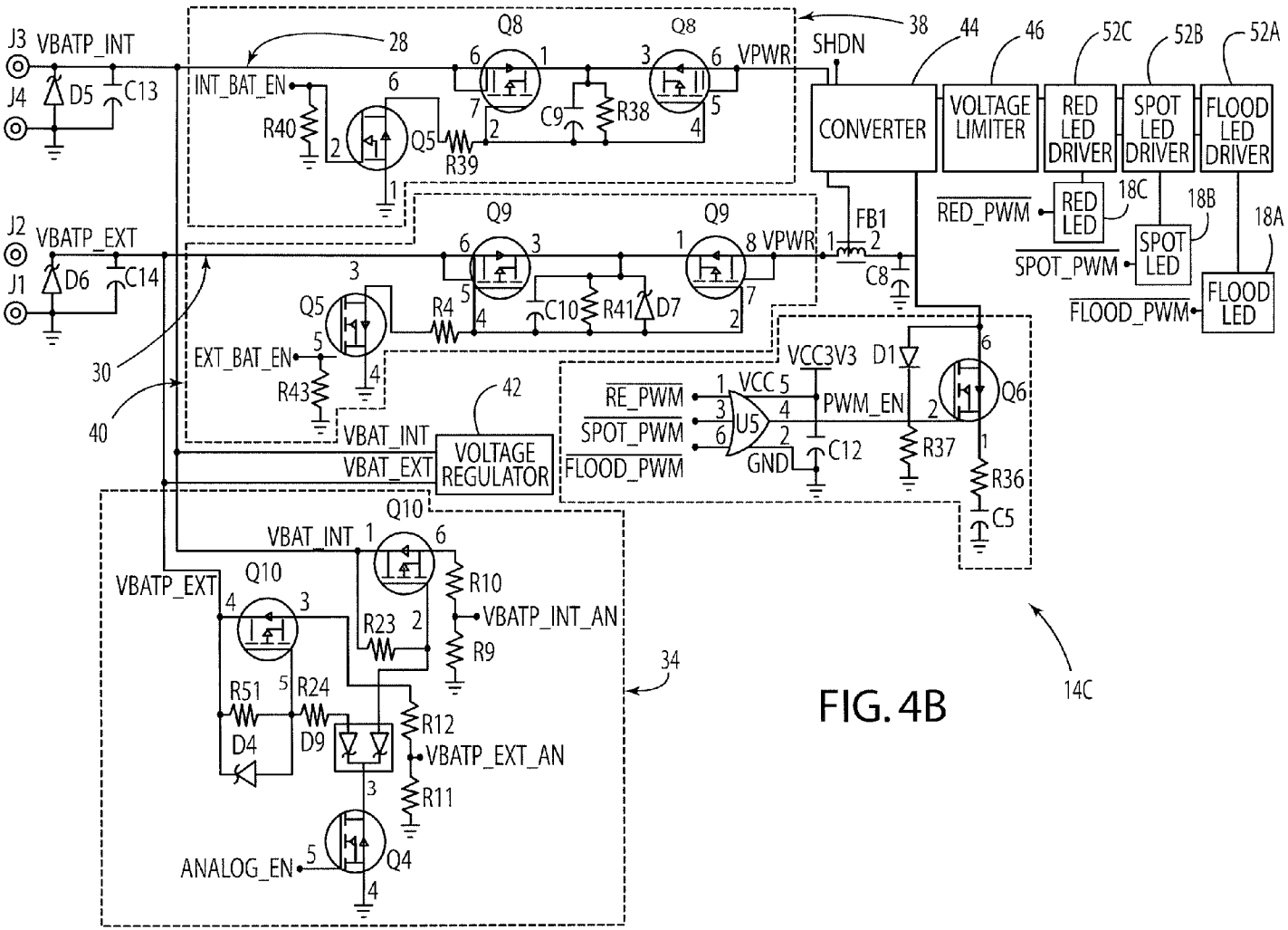
FIG. 4B is a circuit diagram of the spotlight lighting device of the lighting system, in accordance with one embodiment of the present invention.
Figure 5A:
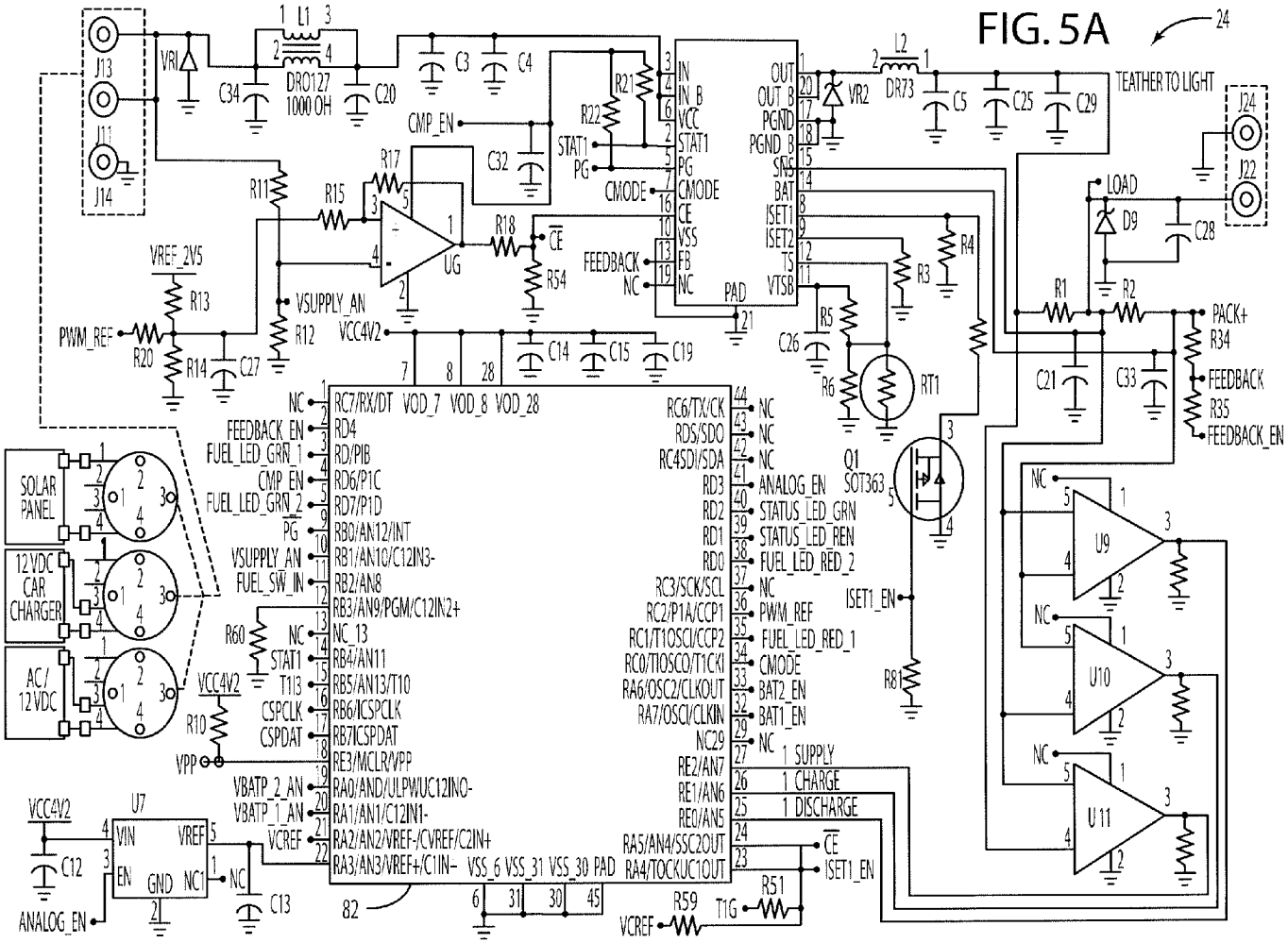
FIG. 5A is a circuit diagram of an energy storage system of a lighting system, in accordance with one embodiment of the present invention.
Figure 5B:
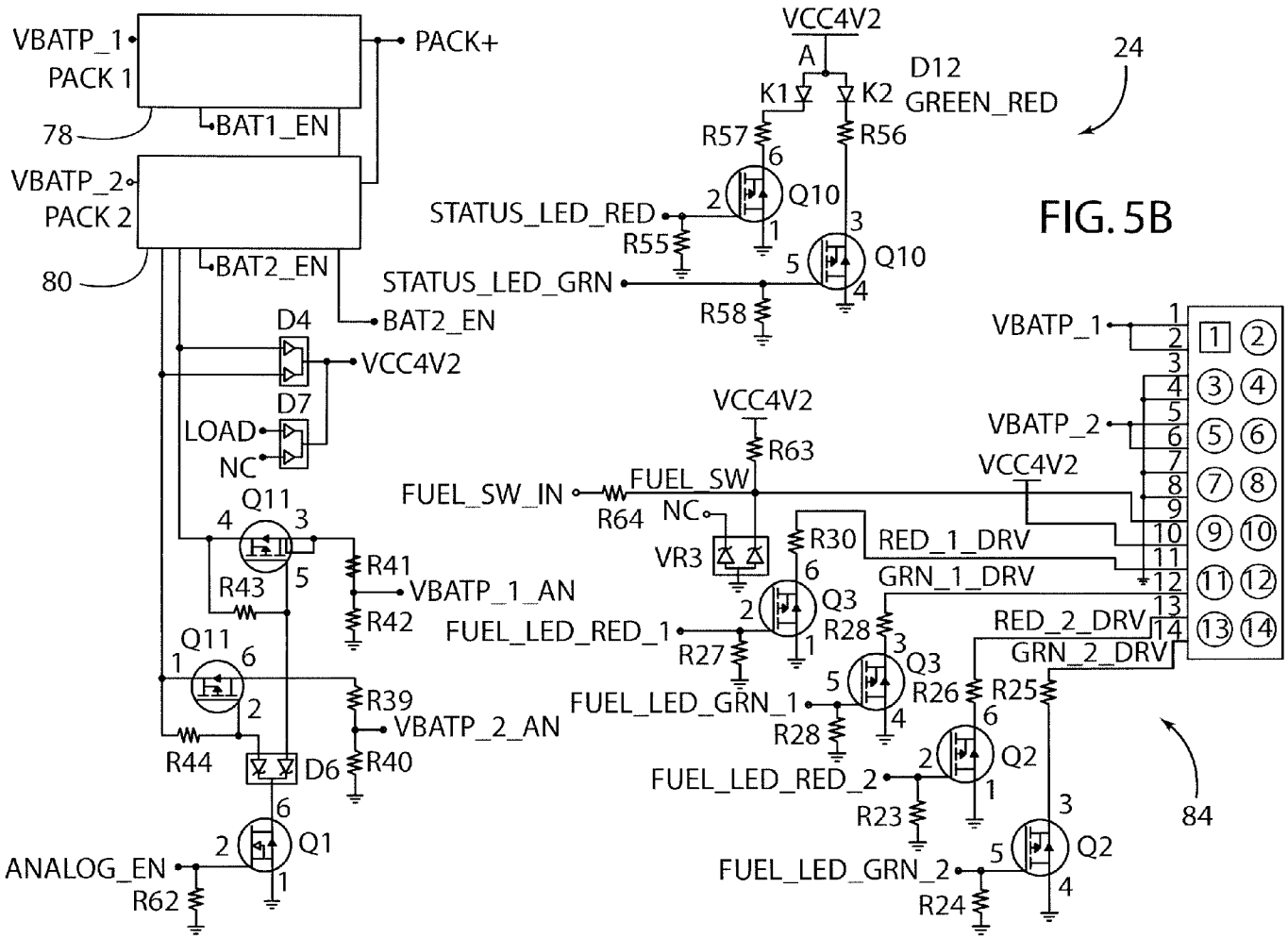
FIG. 5B is a circuit diagram of the energy storage system of the lighting system, in accordance with one embodiment of the present invention.

According to one embodiment, the lighting devices 14A, 14B,14C can each include a first electrical path generally indicated at 28, and a second electrical path generally indicated at 30, wherein both the first electrical path 28 and second electrical path 30 are internal to the lighting device 14A,14B,14C (FIGS. 2B, 3B, and 4B). Typically, the internal power source 16 provides the electrical current to the lighting source 18A,18B,18C through the first electrical path 28, and the plurality of external power sources 20,22,24,26,27 supply the electrical current via the electrical connector 12 to the lighting source 18A,18B,18C through the second electrical path 30, such that the second electrical path 30 bypasses the first electrical path 28. According to an alternate embodiment, the external power sources 20,22,24,26,27, when connected to the lighting device 14A,14B,14C, supply the electrical current via the electrical connector 12 through the second electrical path 30 to illuminate the lighting element 18A,18B, 18C and supply an electrical current to the internal power source 16 to recharge the internal power source. It should be appreciated by those skilled in the art that in such an embodiment, the internal power source 16 is a rechargeable power source (FIG. 1). According to another embodiment, the lighting device 14A,14B,14C is not configured to be electrically connected to the external power sources 20,22,24,26,27, and thus, is not adapted to be connected to the connector 12.

The lighting devices 14A,14B,14C typically include the internal power source 16 and are configured to connect to one of the external power sources 20,22,24,26, or 27 at a time. A battery voltage monitor generally indicated at 34 is in electrical communication with the internal power source 16 and the external power sources 20,22,24,26,27, when one of the external power sources 20,22,24,26, or 27 is connected. The battery voltage monitor 34 determines if the internal power source 16 and external power source 20,22,24,26,27 have a voltage potential. According to one embodiment, a processor or microprocessor 36 powers or turns on transistors Q10 of the battery voltage monitor 34, so that the lighting device 14A,14B, or 14C can determine if the internal power source 16 or the connected external power source 20,22,24,26, or 27 has a voltage potential. Thus, the battery voltage monitor 34 activates a switch to turn on one of an internal battery selector, generally indicated at 38, or an external battery selector, generally indicated at 40. According to one embodiment, the internal battery selector 38 is turned on by switching transistors Q8, which can be back-to-back field-effect transistors (FETs), and the external battery selector 40 is turned on by switching transistors Q9, which can be back-to-back FETs.

Figure 6:
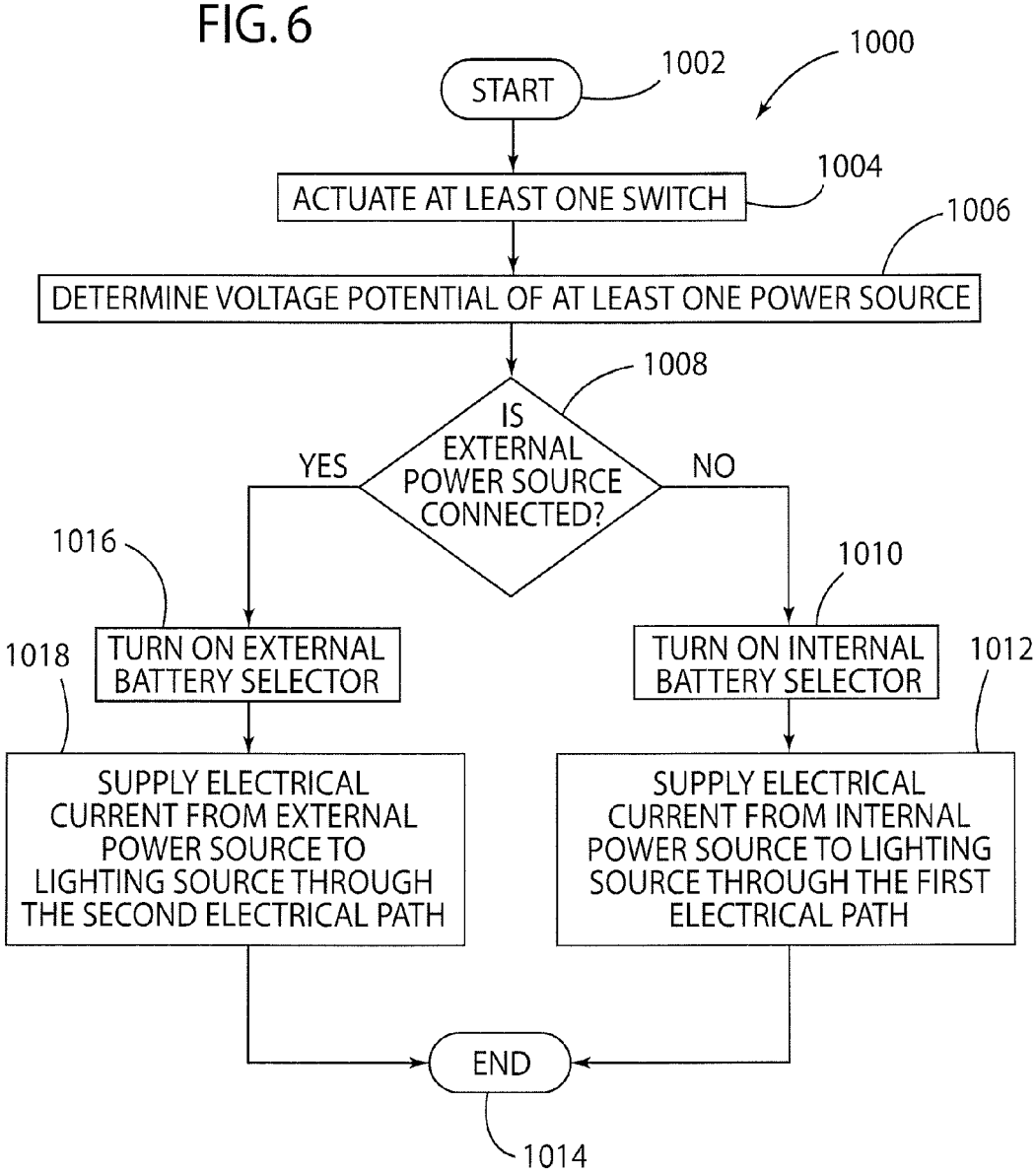
FIG. 6 is a flow chart illustrating a method of an electrical current supported by an external power source bypassing an internal power source of a lighting device of a lighting system, in accordance with one embodiment of the present invention.

In regards to FIGS. 1-6, a method of supplying electrical current from the power sources 16,20,22,24,26,27 is generally shown in FIG. 6 at reference identifier 1000. The method 1000 starts at step 1002, and proceeds to step 1004, wherein the at least one switch SW1 or SW4 is actuated, according to one embodiment. At step 1006, the voltage potential of at least one of the power sources 16,20,22,24,26,27 are determined. At decision step 1008, it is determined if an external power source 20,22,24,26,27 is connected to the lighting device 14A,14B,14C. According to one embodiment, the external power sources 20,22,24,26,27 have a greater voltage potential than the internal power source 16 when the external power source 20,22,24,26,27 is charged (e.g., energy storage system 24), and thus, by determining the voltage potential of the power sources 16,20,22,24,26,27 at step 1006, when there are multiple determined voltage potentials, then the higher voltage potential is assumed to be the external power source 20,22,24,26,27.

If it is determined at decision step 1008 that there is not an external power source 20,22,24,26, or 27 connected to the lighting device 14A,14B,14C, then the method 1000 proceeds to step 1010, wherein the internal battery selector 38 is turned on. At step 1012, electrical current is supplied from the internal power source 16 to a lighting source 18A,18B,18C through the first electrical path 28, and the method 1000 then ends at step 1014. However, if it is determined at decision step 1008 that one of the external power sources 20,22,24,26, or 27 is connected to the lighting device 14A,14B,14C, then the method 1000 proceeds to step 1016, wherein the external battery selector 40 is turned on. At step 1018, electrical current is supplied from the external power source 20,22,24,26, or 27 to the lighting source 18A,18B,18C through the second electrical path 30, and the method 1000 then ends at step 1014. It should be appreciated by those skilled in the art that if the external power source 20,22,24,26, or 27 is connected to the lighting device 14A,14B,14C, after the switch SW1 or SW4 has been actuated to turn on the lighting source 18A, 18B,18C, then the method 1000 starts at step 1002, and proceeds directly to step 1006, wherein the voltage potential of the power sources 16,20,22,24,26,27 is determined.

With regards to FIGS. 1-5 and 7-11, the lighting devices 14A,14B,14C can include a voltage regulator 42. According to one embodiment, the voltage regulator 42 is a 3.3 voltage regulator, wherein the voltage regulator 42 receives an electrical current from the internal power source 16, the external power source 20,22,24,26, or 27, or a combination thereof. Typically, the voltage regulator 42 determines which of the internal power source 16 and the external power source 20,22, 24,26,27 have a higher voltage potential, and uses that power source 16,20,22,24,26, or 27 to power the processor 36. However, it should be appreciated by those skilled in the art that the voltage regulator 42 can include hardware circuitry, execute one or more software routines, or a combination thereof to default to the internal power source 16 or the external power source 20,22,24,26,27, when present, to power the processor 36. Thus, the voltage regulator 42 regulates the voltage of the selected power source 16,20,22,24,26, 27 to supply electrical power at a regulated voltage potential to the processor 36.

Additionally or alternatively, the lighting devices 14A, 14B,14C can include a converter 44, a voltage limiter 46, at least one LED driver, a reference voltage device 48, at least one fuel gauge driver, a temperature monitor device generally indicated at 50, or a combination thereof, as described in greater detail herein. The processor 36 can communicate with a memory device to execute one or more software routines, based upon inputs received from the switches SW1,SW2, SW3,SW4, the temperature monitor device 50, the like, or a combination thereof. According to one embodiment, the converter 44 is a buck-boost converter that has an output DC voltage potential from the input DC voltage potential, and the voltage limiter 46 limits the voltage potential of the electrical current supplied to the lighting sources 18A,18B,18C to suitable voltage potentials. The plurality of LED drivers can include, but are not limited to, a flood LED driver 52A, a spot LED driver 52B, and a red LED driver 52C that corresponds to the respective lighting source 18A,18B,18C. According to one embodiment, the reference voltage device 48 supplies a reference voltage potential of 2.5 Volts to the processor 36 and temperature monitor device 50.

According to one embodiment, the lighting devices 14A, 14B,14C, the AC power source 20, the DC power source 22, or a combination thereof include components that are enclosed in a housing generally indicated at 54. Additionally or alternatively, the energy storage system 24, the solar power source 26, the solar energy storage system 27, or a combination thereof can include components that are enclosed in the housing 54. According to one embodiment, the housing 54 is a two-part housing, such that the housing 54 includes corresponding interlocking teeth 56 that extend along at least a portion of the connecting sides of the housing 54. According to one embodiment, the interlocking teeth 56 on a first part of the two-part housing interlock with corresponding interlocking teeth 56 of a second part of the two-part housing in order to align the corresponding parts of the housing 54 during assembly of the device. The interlocking teeth 56 can also be used to secure the parts of the housing 54. However, it should be appreciated by those skilled in the art that additional connection devices, such as mechanical connection devices (e.g., threaded fasteners) or adhesives, can be used to connect the parts of the housing 54. Further, the interlocking teeth 56 can be shaped, such that a force applied to a portion of the housing 54 is distributed to other portions of the two-part housing 54 along the connection point of the interlocking teeth 56.

Figure 7A:
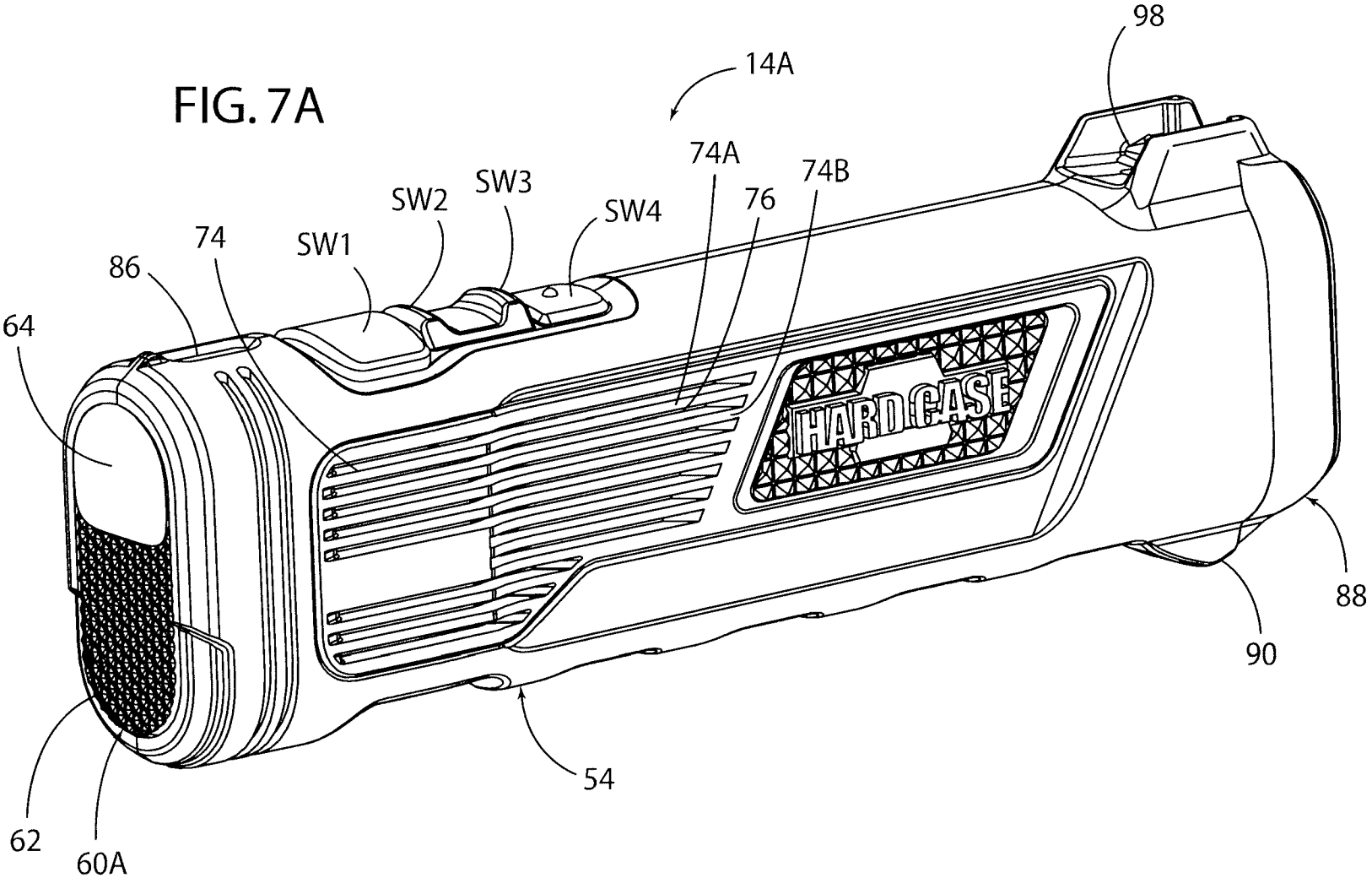
FIG. 7A is front perspective view of a handheld lighting device of a lighting system, in accordance with one embodiment of the present invention.
Figure 7B:
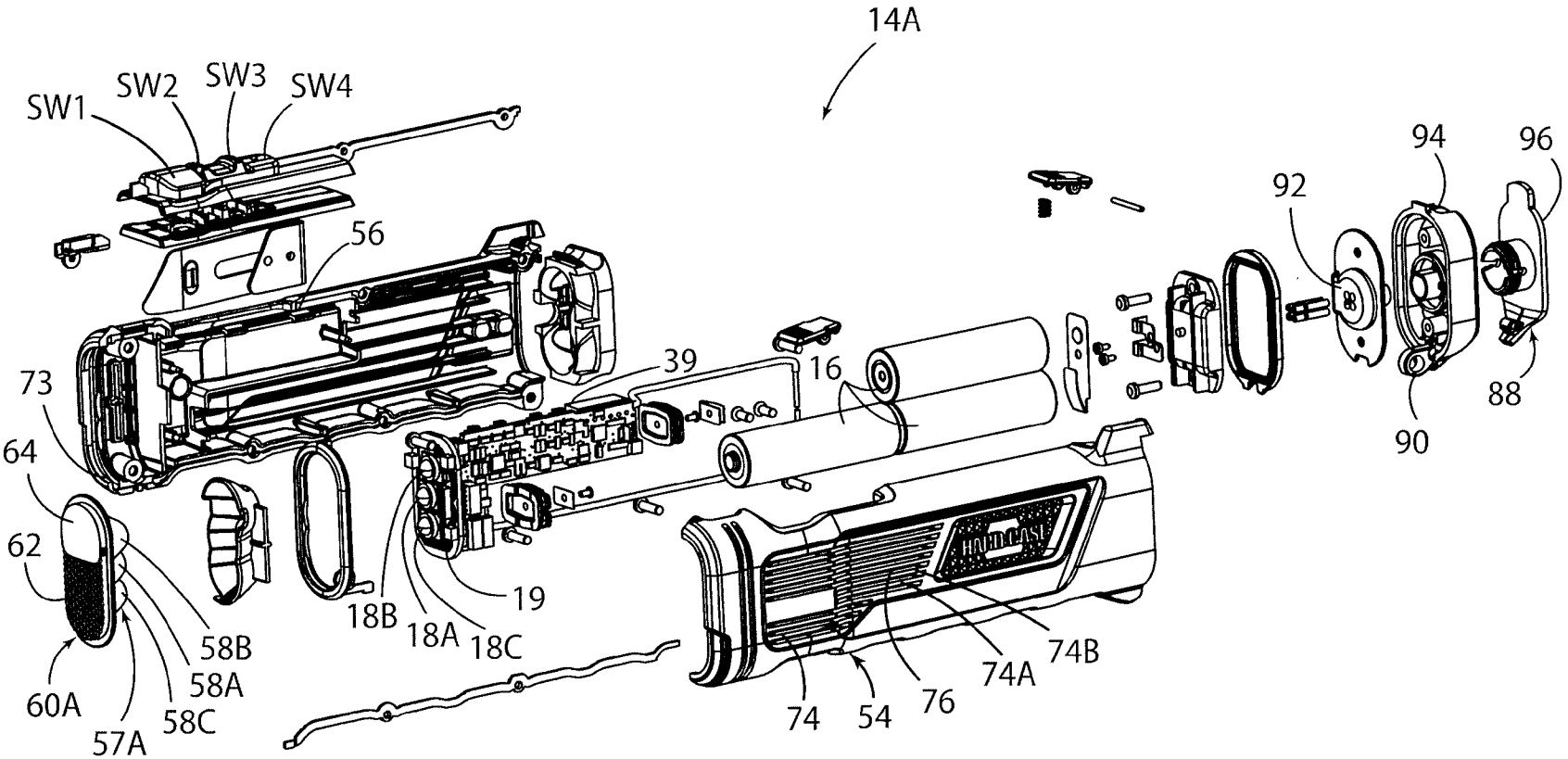
FIG. 7B is an exploded view of the handheld lighting device of the lighting system, in accordance with one embodiment of the present invention.
Figure 7C:
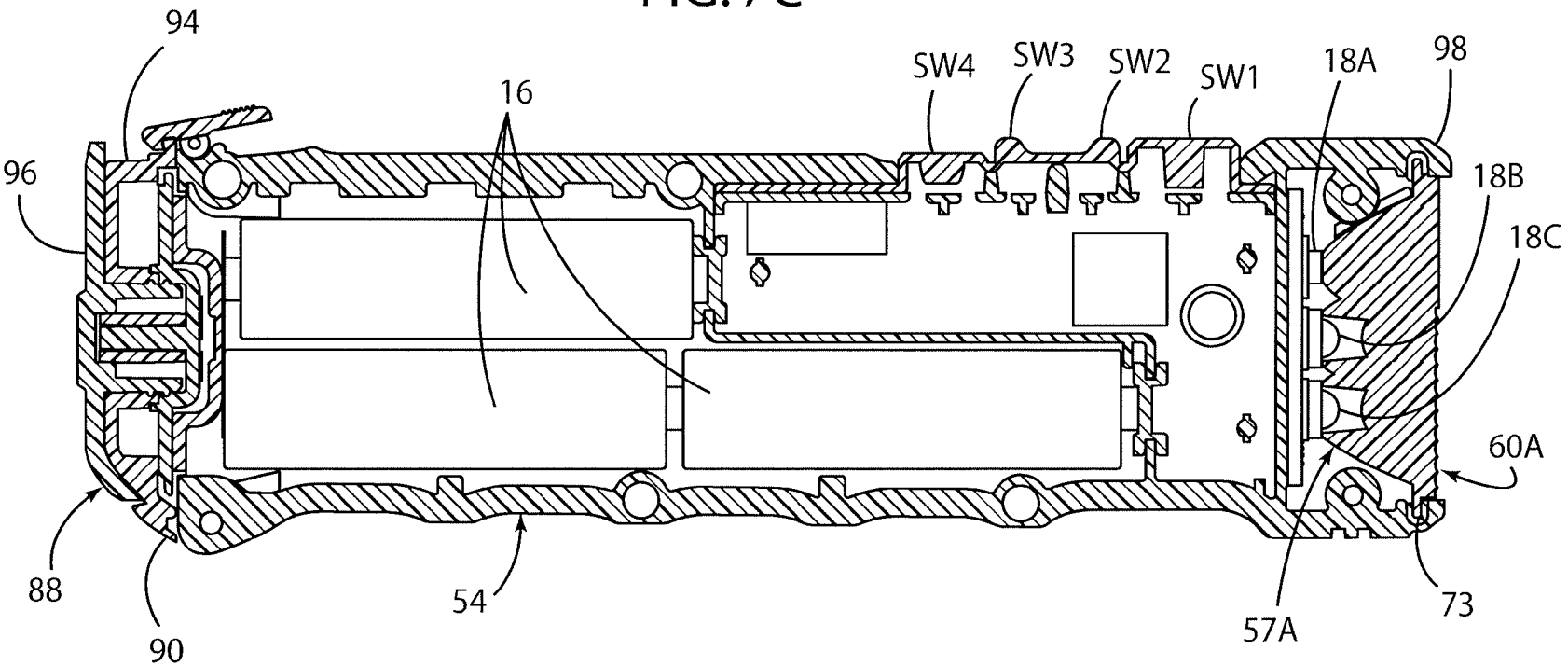
FIG. 7C is a cross-sectional view of the handheld lighting device of the lighting system, in accordance with one embodiment of the present invention.
Figure 7D:
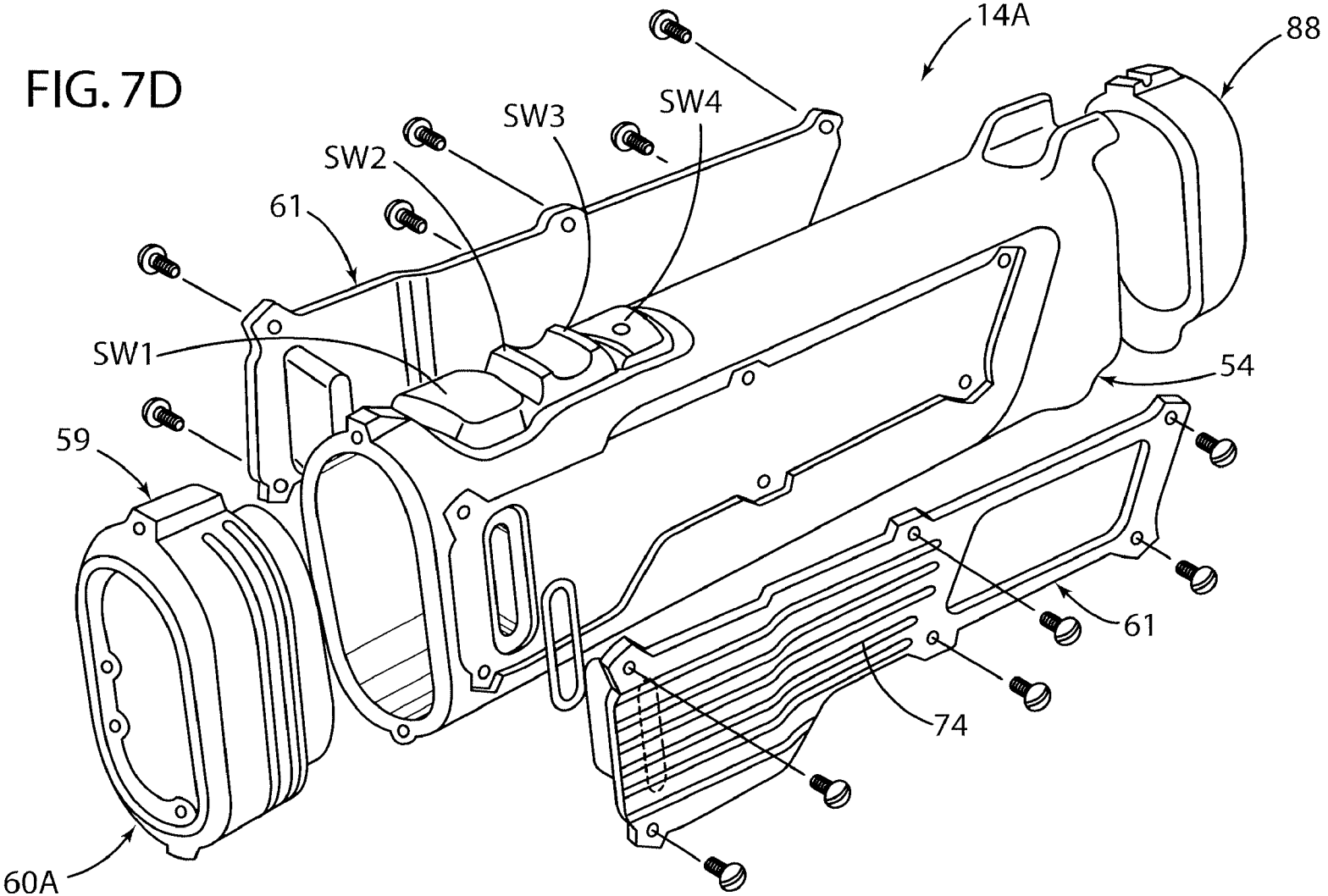
FIG. 7D is an exploded view of a handheld lighting device of a lighting system, in accordance with an alternate embodiment of the present invention.

In accordance with an alternate embodiment shown in FIG. 7D, the housing 54 of the handheld lighting device 14A can be a tubular housing, wherein the internal power source 16 and the circuit board 39 are contained in a longitudinally extending bore of the tubular housing 54. An end cap, generally indicated at 59, can enclose a first end or a front end of the tubular housing 54. According to one embodiment, the end cap 59 includes an optic pack 57, which includes at least the lighting sources 18A,18B,18C, wherein the optic pack 57A is described in greater detail below. Thus, the end cap 59 can be a light emitting end of the handheld lighting device 14A. Additionally, a tail cap assembly, generally indicated at 88, can be used to enclose a second end of the tubular housing 54. The tail cap assembly 88 includes a connector 92, as described in greater detail below. According to one embodiment, the tubular housing 54 can include external features, such as thermally conductive heat sink fins 74. According to an alternate embodiment, an external component 61 can be attached to the tubular housing 54, wherein the external component 61 includes external features, such as the thermally conductive heat sink fins 74. The external component 61 can be attached to the tubular housing 54 by any suitable form of attachment, such as, but not limited to, a mechanical attachment device, an adhesive, the like, or a combination thereof.

Figure 8A:
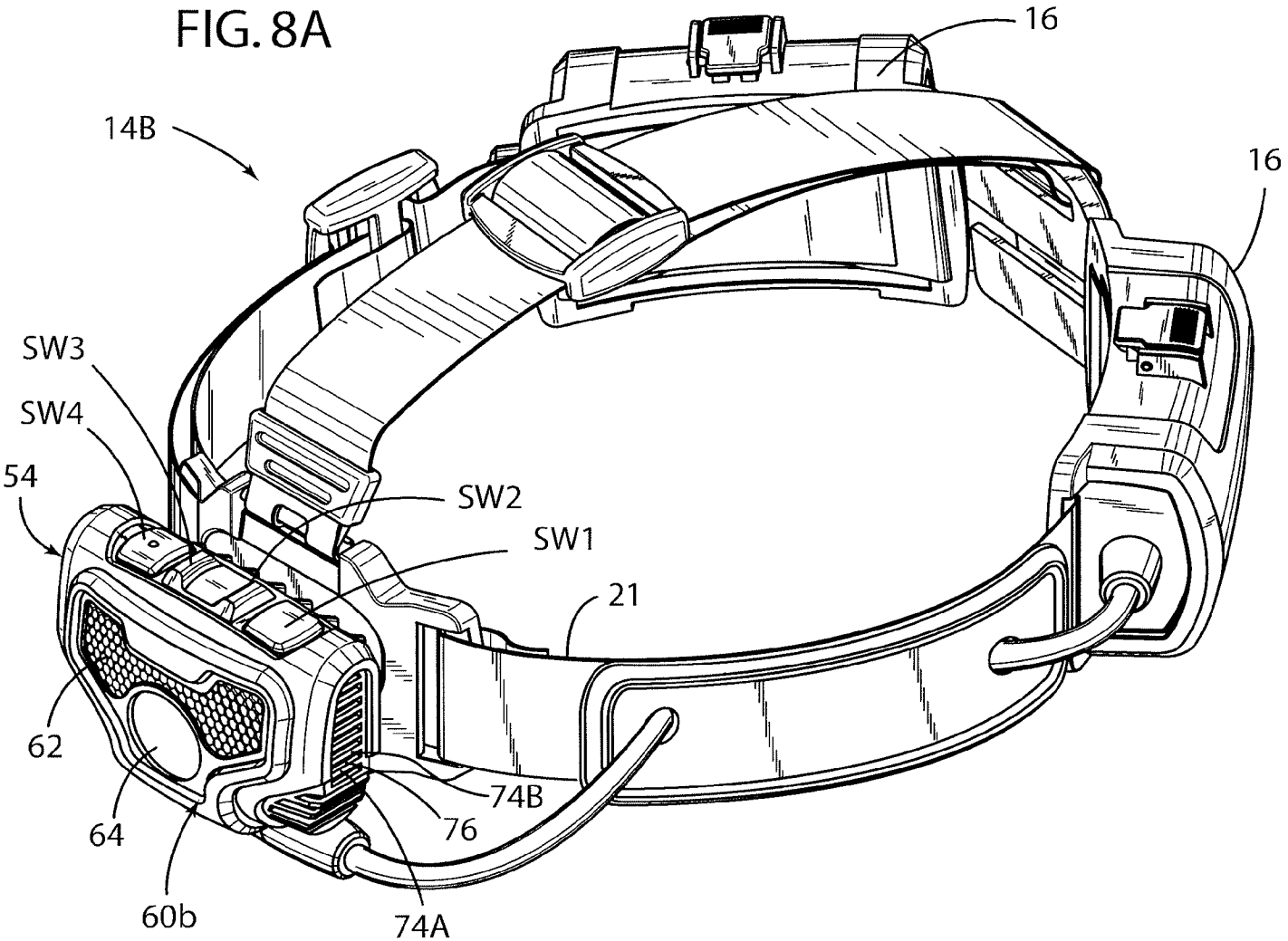
FIG. 8A is a front perspective view of a headlight lighting device of a lighting system, in accordance with one embodiment of the present invention.
Figure 8B:
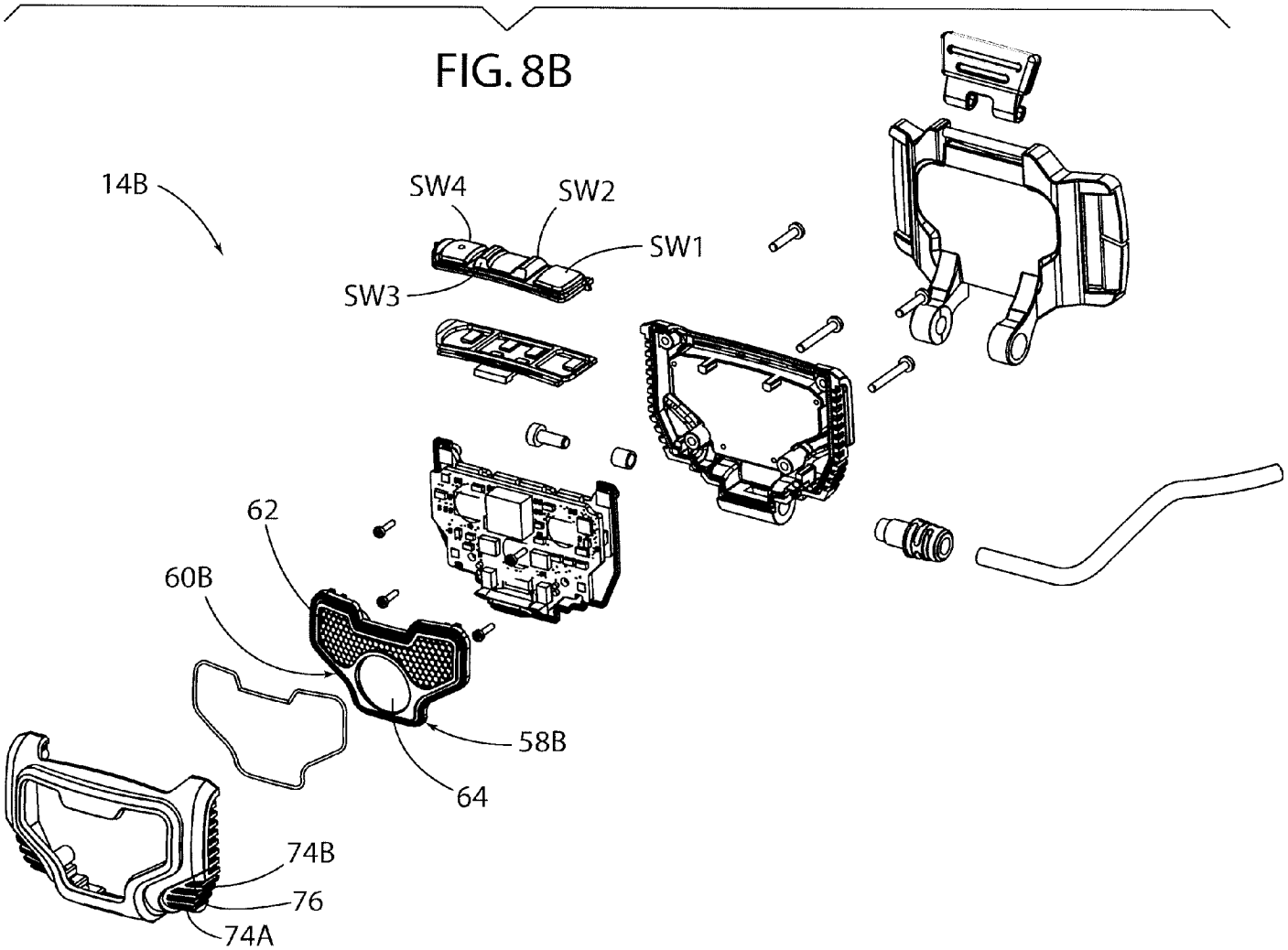
FIG. 8B is an exploded view of the headlight lighting device of the lighting system, in accordance with one embodiment of the present invention.
Figure 8C:
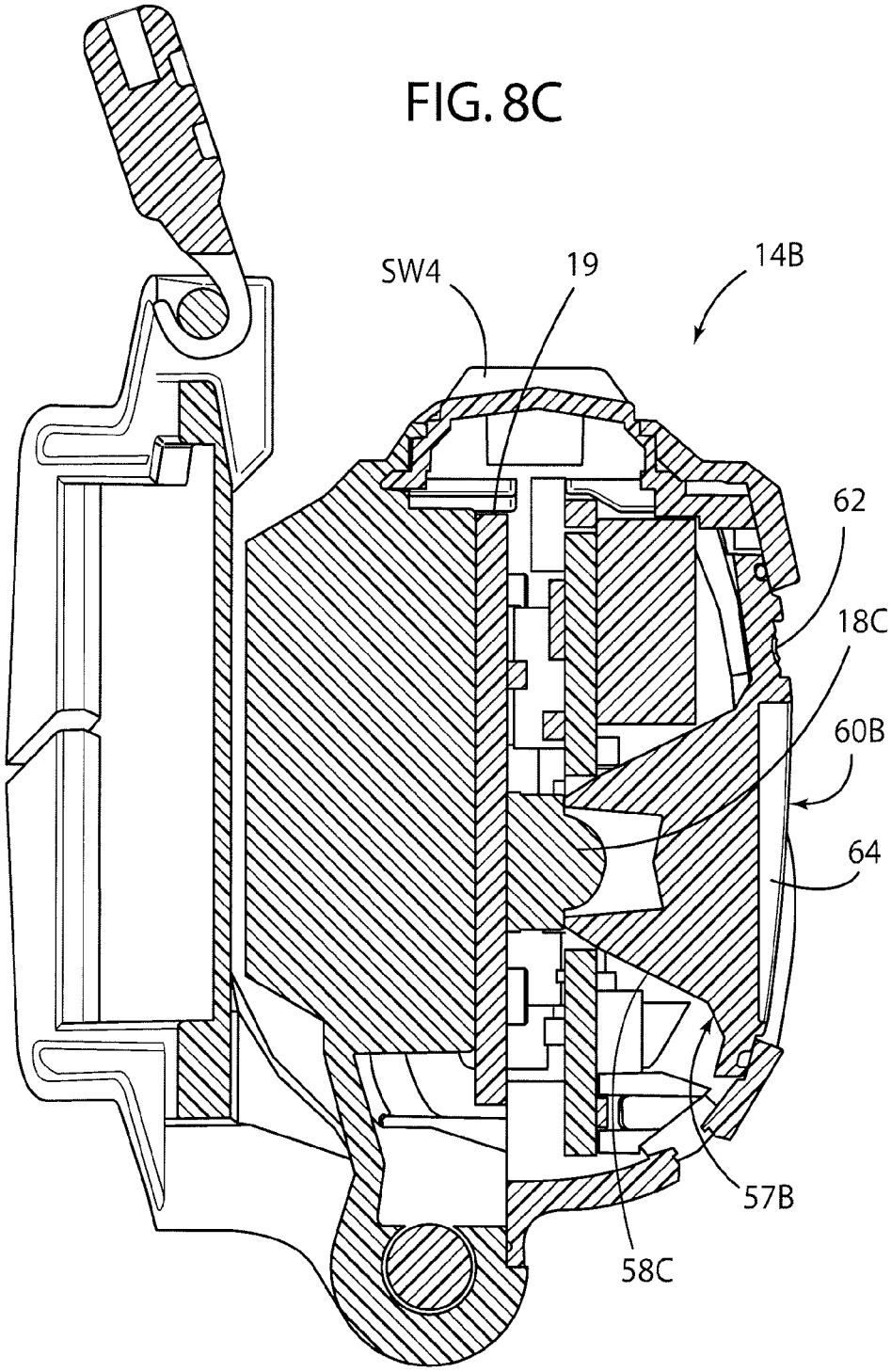
FIG. 8C is a cross-sectional view of the headlight lighting device of the lighting system, in accordance with one embodiment of the present invention.
Figure 8D:
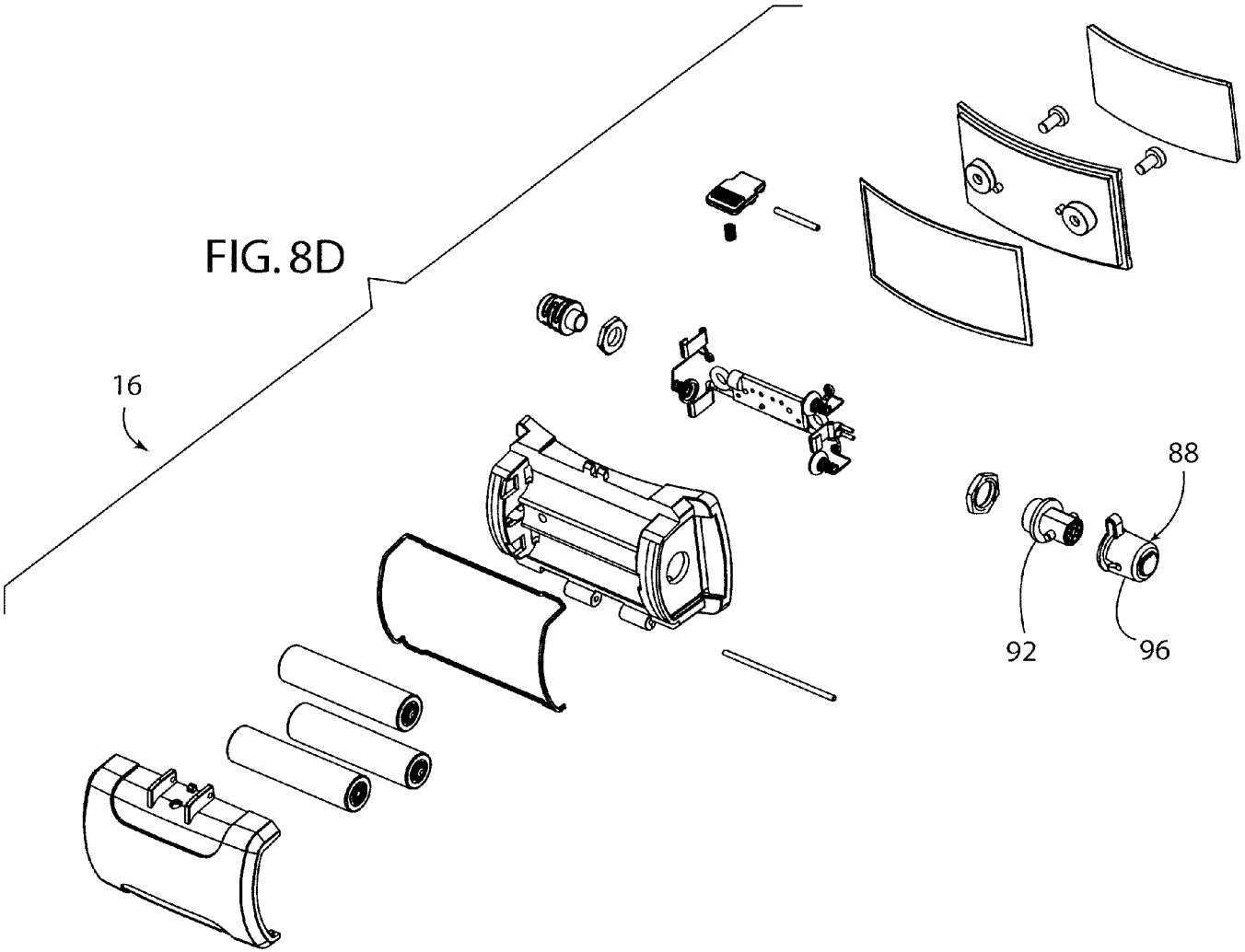
FIG. 8D is an exploded view of an internal power source of the headlight lighting device of the lighting system, in accordance with one embodiment of the present invention.
Figure 9A:
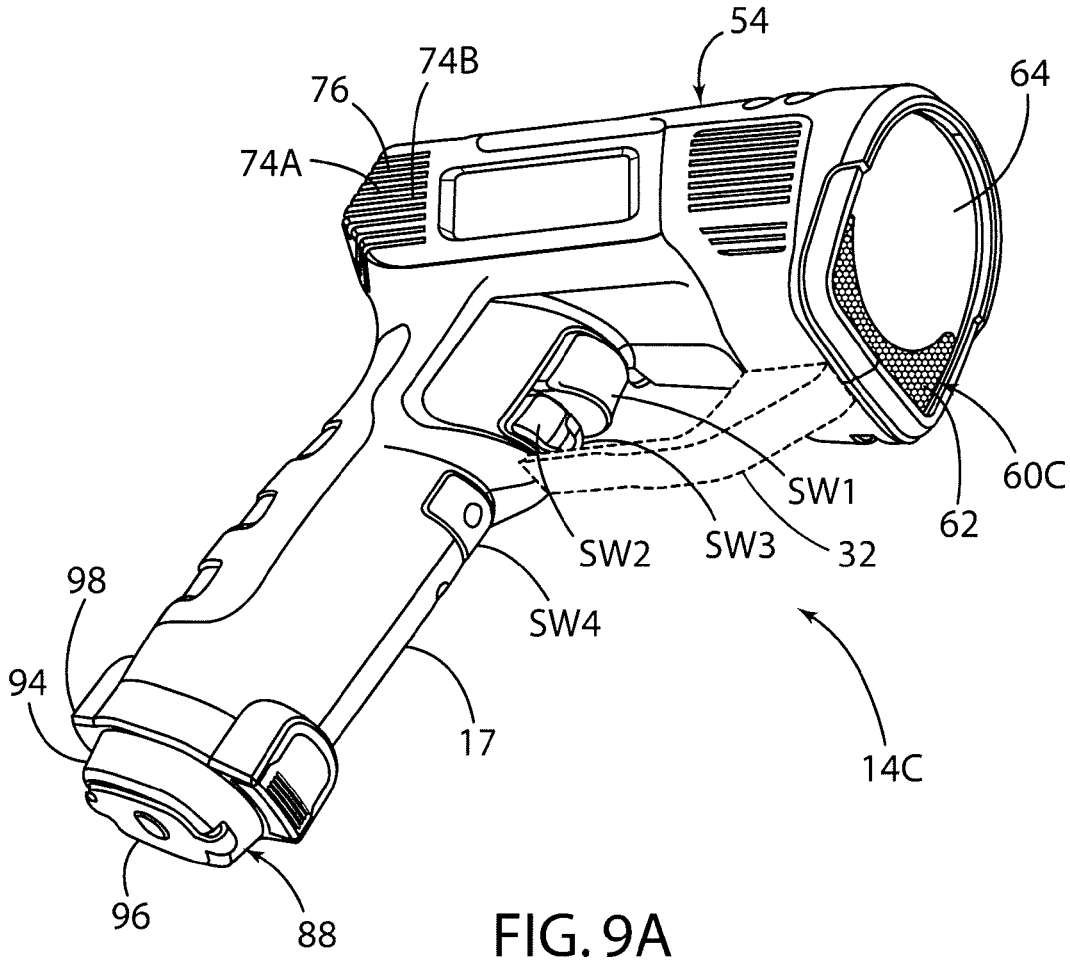
FIG. 9A is a side perspective view of a spotlight lighting device of a lighting system, in accordance with one embodiment of the present invention.
Figure 9B:
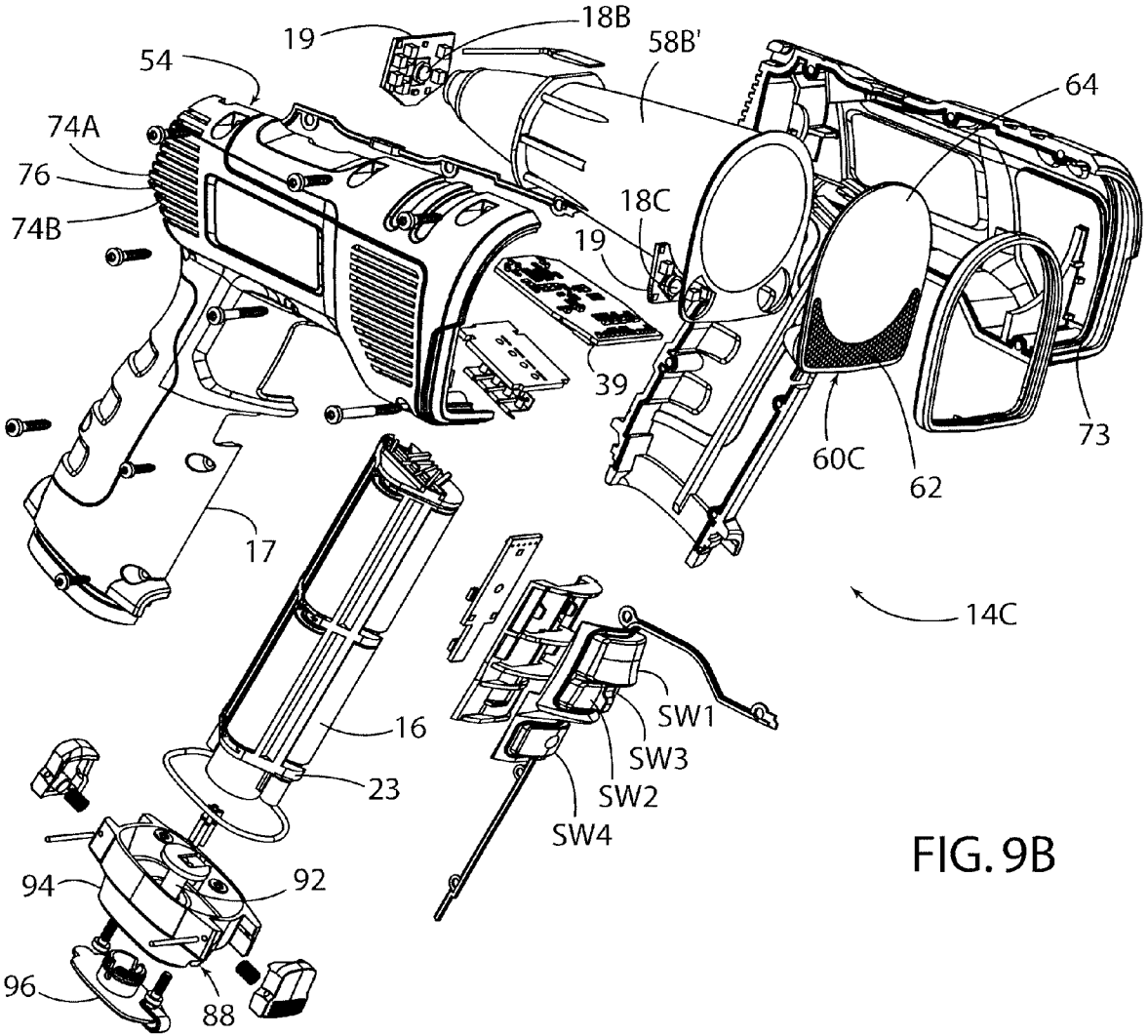
FIG. 9B is an exploded view of the spotlight lighting device of the lighting system, in accordance with one embodiment of the present invention.
Figure 9C:
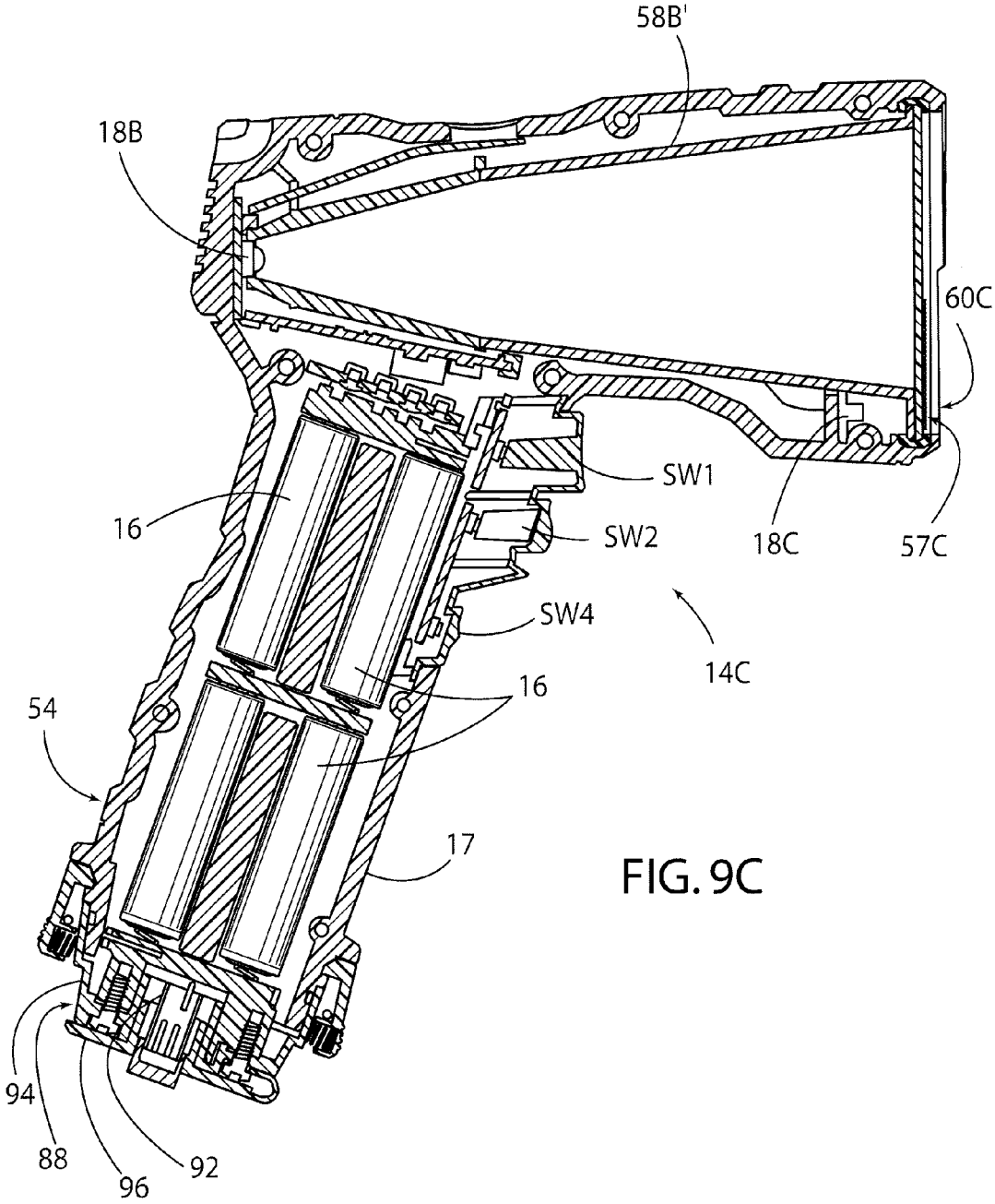
FIG. 9C is a cross-sectional view of the spotlight lighting device of the lighting system, in accordance with one embodiment of the present invention.
Figure 10A:
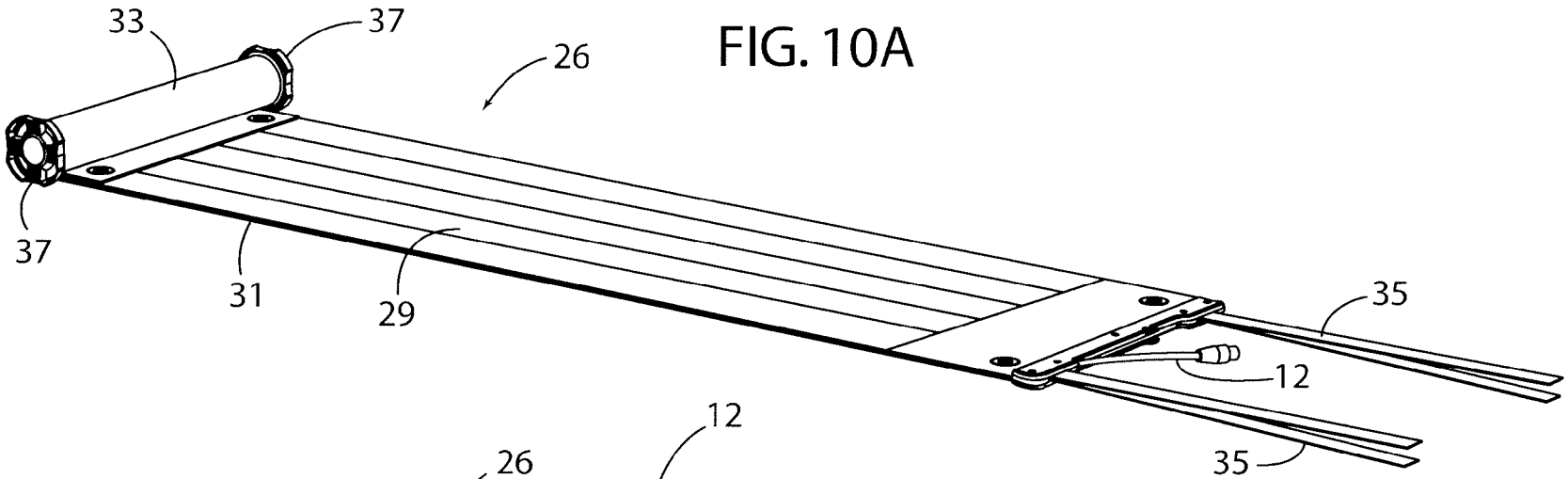
FIG. 10A is a top perspective view of a solar power source of a lighting system in a solar radiation harvesting position, in accordance with one embodiment of the present invention.
Figure 10C:
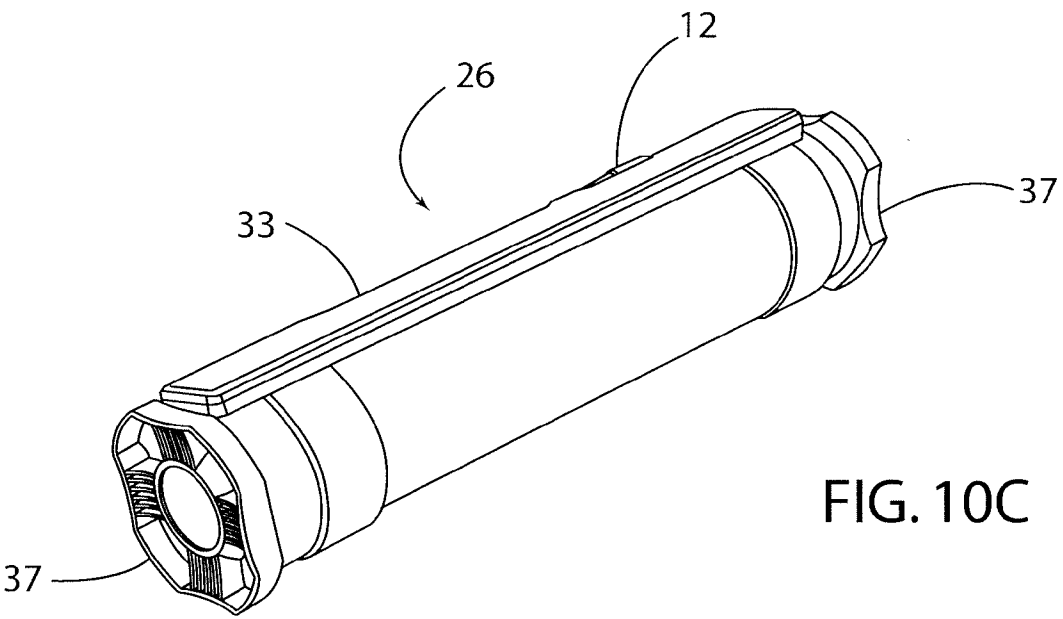
FIG. 10C is a front perspective view of the solar power source of the lighting system in a rolled-up position, in accordance with one embodiment of the present invention.
Figure 10B:
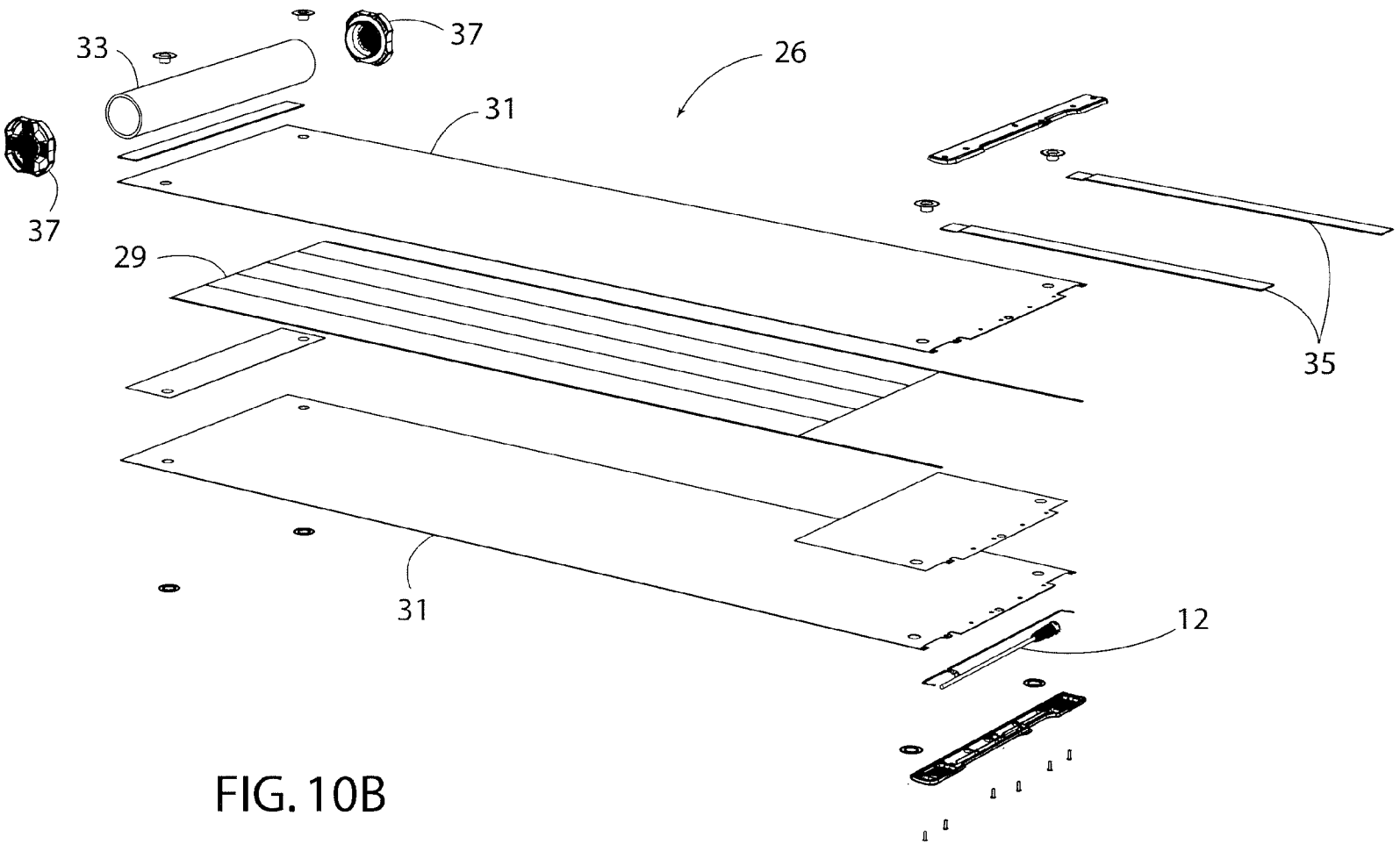
FIG. 10B is an exploded view of the solar power source of the lighting system in a solar radiation harvesting position, in accordance with one embodiment of the present invention.

According to one embodiment, the handheld lighting device 14A has the internal power source 16, which includes three (3) AA size batteries connected in series. Typically, at least two of the AA batteries are positioned side-by-side, such that the three (3) AA size batteries are not each end-to-end, and a circuit board 39 is positioned around the three (3) AA size batteries within the housing 54. According to one embodiment, the internal power source 16 of the headlight lighting device 14B is not housed within the same housing as the light sources 18A,18B,18C, but can be directly electrically connected to the lighting sources 18A,18B,18C and mounted on the headband 21 as the housing 54 enclosing the lighting sources 18A,18B,18C. Thus, the internal power source 16 of the headlight lighting device 14B differs from the external power sources 20,22,24,26,27 that connect to the headlight lighting device 14B with the electrical connector 12. Further, the headlight lighting device 14B can include one or more internal power sources 16 that have batteries enclosed therein. Typically, the internal power source 16 of the headlight lighting device 14B includes three (3) AAA size batteries, as shown in FIG. 8D. Typically, AAA size batteries are used in the headlight lighting device 14B in order to reduce the weight of the headlight lighting device 14B, which is generally supported by the user's head, when compared to the weight of other size batteries (e.g., AA size batteries, C size batteries, etc.). According to one embodiment, the spotlight lighting device 14C has the internal power source 16, which includes six (6) AA size batteries, each supplying about 1.5 Volts, and electrically coupled in series to provide a total voltage potential of about nine Volts (9 V). Typically, the six (6) AA size batteries are placed in a clip device 23 and inserted into the handle 17 of the housing 54 of the spotlight lighting device 14C, as shown in FIG. 9B. However, it should be appreciated by those skilled in the art that batteries of other shapes, sizes, and voltage potentials can be used as the internal power source 16 of the lighting devices 14A,14B,14C.

In regards to FIGS. 1 and 10A-10C, the solar power source 26 includes a film material 29 having panels, wherein the panels receive radiant solar energy from a solar source, such as the sun. According to one embodiment, the film material 29 includes one (1) to five (5) panels. The film material 29, via the panels, receives or harvests the solar energy, such that the solar energy is converted into an electrical current, and the electrical current is propagated to the lighting device 14A, 14B,14C or the energy storage system 24,27 through the electrical connector 12. According to one embodiment, the solar radiation received by the solar power source 26 is converted into an electrical current having a voltage potential of approximately eight volts (8V). Further, film material 29 can be a KONARKA™ film material, such as a composite photovoltaic material, in which polymers with nano particles can be mixed together to make a single multi-spectrum layer (fourth generation), according to one embodiment. According to other embodiments, the film material 29 can be a single crystal (first generation) material, an amorphous silicon, a polycrystalline silicon, a microcrystalline, a photoelectrochemical cell, a polymer solar cell, a nanocrystal cell, and a dyesensitized solar cell. Additionally, the solar power source 26 can include protective cover films 31 that cover a top and bottom of the film material 29. For purposes of explanation and not limitation, the protective cover film 31 can be any suitable protective cover film, such as a laminate, that allows solar radiation to substantially pass through the protective cover film 31 and be received by the film material 29.

According to one embodiment, the film material 29 and the protective cover film 31 are flexible materials that can be rolled or wound about a mandrel 33. The mandrel 33 can have a hollow center, such that the electrical connector 12 or other components can be stored in the mandrel 33. Straps 35 can be used to secure the film material 29 and the protective cover film 31 to the mandrel when the film material 29 and protective cover film 31 are rolled about the mandrel 33 or in a rolled-up position, according to one embodiment. Additionally, the straps 35 can be used to attach the solar power source 26 to an item, such as, but not limited to, a backpack or the like, when the film material 29 and protective cover film are not rolled about the mandrel 33 or in a solar radiation harvesting position. Additionally or alternatively, end caps 37 can be used to further secure the film material 29 and protective cover film 31 when rolled about the mandrel 33, and to provide access to the hollow interior of the mandrel 33.

According to an alternate embodiment, the film material 29 can be a foldable material, such that the film material 29 can be folded upon itself in order to be stored, such as when the solar power source 26 is in a non-solar radiation harvesting position. Further, the film material 29, when in the folded position, can be stored in the mandrel 33, other suitable storage containers, or the like. Additionally, the protective cover film 31 can be a foldable material, such that both the film material 29 and protective cover film 31 can be folded when in a non-solar radiation harvesting position. The film material 29 and protective cover film 31 can then also be un-folded when the film material 29 is in a solar radiation harvesting position.

With respect to FIGS. 1-5 and 7-12, the electrical connector 12 includes a plurality of pins 41 connected to a plurality of electrical wires 43 that extend longitudinally through the electrical connector 12, according to one embodiment. Typically, the plurality of pins 41 are positioned, such that the pins 41 matingly engage to make an electrical connection with a predetermined electrical component of the device 14A,14B, 14C,

20,22,24,26,27 that is connected to the electrical connector 12. Thus, the electrical wires 43, and the pins 41, can communicate or propagate an electrical current between one of the light devices 14A,14B,14C and one of the external power sources 20,22,24,26, or 27 and between the external power sources (i.e. the AC power source 20 to the energy storage system 24) at different voltage potentials. According to one embodiment, the electrical connector 12 communicates an intelligence signal from the power source 20,22,24,26,27 to the lighting device 14A,14B,14C, such that the lighting device 14A,14B,14C can confirm that the electrical connector 12 is connecting a suitable external power source to the connected lighting device 14A,14B,14C.

According to one embodiment, the connector 41 includes an outer sleeve 45 having a first diameter and an inner sleeve 47 having a second diameter, wherein the second diameter is smaller than the first diameter. The connector 41 can further include a retainer 49 that surrounds at least a portion of the plurality of pins 41 and the electrical wires 43, according to one embodiment. The retainer 49, in conjunction with other components of the electrical connector 12, such as the outer sleeve 45 and inner sleeve 47, form a water-tight seal, so that a waterproof connection between the pins 41 and the electrical components of the connected device 14A,14B,14C,20,22,24,26,27.

Additionally or alternatively, the connector 41 includes a quarter-turn sleeve 51, which defines at least one groove 53 that extends at least partially circumferentially, at an angle, around the quarter-turn sleeve 51. According to one embodiment, the electrical connector 12 includes a flexible sleeve 55 at the non-connecting end of the quarter-turn sleeve 51 that connects to a protective sleeve 59. Typically, the protective sleeve 59 extends longitudinally along the length of the electrical connector 12 to protect the wires 43, and the flexible sleeve 55 allows the ends of the electrical connector 12 to be flexible so that the pins 41 can be correctly positioned with respect to a receiving portion of the device 14A,14B,14C,20,22,24,26, or 27.

The spotlight lighting device 14C can also include a switch guard 32, according to one embodiment. Additionally or alternatively, the devices 14A,14B,14C,20,22,24,26,27 can include the tail cap assembly 88. The tail cap assembly 88 includes a hinge mechanism 90, wherein at least one cover is operably connected to the hinge mechanism 90, such that the at least one cover pivots about the hinge mechanism 90. According to one embodiment, a connector 92 is attached or integrated onto a cover 94, wherein the connector 92 is the corresponding male portion to the electrical connector 12. The connector 92 can include a flange that is positioned to slidably engage the groove 53 of the electrical connector 12 when the connector 92 is being connected and disconnected from the electrical connector 12, according to one embodiment. The connector 92 is electrically connected to the lighting sources 18A,18B,18C when the cover 94 is in a fully closed positioned, such that when one of the external power sources 20,22,24,26, or 27 is connected to one of the lighting devices 14A,14B, or 14C by the electrical connector 12 being connected to the connector 92, the external power source 20,22,24,26,27 propagates an electrical current to the lighting sources 18A,18B,18C. When the cover 94 is in an open position, the connector 92 is not electrically connected to the lighting sources 18A,18B,18C, and the internal power source 16 can be inserted and removed from the lighting device 14A,14B,14C.

According to an alternate embodiment, the tail cap assembly 88 includes a second cover 96 that covers the connector 92 when in a fully closed position. Typically, the second cover 96 is operably connected to the hinge mechanism 90, such that the second cover pivots about the hinge mechanism 90 along with the cover 94. When the second cover 96 is in the fully closed position, the electrical connector 12 cannot be connected to the connector 92, and when the second cover 96 is in an open position, the electrical connector 12 can be connected to the connector 92. Thus, the connector 92 does not have to be exposed to the environment that the lighting device 14A,14B,14C is being operated in, when the connector 92 is not connected to the electrical connector 12. Further, the tail cap assembly 88 can include a fastening mechanism 98 for securing the cover 94,96 when the cover 94,96 is in the fully closed position.

II. Optic Pack

In regards to FIGS. 1-5, 7-9, 12-15, and 20, the lighting devices 14A,14B,14C have a plurality of lighting sources enclosed in the housing 54, wherein at least one light source 18A,18B,18C of the plurality of light sources emits lights. According to one embodiment, each of the light sources 18A,18B,18C are in optical communication with a corresponding optic pack generally indicated at 57A,57B,57C. Typically, the optic pack 57A,57B,57C includes an optical lens, such that a plurality of optical lenses are enclosed in the housing 54, wherein each of the plurality of light sources 18A,18B,18C is in optical communication with one optical lens of the plurality of optical lenses. According to one embodiment, the plurality of optical lenses include a first optical lens 58A associated with the white flood LED 18A, a second optical lens 58B or 58B' associated with the white spot LED 18B, and a third optical lens 58C associated with the red flood LED 18C. Typically, the optical lens 58A,58B,58B',58C reflects at least a portion of the light emitted by the corresponding lighting source 18A,18B,18C, wherein at least a portion of the light emitted by the corresponding lighting sources 18A,18B,18C passes through the optical lens 58A,58B,58B',58C, as described in greater detail herein.

A lens generally indicated at 60A,60B,60C is substantially fixedly coupled to the housing 54. Thus, the optic pack 57A,57B,57C can include the optical lens 58A,58B,58B',58C and the lens 60A,60B,60C, wherein the corresponding light source 18A,18B,18C can be connected to the LED circuit board 19 and inserted into the corresponding optic pack 57A,57B,57C. According to one embodiment, the optic pack 57A including optical lens 58A,58B,58C and lens 60A is associated with the handheld lighting device 14A, the optic pack 57B including optical lens 58A,58B',58C and lens 60B is associated with the headlight lighting device 14B, and the optic pack 57C including optical lens 58A,58B,58C and lens 60C is associated with the spotlight lighting device 14C. The lens 60A,60B,60C is a single lens having a portion that is in optical communication with a corresponding light source 18A,18B,18C and corresponding optical lens 58A,58B,58C, according to one embodiment. The lens 60A,60B,60C also includes a plurality of surface configurations, such that at least one surface configuration of the plurality of surface configurations is formed on each portion of the lens 60A,60B,60C to control an illumination pattern of the light emitted from the corresponding lighting source 18A,18B,18C.

According to one embodiment, a first portion 62 of the lens 60A,60B,60C has a first surface configuration that is a flood surface configuration. Thus, the light emitted from the corresponding light source (e.g., white flood LED 18A and red flood LED 18C) and reflected by the corresponding optical lens 58A,58C are directed through the flood surface configuration to produce a flood pattern. Additionally, a second portion 64 of the lens 60A,60B,60C can include a second surface configuration that is a spot surface configuration. Thus, the light emitted from the corresponding light source (e.g., white spot LED 18B) and reflected by the corresponding optical lens 58B' is directed through the spot surface configuration to produce a spot pattern. According to one embodiment, at least a portion of the plurality of the surface configurations are generally formed by chemically treating the portion of the lens 60A,60B,60C. Typically, at least one chemical agent is applied to the desired portion of the lens 60A,60B,60C surface (e.g., the first portion 62), and the chemical agent alters the surface configuration, which results in the light emitted from the corresponding light source (e.g., white flood LED 18A and red flood LED 18C) to be dispersed at greater angles than the light emitted through a smooth or non-treated portion of the lens 60A,60B,60C (e.g., the second portion 64).

According to one embodiment, the flood beam pattern illuminates a circular target size in diameter of approximately two meters (2 m) or greater at a target distance of approximately one hundred meters (100 m), and the spot beam pattern illuminates a circular target size in diameter of approximately less than one meter (1 m) at a target distance of two meters (2 m). Thus, the flood beam pattern generally illuminates a target size at a first target distance having a greater diameter than the spot beam pattern at a second target distance, such that the light emitted in the flood pattern is emitted at greater angles with respect to the light source (e.g., the white flood LED 18A and red flood LED 18C) than light emitted in the spot pattern. According to one embodiment, the flood beam pattern can be defined as the light being emitted at a half angle of twelve degrees (12°) or greater with respect to the lighting source 18A, and the spot beam pattern can be defined as the light being emitted at a half angle of less than twelve degrees (12°) with respect to the lighting source 18B. Additionally or alternatively, the white LED light sources 18A,18B are CREE XR-E™ LEDs, and the red LED light source 18C is a CREE-XR™ 7090 LED. According to one embodiment, the spot lighting source 18B, and corresponding optic pack 57B, can have a half angle of less than or equal to approximately five degrees (5°) for the handheld and headlight lighting devices 14A,14B, and a half angle of less than or equal to approximately two degrees (2°) for the spotlight lighting device 14C.

For purposes of explanation and not limitation, an exemplary illumination pattern that is emitted by a lighting source 18A,18B,18C is shown in FIG. 21. The illumination pattern has a diameter D at a target, wherein the diameter D corresponds to an angle θ, with which the light is emitted with respect to an optical axis of the lighting source 18A,18B,18C. Thus, the illumination pattern of light emitted by the lighting source 18A,18B,18C can be defined by the size or diameter D of the illumination pattern at the target, the shape of the illumination pattern, the intensity of the light emitted, the angle with which the light is emitted from the lighting source 18A,18B,18C, or a combination thereof. Typically, the light emitted by the white flood LED 18A and red flood LED 18C have a greater size or diameter D at a target, and the light is emitted at a greater angle θ with respect to the optical axis of the lighting source than the white spot LED 18B.

Figure 12A:
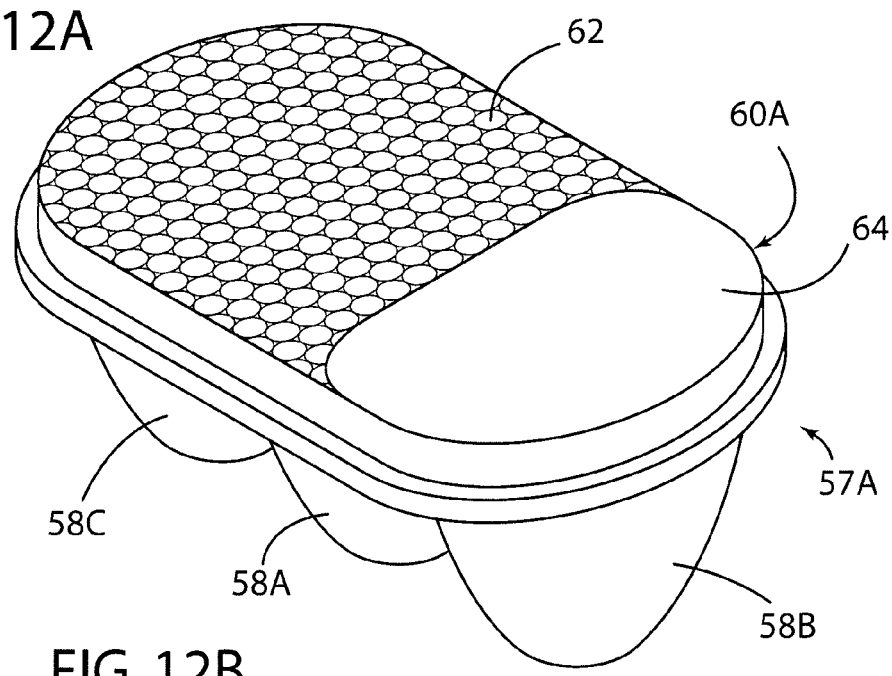
FIG. 12A is a front perspective view of an optic pack of a handheld lighting device of a lighting system, in accordance with one embodiment of the present invention.
Figure 12B:
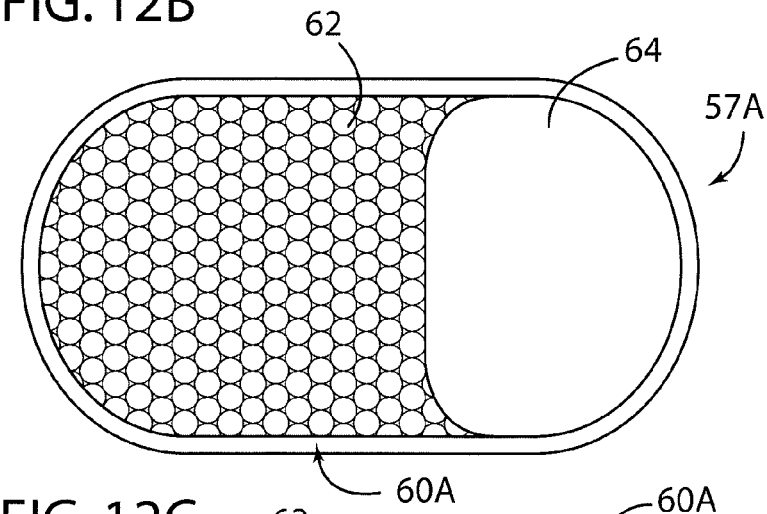
FIG. 12B is a top plan view of the optic pack of the handheld lighting device of the lighting system, in accordance with one embodiment of the present invention.
Figure 12C:
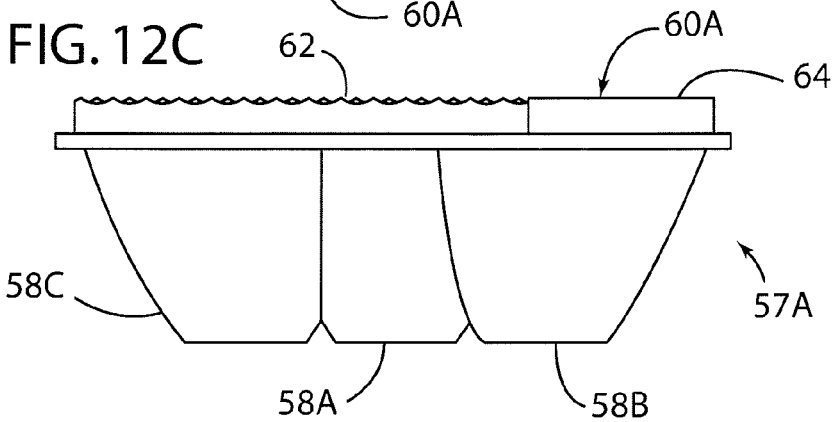
FIG. 12C is a side plan view of the optic pack of the handheld lighting device of the lighting system, in accordance with one embodiment of the present invention.

With regards to FIGS. 12A-12C, the optic pack 57A of the handheld lighting device 14A includes the first, second, and third optical lens 58A,58B,58C and the lens 60A. The first portion 62 of the lens 60A,60B, substantially covers and corresponds with the first optical lens 58A and the third optical lens 58C, and the second portion 64 of the lens 60A, 60B,60C substantially covers and corresponds with the second optical lens 58B. Thus, the first portion 62 in conjunction with the first optical lens 58A and the third optical lens 58C produce a flood pattern of light emitted by the white flood LED 18A and the red flood LED 18C, respectively. Further, the second portion 64 in conjunction with the second optical lens 58B emit a spot pattern of illuminated light emitted by the white spot LED 18B.

Figure 13A:
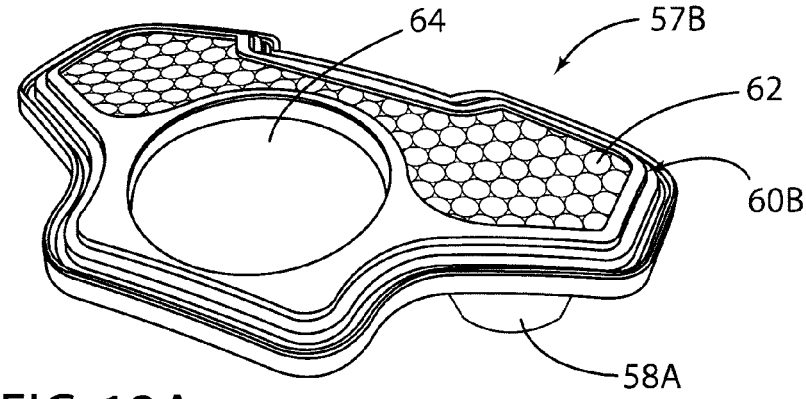
FIG. 13A is a top perspective view of an optic pack of a headlight lighting device of a lighting system, in accordance with one embodiment of the present invention.
Figure 13B:
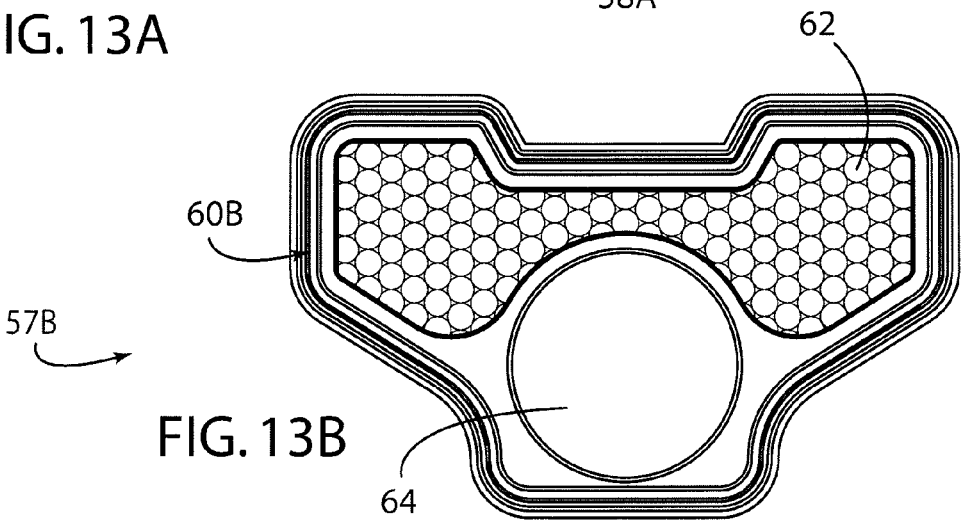
FIG. 13B is a top plan view of the optic pack of the headlight lighting device of the lighting system, in accordance with one embodiment of the present invention.
Figure 13C:
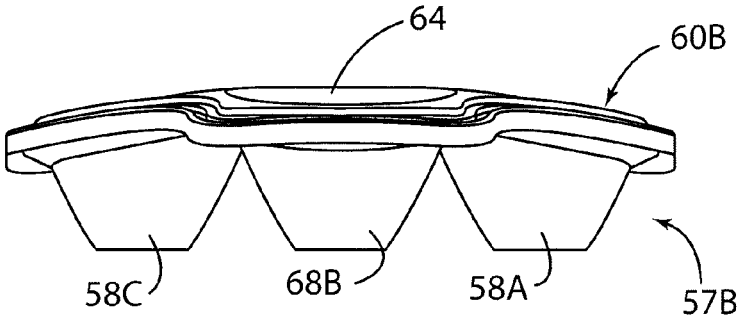
FIG. 13C is a side plan view of the optic pack of the headlight lighting device of the lighting system, in accordance with one embodiment of the present invention.
Figure 15A:
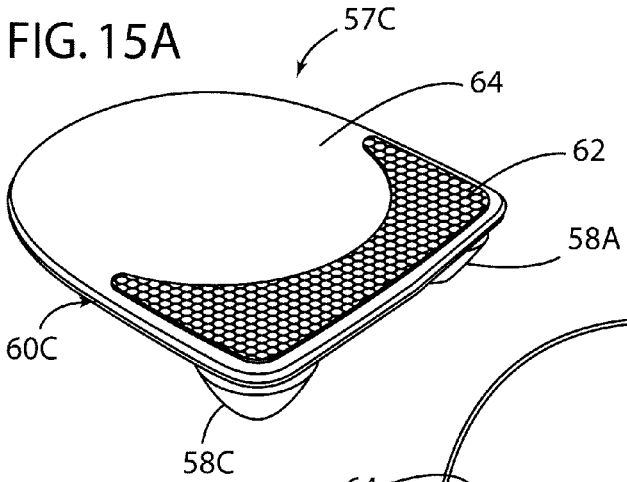
FIG. 15A is a top perspective view of a lens of the optic pack of the spotlight lighting device of the lighting system, in accordance with one embodiment of the present invention.
Figure 15B:
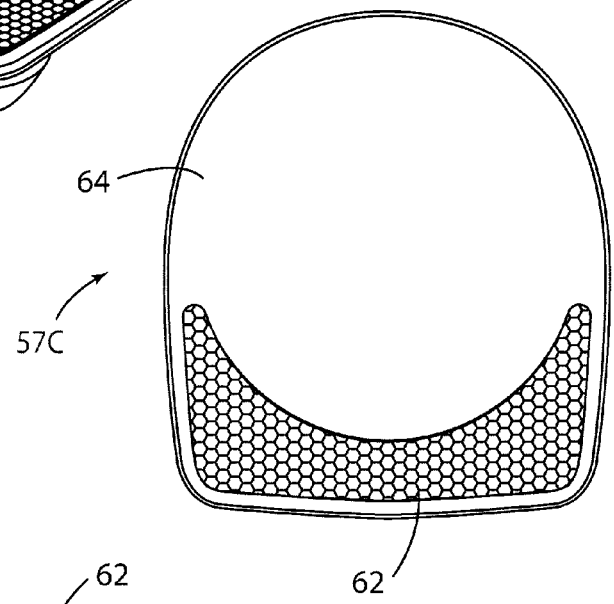
FIG. 15B is a top plan view of the lens of the optic pack of the spotlight lighting device of the lighting system, in accordance with one embodiment of the present invention.
Figure 15C:
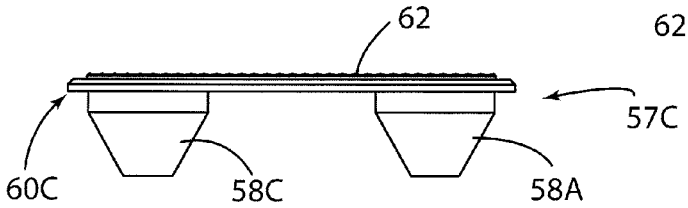
FIG. 15C is a front plan view of the lens of the optic pack of the spotlight lighting device of the lighting system, in accordance with one embodiment of the present invention.
Figure 15D:
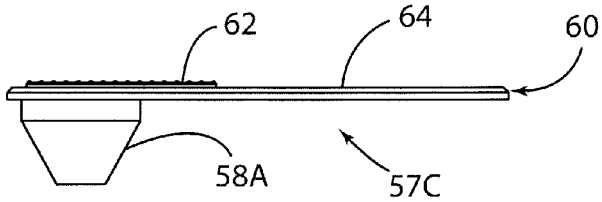
FIG. 15D is a side plan view of the lens of the optic pack of the spotlight lighting device of the lighting system, in accordance with one embodiment of the present invention.

In reference to FIGS. 13A-13C, the optic pack 57B of the headlight lighting device 14B is shown, wherein the optic pack 57B includes the first, second, and third optical lens 58A,58B,58C and the lens 60B. According to one embodiment, the first portion 62 of the lens 60B substantially covers and is associated with the first optical lens 58A and the third optical lens 58C, such that the corresponding white flood LED 18A and red flood LED 18C are directed through the first portion 62 to produce a flood pattern of illuminated light. The second portion 64 of the lens 60A,60B,60C substantially covers and corresponds to the second optical lens 58B, such that light emitted from the white spot LED 18B is emitted through the second portion 64 to produce a spotlight pattern.

With respect to FIGS. 14A-15D, the optic pack 57C of the spotlight lighting device 14C includes the first optical lens 58A, a second optical lens 58B', the third optical lens 58C, and the lens 60C. The first portion 62 of the lens 60C substantially covers and corresponds to the first optical lens 58A and the third optical lens 58C, such that light emitted from the white flood LED 18A and the red flood LED 18C is emitted through the first portion 62 to produce a flood pattern. The second portion 64 of the lens 60C substantially covers and corresponds to the second optical lens 58B', such that light emitted by the white spot LED 18B is emitted through the second portion 64 to produce a spot pattern. Additionally, the second optical lens 58B' that is included in the optic pack 57C of the spotlight lighting device 14C can have a focal point 66 that is deeper with respect to a top 68 that defines an opening 70, wherein light is directed out of the second optical lens 58B' that is deeper than at least one other focal point of the plurality of optical lenses in the optic pack 57C. Additionally, the second optical lens 58B' can be a multiple-part optical lens, according to one embodiment. Thus, the multiple parts of the second optical lens 58B' can be attached to one another to form the second optical lens 58B' in the final assembly. The multiple parts of the second optical lens 58B' can be attached by suitable mechanical devices, pressure fitting, adhesives, the like, or a combination thereof. According to one embodiment, the second optical lens 58B' has a seam 72 that extends circumferentially around the second optical lens 58B' that separates the second optical lens 58B' into two parts. According to an alternate embodiment, the second optical lens 58B' has a seam that extends longitudinally along the second optical lens 58B' to separate the second optical lens 58B' into two parts.

According to one embodiment, the optical lenses 58A, 58B,58B',58C are conically shaped reflectors. Specifically, the conically shaped optical lenses 58A,58B,58B',58C are total internal reflection (TIR) optical lenses, according to one embodiment. The apex (vertex) of each cone shaped optical lens 58A,58B,58B',58C has a concave surface that generally engages the corresponding LED 18A,18B,18C. By way of explanation and not limitation, at least one of the optical lenses 58A,58B,58B',58C have a refractive index of 1.4 to 1.7. Additionally or alternatively, the optical lenses 58A,58B, 58B',58C are made of a polycarbonate material, and the lens 60A,60B,60C is made of a polymethylmethacrylate (PMMA) material. Further, the housing 54 can define an indentation 73, as shown in FIGS. 7B,7C, 8B, 8C, 9B, and 9C, wherein a portion of the lens 60A,60B,60C is inserted in the indentation 73 to fixedly connect the lens 60A,60B,60C to the housing 54, according to one embodiment. Additionally, the first and second portions 62,64 of the lens 60A,60B,60C are optically aligned with the corresponding light source 18A,18B,18C and optical lens 58A,58B,58B',58C when the lens 60A,60B, 60C is inserted into the indentation 73. Alternatively, the lenses 58A,58B,58B',58C can be, but are not limited to, plano-convex lenses, biconvex or double convex lenses, positive meniscus lenses, negative meniscus lenses, parabolic lenses, the like, or a combination thereof, according to one embodiment.

According to one embodiment, the optic pack 57A,57B, 57C can include a central lens section, an outside internal reflection form, a top microlens array, and a small microlens array. Typically, the central lens section can concentrate the light into a range of angles, and the outside internal reflection form can guide the light in the direction the light is to be emitted (e.g., a forward direction). The top microlens array can spread the light into a particular pattern, such as the flood illumination pattern, according to one embodiment. The small microlens array can be used to eliminate a square shape in the illumination pattern, such as for the white spot LED 18B, according to one embodiment.

According to an alternate embodiment, the optic pack 57A, 57B,57C is a hybrid of components instead of the embodiment as described above. In this embodiment, the sidewalls of the TIR lens can be reflectors, and a central lens portion can function as spreading optics to spread out the light and form the illumination pattern.

III. Heat Dissipation

With regards to FIGS. 1-4 and 7-9, the lighting devices 14A,14B,14C each include at least one lighting source 18A, 18B,18C that generate thermal energy (heat) as a by-product and the housing 54 that encloses the at least one lighting source 18A,18B,18C generally confines the heat and protects the components therein, according to one embodiment. The housing 54 is in thermal communication with at least one of the lighting sources 18A,18B,18C, such that thermal radiation transfers directly or indirectly from the at least one lighting source 18A,18B,18C to the housing 54. The housing 54 includes a body and a plurality of thermally conductive heat sink fins 74. According to one embodiment, at least a portion of the plurality of thermally conductive heat sink fins 74 extend horizontally with respect to a normal operating position of the at least one lighting device 14A,14B,14C. According to an alternate embodiment, at least a portion of the thermally conductive heat sink fins 74 extend vertically with respect to a normal operating position of the at least one lighting device.

According to one embodiment, the housing 54 is made of a thermally conductive material, such as, but not limited to, thixo molded magnesium alloy, or the like. Additionally or alternatively, at least a portion of the thermally conductive material of housing 54 can be covered with an emissivity coating, wherein the emissivity coating increases the heat dissipation capabilities of the thermally conductive material. According to one embodiment, the emissivity coating can be a material with a heat conductive rating of approximately 0.8, such that the emissivity coating provides a high emissivity and promotes adequate radiant heat transfer. For purposes of explanation and not limitation, the emissivity coating can be, but is not limited to, a DUPONT® Raven powder material. Typically, the emissivity coating is applied to the housing 54 and baked onto the housing 54 after the molding process in order to provide a durable finish.

The thermally conductive heat sink fins 74, whether extending horizontally in one embodiment, or vertically in another embodiment, can include at least a first thermally conductive fin 74A and a second thermally conductive heat sink fin 74B that define an approximately five millimeter (5 mm) spacing 76 between the first and second thermally conductive heat sink fins 74A,74B. In one exemplary embodiment, a horizontal thickness of the thermally conductive heat sink fins 74 can range from and include approximately 0.75 mm to one millimeter (1 mm), and the height of the thermally conductive heat sink fins 74A,74B range from and include approximately four millimeters (4 mm) to 5.8 mm. However, it should be appreciated by those skilled in the art that the above dimensions can be altered to provide a thermally conductive heat sink fin 74 with a greater amount of surface area, which generally dissipates heat with greater efficiency than a thermally conductive heat sink fin with less surface area under substantially the same operating conditions.

According to one embodiment, a thermal conductive gap filler is dispersed between the housing 54 and the LED circuit board 19. The thermal conductive gap filler can generally be selected to have characteristics including, but not limited to, thermal conductivity, adhesive, electrical non-conductivity, the like, or a combination thereof. Thus, the thermal conductive gap filler can be used to conduct heat from the LED circuit board 19 to the housing 54. According to one embodiment, the thermal conductivity of the thermal conductive material is one watt per meter degree of Celsius (W/mC). One exemplary thermal conductive material that can be used as the gap filler is GAP PAD™ manufactured by Bergquist Company. The thermal conductive gap filling material can have an adhesive property, which further forms a connection between the LED circuit board 19 and the housing 54. Typically, the thermal conductive gap filling material is a dielectric material.

At least one temperature monitoring device 50 can be in thermal communication with at least one of the LED circuit board 19 and the housing 54. In one exemplary embodiment, the temperature monitoring device 50 is a thermister that monitors the temperature of at least one component of the lighting device 14A,14B,14C. By way of explanation and not limitation, the temperature monitoring device 50 can be a positive temperature coefficient (PTC) thermister, a negative temperature coefficient (NTC) thermister, or a thermocouple. According to one embodiment, the temperature monitoring device 50 is in thermal communication with at least one other component, such that the temperature monitoring device 50 directly monitors the thermal radiation emitted by the component or a rate of change in the emitted thermal radiation over a period of time. Additionally, the temperature monitoring device 50 communicates the monitored temperature to the processor 36. The processor 36 has hardware circuitry or executes one or more software routine to determine a temperature of at least one other component of the lighting device 14A,14B,14C based upon the monitored temperature. The processor 36 can then alter the electrical current supplied to the at least one light source 18A,18B,18C in order to control the thermal radiation emitted by the light source 18A,18B, 18C to the LED circuit board 19.

According to one embodiment, wherein the rate of change of the emitted thermal radiation is monitored, the rate of change of emitted thermal radiation is monitored with respect to a commanded or selected light output function for the lighting source 18A,18B,18C. Thus, the temperature of a component, such as the housing 54, can be determined to a degree by measuring the rate of change of the LED circuit board 19 temperature during a period of time at a specific current output. Typically, the rate of change in the temperature of the component is a function of convection heat transfer (e.g., wind), conduction heat transfer (e.g., the lighting device 14A,14B,14C being held), and radiation heat transfer (e.g., solar radiation).

For purposes of explanation and not limitation, in operation, one of the white flood LED 18A, white spot LED 18B, and red flood LED 18C, or a combination thereof, are illuminated and emit thermal radiation, which is transferred to the LED circuit board 19. According to one embodiment, the temperature monitor device 50 is in thermal communication with the LED circuit board 19, such that the temperature monitor device 50 determines the temperature of the LED circuit board 19. The temperature monitor device 50 communicates the monitored temperature data, which includes, for example, resistance, of the LED circuit board 19 or data to processor 36, wherein the processor 36 determines an approximate temperature of the housing 54 based upon the monitored temperature of the LED circuit board 19. If the monitored temperature or the determined temperature are at or exceed a predetermined temperature value, then the processor 36 reduces the power supplied to the white flood LED 18A, white spot LED 18B, red flood LED 18C, or a combination thereof, in order to reduce the amount of thermal radiation emitted by the LEDs 18A,18B,18C. The power supplied may be controlled by altering the electrical current supplied to the lighting source 18A,18B,18C, such as by using pulse width modulation (PWM) control. By reducing the power supplied to the LEDs 18A,18B,18C, the thermal radiation emitted by the LEDs 18A,18B,18C is reduced, and the temperature of the LED circuit board 19 and housing 54 is also reduced. Therefore, reducing the electrical current, which reduces the amount of light emitted by the LEDs 18A, 18B,18C, results in a temperature controlled lighting device that maintains a selected temperature for the lighting devices 14A,14B,14C.

According to an alternate embodiment, the temperature monitoring device 50 is in thermal communication with the housing 54, such that the thermal monitoring device 50 monitors the temperature of the housing 54. The temperature monitoring device 50 then communicates the monitored temperature of the housing 54 or data to the processor 36, wherein the processor 36 processes the data and determines an approximate temperature of the LED circuit board 19 based upon the monitored temperature of the housing 54. The processor 36 can alter the electrical current supplied to the LEDs 18A,18B,18C based upon the monitored temperature of the housing 54, the determined temperature of the LED circuit board 19, or a combination thereof, in order to reduce the amount of thermal radiation emitted by the LEDs 18A,18B, 18C.

Additionally or alternatively, the processor 36 can increase the electrical current supplied to the LEDs 18A,18B,18C based upon a monitored temperature monitored by the temperature monitoring device 50, the determined temperature determined by the processor 36, or a combination thereof, without regard to the component that the temperature monitoring device 50 is in thermal communication with. Typically, the electrical current can be controlled by using PWM control. Thus, the supplied electrical current to the LEDs 18A, 18B,18C can be increased in order to emit more illumination from the LEDs 18A,18B,18C, when the temperature within the lighting device 14A,14B,14C is maintained at a suitable temperature.

Figure 16A:
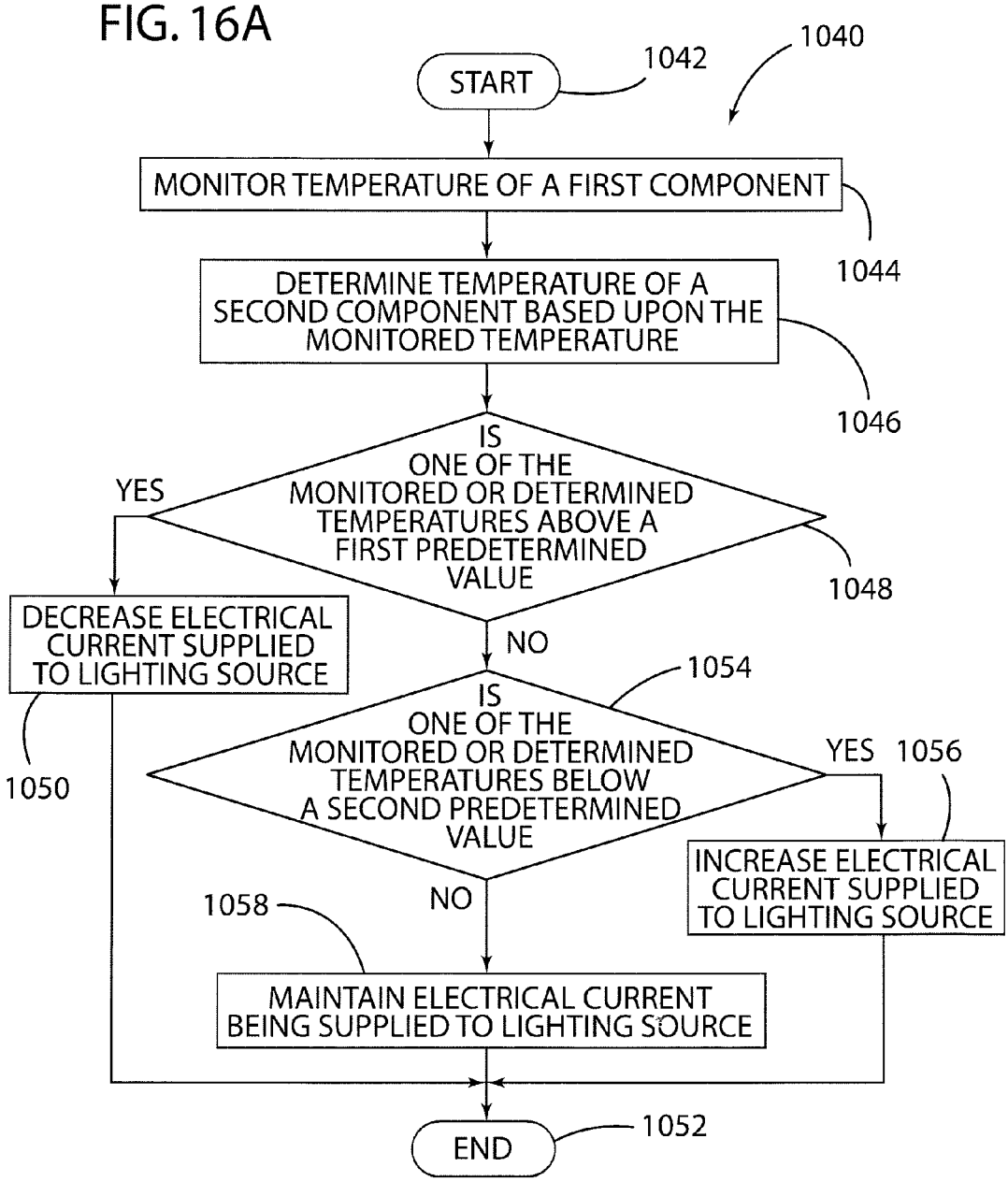
FIG. 16A is a flow chart illustrating a method of controlling at least one component of a lighting device of a lighting system based upon a temperature of at least one component in the lighting device, in accordance with one embodiment of the present invention.

With respect to FIGS. 1-4, 7-9, and 16A, a method of controlling the electrical current supplied to the lighting source 18A,18B,18C is generally shown in FIG. 16A at reference identifier 1040, according to one embodiment. The method 1040 starts at step 1042, and proceeds to step 1044, wherein the temperature of a first component is monitored. According to one embodiment, the first component is the LED circuit board 19, which is monitored by the temperature monitoring device 50. According to an alternate embodiment, the first component is housing 54, wherein the temperature of the housing 54 is monitored by the temperature monitoring device 50. At step 1046, an approximate temperature of a second component is determined based upon the temperature monitored at step 1044. According to one embodiment, the second component is either the LED circuit board 19 or the housing 54, wherein the temperature monitoring device 50 is not in direct thermal communication with the second component. It is then determined at decision step 1048 whether one of the monitored or determined temperature is above a first predetermined value. For purposes of explanation and not limitation, when the temperature monitoring device 50 monitors the temperature of the LED circuit board 19, the first predetermined value is approximately sixty-six degrees Celsius (66° C.), such that the LED board 19 is operating at approximately sixty-six degrees Celsius (66° C.) and the housing 54 is presumed to have an operating temperature of approximately fifty-five degrees Celsius (55° C.). If it is determined at decision step 1048 that one of the monitored or determined temperature is above the first predetermined value, then the method 1040 proceeds to step 1050, wherein the electrical current supplied to the light source 18A,18B, 18C is decreased. The method 1040 then ends at step 1052.

When it is determined at decision step 1048 that one of the monitored or determined temperature is not above a predetermined value, then the method 1040 proceeds to decision step 1054. At decision step 1054, it is determined if one of the monitored or determined temperature is below a second predetermined value. If it is determined at decision step 1054 that one of the monitored or determined temperature is below the second predetermined value, then the method 1040 proceeds to step 1056, wherein the electrical current supplied to the light source 18A,18B,18C is increased. The method 1040 then ends at step 1052.

However, if it is determined at decision step 1054 that one of the monitored or determined temperatures is not below the predetermined value, then the method 1040 proceeds to step 1058. At step 1058, the electrical current being supplied to the light source 18A,18B,18C is maintained, and the method 1040 then ends at step 1052.

Figure 16B:
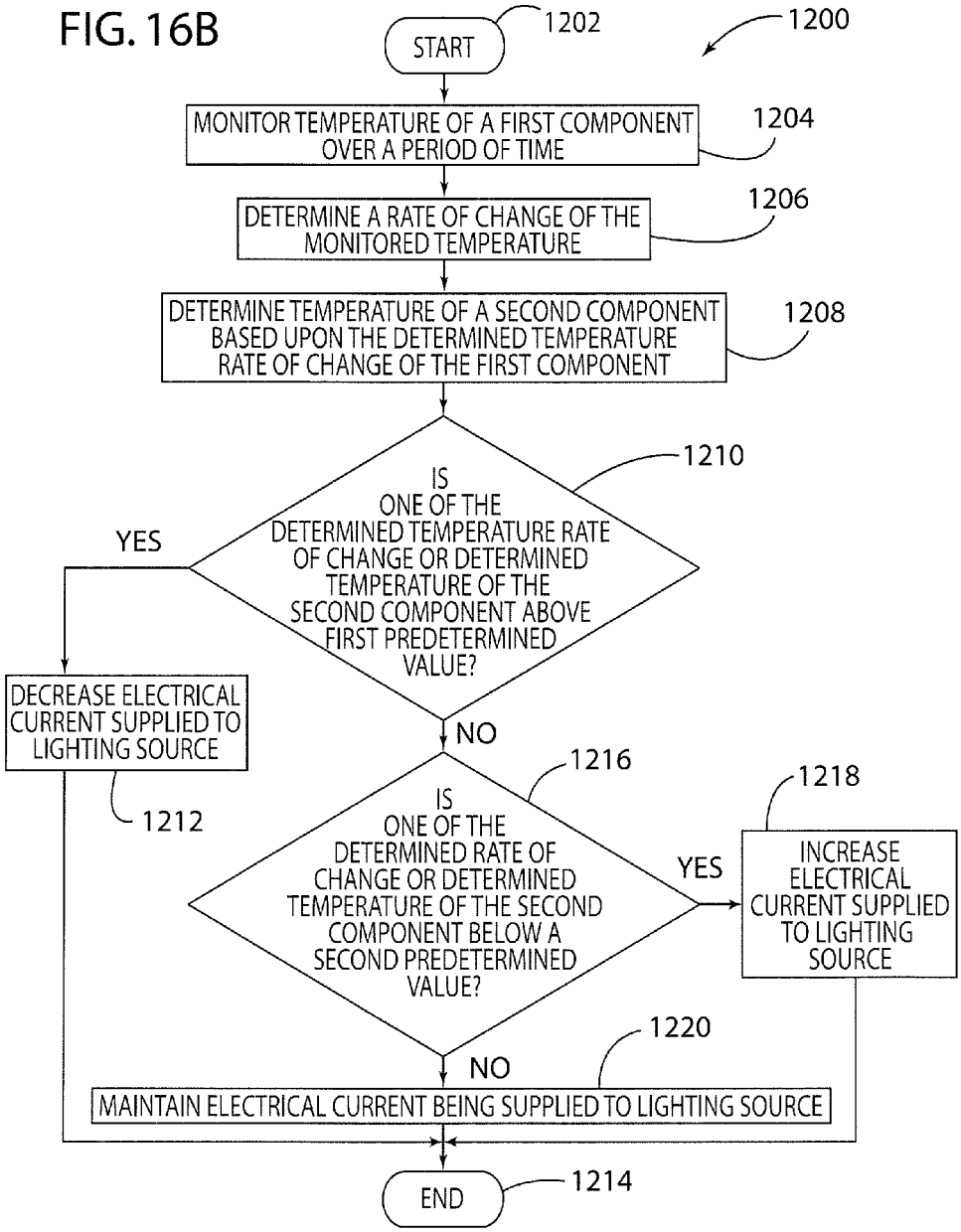
FIG. 16B is a flow chart illustrating a method of controlling at least one component of a lighting device of a lighting system based upon a rate of temperature change of at least one component in the lighting device, in accordance with an alternate embodiment of the present invention.

With respect to FIGS. 1-4, 7-9, and 16B, a method of controlling the electrical current supplied to the lighting source 18A,18B,18C is generally shown in FIG. 16B at reference identifier 1200, according to one embodiment. The method 1200 starts at step 1202, and proceeds to step 1204, wherein a temperature of a first component is monitored over a period of time. At step 1206, a rate of change of the emitted thermal radiation or monitored temperature is determined. According to one embodiment, the rate of change can be determined based upon comparing the current temperature of the component to a previous temperature of the component. Thus, the temperature of the component is monitored over a period of time. At step 1208, the temperature of a second component is determined based upon the determined temperature rate of change of the first component.

At decision step 1210, it is determined if one of the determined temperature rate of change or determined temperature of the second component is above a first predetermined value. If it is determined at decision step 1210 that one of the determined temperature rate of change or determined temperature of the second component is above a first predetermined value, then the method 1200 proceeds to step 1212. At step 1212, the electrical current supplied to the lighting source is decreased, and the method 1200 then ends at step 1214.

However, if it is determined at decision step 1210 that one of the determined temperature rate of change or determined temperature of the second component is not above a first predetermined value, then the method 1200 proceeds to decision step 1216. At decision step 1216, it is determined if one of the determined temperature rate of change or the determined temperature of the second component is below a second predetermined value. If it is determined at decision step 1216 that one of the determined temperature rate of change or the determined temperature of the second component is below a second predetermined value, then the method 1200 proceeds to step 1218. At step 1218, the electrical current supplied to the lighting source 18A,18B,18C is increased, and the method 1200 then ends at step 1214.

If it is determined at decision step 1216 that one of the determined temperature rate of change or the determined temperature of the second component is not below a second predetermined value, then the method 1200 proceeds to step 1220. At step 1220, the electrical current being supplied to the lighting source 18A,18B,18C is maintained, and the method 1200 then ends at step 1214.

Therefore, the monitored temperature of a component of the lighting device 14A,14B,14C and the determined approximate temperature of other components in the lighting device 14A,14B,14C can be used for controlling different components or devices within the lighting devices 14A,14B, 14C. By way of explanation and not limitation, one exemplary use is to protect the lighting sources 18A,18B,18C from overheating when the lighting sources 18A,18B,18C are LEDs. Typically, LEDs have an LED junction, and it can be undesirable for a temperature of such an LED junction be exceeded for extended periods of time. When the LED junction temperature is exceeded for extended periods of time, the LED life can be shortened. Thus, the monitored and determined temperatures can be used to prevent the LED junction from exceeding a temperature for an extended period of time. Another exemplary use is to maintain the temperature of the housing 54 at a desirable temperature. Thus, by monitoring the temperature of the LED circuit board 19, the approximate temperature of the housing 54 can be determined so that the temperature of the housing 54 can be maintained at a desirable level. A third exemplary use can be to determine an approximate temperature of the internal power source 16, so that the internal power source 16 is operated under desirable conditions, as set forth in greater detail below. It should be appreciated by those skilled in the art that other components, devices, or operating conditions of the lighting device 14A, 14B,14C can be controlled based upon the monitored and determined temperatures.

IV. Cross-Fade and Dimming

In reference to FIGS. 1-4, 7-9, and 17-19, according to one embodiment, at least one of the lighting devices 14A,14B, 14C include a plurality of lighting sources 18A,18B,18C including a first lighting source and a second lighting source. Typically, the first lighting source emits light in a first illumination pattern, and the second lighting source emits light in a second illumination pattern that may be different than the first illumination pattern. According to one embodiment, the term illumination pattern generally refers to the size and shape of the illuminated area at a target distance, angles of the emitted light, the intensity of the emitted light across the beam, the illuminance of the beam (e.g., the total luminous flux incident on a surface, per unit area), or a combination thereof. The shape of the illumination pattern can be defined as the target area containing approximately eighty percent to eighty-five percent (80%-85%) of the emitted light. Cross-fading generally refers to sharing or adjusting the electrical power supplied to two or more light sources in order to yield a selected illumination pattern, such that the intensity distribution of the emitted light is altered to create the selected illumination pattern.

According to one embodiment, the first lighting source is the white flood LED 18A and the second lighting source is the white spot LED 18B. Typically, the first and second illumination patterns of the white flood LED 18A and white spot LED 18B are directed in substantially the same direction, such that the first and second illumination patterns of the white flood LED 18A and the white spot LED 18B at least partially overlap to yield or create a third illumination pattern. The controller or processor 36 alters an intensity of the light emitted from the white flood LED 18A and white spot LED 18B with respect to one another, wherein the third illumination pattern is altered when the processor 36 alters the intensity of the white flood 18A and white spot LED 18B. However, it should be appreciated by those skilled in the art that two or more illumination patterns emitted by two or more lighting sources can be cross-faded that have the same illumination pattern, different illumination patterns, illumination patterns other than spot and/or flood, the same color, different colors, or a combination thereof, according to one embodiment.

Generally, by cross-fading the lighting sources of the lighting devices 14A,14B,14C, the available power is proportionally shifted between the white flood LED 18A and the white spot LED 18B, which controls the relative intensity of the LEDs 18A,18B. The third illumination pattern is yielded by a combination of the first and second illumination patterns of the white flood LED 18A and the white spot LED 18B, respectively, such that when the power supplied to one of the LEDs 18A,18B is increased, the power supplied to the other LED 18A,18B can be proportionally decreased, according to one embodiment. The electrical power can be altered by controlling the electrical current, the voltage, pulse width modulation (PWM), pulse frequency modulation (PFM), the like, or a combination thereof. According to one embodiment, wherein the electrical power is controlled by PWM, the perceived brightness of the white flood LED 18A and white spot LED 18B, the third illumination pattern can be altered by changing the PWM duty cycle. According to one embodiment, a default PWM frequency is approximately one hundred hertz (100 Hz), which is a ten millisecond (10 ms) period, which is altered to change the intensity of the LEDs 18A,18B.

By way of explanation and not limitation, the lighting devices 14A,14B,14C have, such as, but not limited to, the first switch SW1 for activating and deactivating the white LEDs 18A,18B, the second switch SW2 for increasing the power supplied to the white spot LED 18B, the third switch SW3 for increasing the power supplied to the white flood LED 18A, and the fourth switch SW4 for activating and deactivating the red flood LED 18C. Thus, in order to alter the intensities of the white flood LED 18A and white spot LED 18B, and ultimately alter the third illumination pattern, one of the second and third switches SW2,SW3 is actuated in order to indicate which lighting source 18A,18B is to be supplied with additional electrical power. However, it should be appreciated by those skilled in the art that the second and third switches SW2,SW3 can be a single switching device, such as a rocker switch.

Figure 17A:
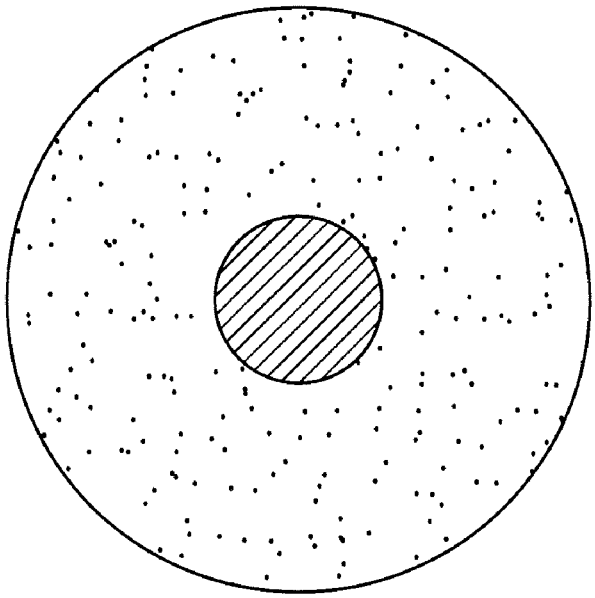
FIG. 17A is an illustration of an illumination pattern emitted by a lighting device of a lighting system, wherein lighting sources of the lighting device are emitting light at substantially a spot end of a cross-fading spectrum, in accordance with one embodiment of the present invention.
Figure 17B:
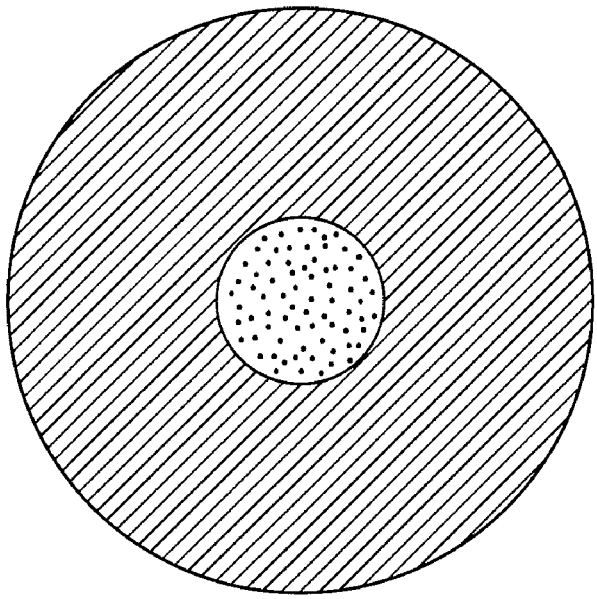
FIG. 17B is an illustration of an illumination pattern emitted by a lighting device of a lighting system, wherein lighting sources of the lighting device are emitting light at substantially a flood end of a cross-fading spectrum, in accordance with one embodiment of the present invention.

Depending upon which of the second and third switches SW2,SW3 is actuated, the power supplied to the other lighting source of the white flood LED 18A and white spot LED 18B is supplied with proportionally less electrical power. Typically, when the second or third switch SW2,SW3 is actuated, the PWM duty cycle for the corresponding LED 18A, 18B is increased, while the PWM duty cycle for the non-corresponding LED 18A,18B is decreased while maintaining a constant period. For purposes of explanation and not limitation, when the second switch SW2 is actuated to increase the power supplied to the white spot LED 18B, the third illumination pattern is created having a greater light intensity in the center of the pattern than the outer portions of the pattern, as shown in FIG. 17A. Alternatively, when the third switch SW3 is actuated in order to increase the power supplied to the white flood LED 18A, the third illumination pattern is created, wherein the outer portions of the third illumination pattern have a greater light intensity than the center portion of the third illumination pattern, as shown in FIG. 17B.

Figure 17C:
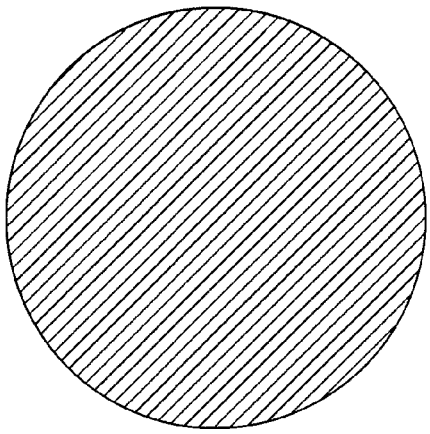
FIG. 17C is an illustration of an illumination pattern emitted by a flood lighting source of a lighting device of a lighting system, in accordance with one embodiment of the present invention.
Figure 17D:
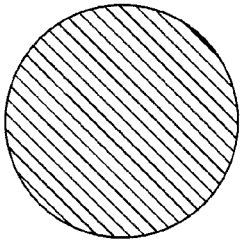
FIG. 17D is an illustration of an illumination pattern emitted by a spot lighting source of a lighting device of a lighting system, in accordance with one embodiment of the present invention.
Figure 17E:
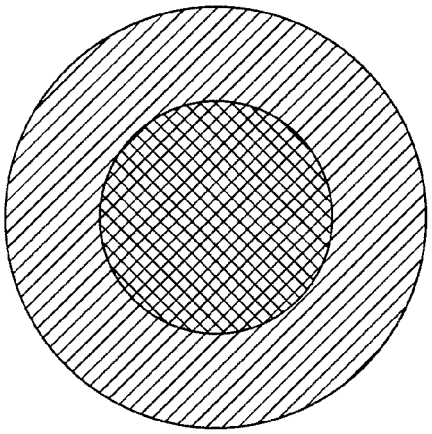
FIG. 17E is an illustration of an illumination pattern created by the cross-fading of the illumination patterns illustrated in FIGS. 17C and 17D, in accordance with one embodiment of the present invention.

Another example of cross-fading to create the third illumination pattern is shown in FIGS. 17C-17E, according to one embodiment. FIG. 17C shows an exemplary first illumination pattern emitted by the white flood LED 18A, and FIG. 17D shows an exemplary second illumination pattern emitted by the white spot LED 18B. As described herein, the target illuminated by the light emitted from the white spot LED 18B is smaller than the target size illuminated by the white flood LED 18A. When the exemplary first and second illumination patterns of FIGS. 17C and 17D are combined, the third illumination pattern is created, as shown in FIG. 17E. Thus, the third illumination pattern has the diameter of the illuminated target size from the light emitted by the white flood LED 18A, while having a greater intensity in the center of the third illumination pattern based upon the additional light intensity emitted by the white spot LED 18B.

Figure 17F:
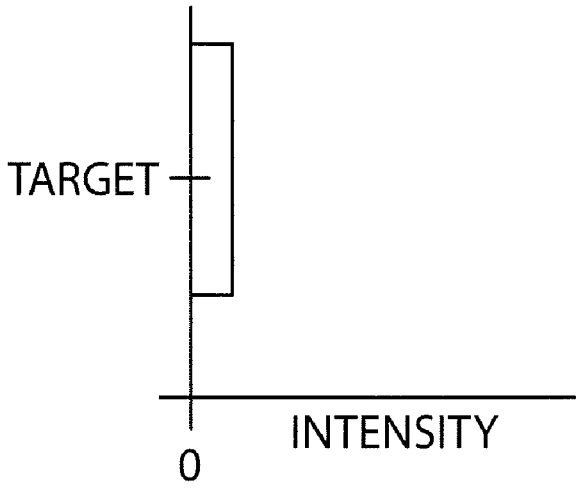
FIG. 17F is a graph illustrating an intensity of an illumination pattern at a target of light emitted by a flood lighting source of a lighting device of a lighting system, in accordance with one embodiment of the present invention.
Figure 17G:
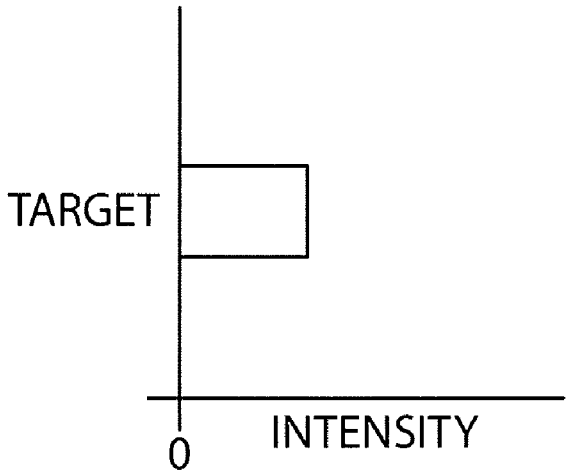
FIG. 17G is a graph illustrating an intensity of an illumination pattern at a target of light emitted by a spot lighting source of a lighting device of a lighting system, in accordance with one embodiment of the present invention.
Figure 17H:
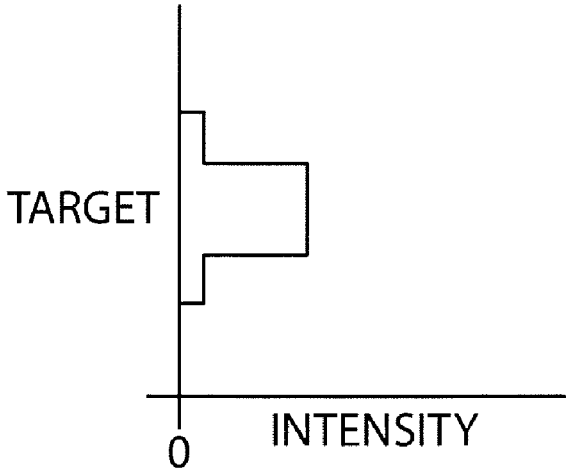
FIG. 17H is a graph illustrating an intensity of an illumination pattern at a target created by the cross-fading of the illumination patterns of FIGS. 17F and 17G, in accordance with one embodiment of the present invention.

In regards to FIG. 17F, an illumination pattern is shown with an intensity at a target, wherein the illumination pattern is representative of the light emitted by the white flood LED 18A, according to one embodiment. The intensity at a target, as shown in FIG. 17G, is representative of a second illumination pattern created by a light emitted from the white spot LED 18B. Thus, the intensity at a target illustrated in FIG. 17H represents the cross-fading of the intensities of the white flood LED 18A and the white spot LED 18B, which illuminates the target with the diameter of the illumination pattern emitted by the white flood LED 18A with greater intensity in the center due to the illumination pattern emitted by the white spot LED 18B.

According to one embodiment, a default setting when the lighting device 14A,14B,14C is turned on by actuating the first switch SW1 is employed, such that both the white flood LED 18A and white spot LED 18B receive fifty percent (50%) of the cycle time. Additionally or alternatively, there can be any number of cross-fading levels across a cross-fading spectrum, which have corresponding PWM duty cycles for the lighting sources 18A,18B. For purposes of explanation and not limitation, there can be a suitable number of cross-fading levels in order to control the proportional intensity of the lighting sources 18A,18B, such that there are thirty-eight (38) cross-fading levels in the cross-fading spectrum, wherein each level takes 78.9 milliseconds (ms) so that the electrical current supplied to the lighting sources LEDs 18A,18B can be varied over the entire available spectrum in approximately three seconds (3 s).

Cross-fading levels are a plurality of levels that yield the cross-fading spectrum, wherein each level represents an amount of electrical power supplied to the lighting sources 18A,18B,18C. According to one embodiment, the cross-fading levels are linear, such that the change of electrical power supplied to the lighting sources 18A,18B at the different cross-fading levels is a linear change. According to an alternate embodiment, the cross-fading levels are non-linear, such that the change of electrical power supplied to the lighting sources 18A,18B at the different cross-fading levels is a non-linear change. Additionally or alternatively, the cross-fading levels can correspond to an increase or decrease in light intensity that is noticeable by the human eye (e.g., approximately thirty percent (30%)).

Figure 18:
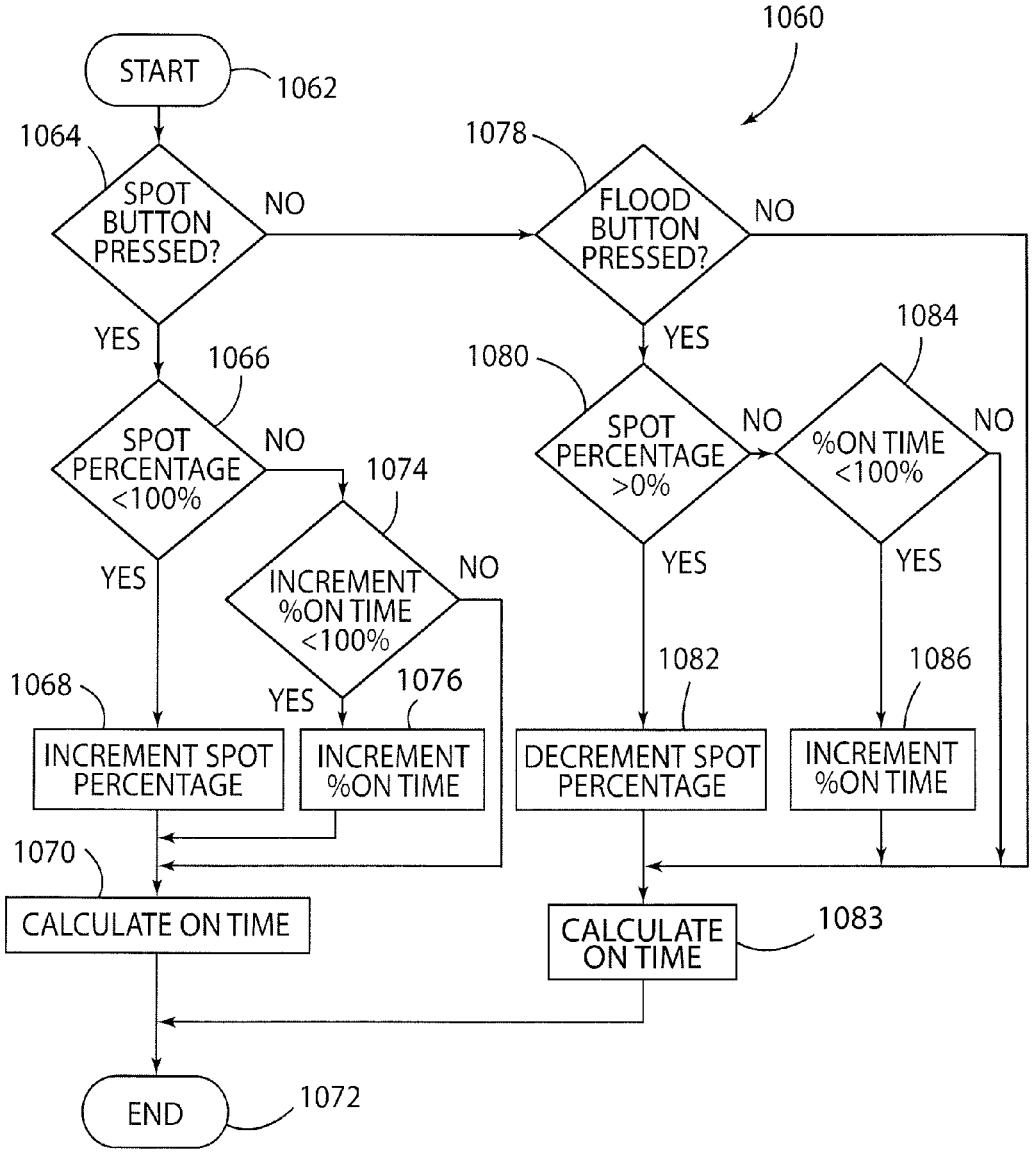
FIG. 18 is a flow chart illustrating a method of cross-fading lighting sources of a lighting device to emit light in an illumination pattern, in accordance with one embodiment of the present invention.

According to one embodiment, a method of cross-fading the first and second illumination patterns to alter the third illumination is generally shown in FIG. 18 at reference identifier 1060. The method 1060 starts at step 1062, and proceeds to decision step 1064, wherein it is determined if the switch SW2 associated with the white spot LED 18B is depressed or actuated, according to one embodiment. If it is determined at decision step 1064 that the switch SW2 is depressed, then the method 1060 proceeds to decision step 1066. At decision step 1066 it is determined if a spot percentage is less than one hundred percent (100%), wherein the spot percentage represents the percentage of total light intensity emitted by the white spot LED 18B. If it is determined at decision step 1066 that the spot percentage is less than one hundred percent (100%), then the method 1060 proceeds to step 1068 and the spot percentage in incremented. Thus, the percentage of the total light intensity emitted by the white spot LED 18B is increased, and the percentage of total light intensity emitted by the white flood LED 18B is proportionally decreased, according to one embodiment. This effectively shifts a higher concentration of the output light illumination beam from a flood illumination pattern to a spot illumination pattern. At step 1070, the On Time is calculated. The calculated On Time represents the total time the white spot LED 18B is on, which corresponds to the intensity of the light emitted by the white spot LED 18B, according to one embodiment. The method 1060 then ends at step 1072.

However, if it is determined at decision step 1066 that the spot percentage is not less than one hundred percent (100%), then the method 1060 proceeds to decision step 1074. At decision step 1074, it is determined if the Percent On Time (% On_Time) is less than one hundred percent (100%). According to one embodiment, the Percent On Time (% On_Time) is the total time the white spot LED 18B is on, which is typically represented by a percentage of the total PWM period. If it is determined that the Percent On Time (% On_Time) is not less than one hundred percent (100%) at decision step 1074, then the method 1060 ends at step 1072. However, if it is determined at decision step 1074 that the Percent On Time (% On_Time) is less than one hundred (100%), then the method 1060 proceeds to step 1076, wherein the Percent On Time (% On_Time) is incremented. According to one embodiment, when the Percent On Time (% On_Time) is incremented, the intensity of the light emitted by the white spot LED 18B is increased. Thus, the intensity of the light emitted by the white flood and spot LEDs 18A,18B is increased when the cross-fade is at an end (i.e. spot end) of a cross-fade spectrum. Generally, the spot end of the cross-fade spectrum can be the end of the cross-fade spectrum where the output light illumination pattern is substantially concentrated with the spot illumination pattern. The method 1060 then proceeds to step 1070, wherein the On Time is calculated, and the method 1060 then ends at step 1072.

When it is determined at decision step 1064 that the switch SW2 is not depressed, then the method 1060 proceeds to decision step 1078. At decision step 1078 it is determined if the switch SW3 associated with the white flood LED 18A is depressed. If it is determined at decision step 1078 that the switch SW3 is depressed, the method proceeds to decision step 1080, wherein it is determined if the spot percentage is greater than zero percent (0%). When it is determined that the spot percentage is greater than zero percent (0%) at decision step 1080, then the method 1060 proceeds to step 1082. At step 1082, the spot percentage is decremented. Typically, when the spot percentage is decremented, the intensity of the light emitted by the white spot LED 18B is decreased and the intensity of the light emitted by the white flood LED 18A is proportionally increased, according to one embodiment. The method 1060 then proceeds to step 1083, wherein the On Time is calculated, and ends at step 1072. Typically, the On Time calculated for the white spot LED 18B at step 1083 can be calculated in the same manner as the On Time calculated in step 1070 for the white flood LED 18A.

However, if it is determined at decision step 1080 that the spot percentage is not greater than zero percent (0%), then the method 1060 proceeds to decision step 1084. At decision step 1084, it is determined if the Percent On Time (% On_Time) is less than one hundred percent (100%). If it is determined at decision step 1084 that the Percent On Time (% On_Time) is less than one hundred percent (100%) then the method 1060 proceeds to step 1086, wherein the Percent On Time (% On_Time) is incremented. Thus, the intensity of the light emitted by the white flood and spot LEDs 18A,18B is increased when the cross-fade is at an end (i.e. flood end) of the cross-fade spectrum. Generally, the flood end of the cross-fade spectrum can be the end of the cross-fade spectrum where the output light illumination pattern is substantially concentrated with the flood illumination pattern. The method 1060 then proceeds to step 1070 to calculate the On Time, and the method 1060 then ends at step 1072. Further, when it is determined at decision step 1078 that the switch SW3 is not depressed, the method 1060 then ends at step 1072.

Additionally or alternatively, the lighting devices 14A, 14B,14C can have a dimming feature to control the intensity of the lighting sources 18A,18B,18C. According to one embodiment, the first switch SW1 can be depressed for a predetermined period of time in order to activate the dimming feature, which would then increase or decrease the electrical current provided to both the white flood LED 18A and the white spot LED 18B by the power source 16,20,22,24,26,27. Similarly, the fourth switch SW4 can be depressed for a predetermined period of time in order to increase or decrease the electrical current supplied to the red flood LED 18C. Typically, by increasing or decreasing the electrical current supplied to the lighting sources 18A,18B,18C, the intensity of the light emitted by the lighting sources 18A,18B,18C is altered accordingly. Typically, increasing or decreasing the electrical current supplied to the lighting sources 18A,18B, 18C is accomplished by reducing or increasing the duty cycle of the lighting sources 18A,18B,18C.

By way of explanation and not limitation, there can be a suitable number of dimming levels of a dimming spectrum in order to control the dimming of the lighting sources 18A,18B, 18C. According to one embodiment, thirty-eight (38) dimming levels are provided across the dimming spectrum, wherein each dimming level takes approximately 78.9 milliseconds (ms) to change between dimming levels when the corresponding switch SW1,SW2 is continuously being depressed. Thus, the time for total transition across the spectrum for each lighting source 18A,18B,18C is approximately three seconds (3 s). Dimming levels are a plurality of dimming levels that yield the dimming spectrum, wherein each level represents an amount of electrical power supplied to the lighting source 18A,18B,18C. Typically, when either the minimum or maximum dimming level is selected (e.g., the lighting sources 18A,18B,18C are emitting the minimum or maximum amount of light), the dimming state will be maintained at the minimum or maximum dimming level for a predetermined period of time before changing to another level when the switch SW1,SW4 is depressed. According to one embodiment, the selected dimming conditions of the lighting sources 18A,18B,18C is maintained when the cross-fading feature is activated. Additionally or alternatively, the selected cross-fading pattern is maintained when the dimming feature is activated.

Figure 19:
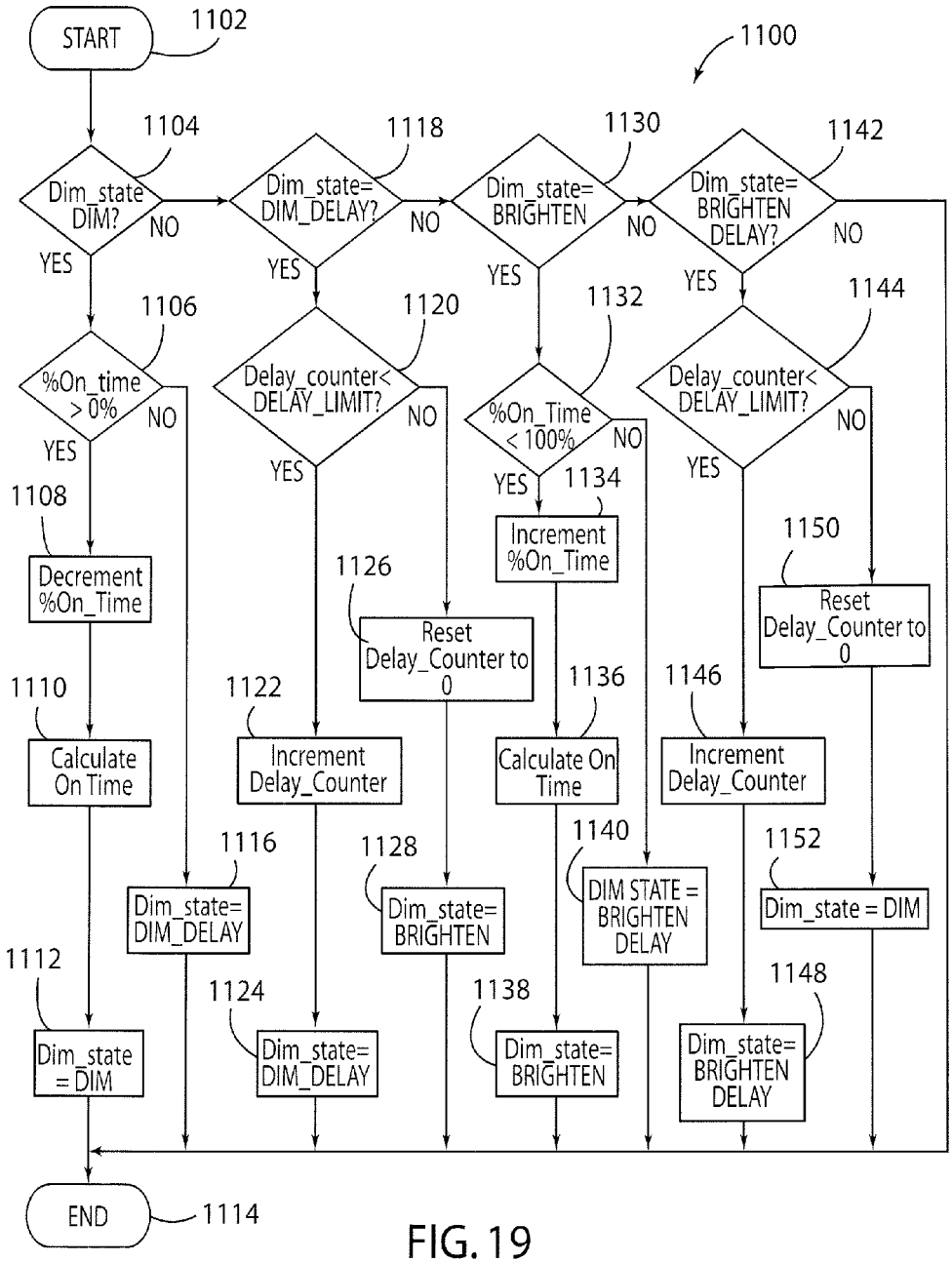
FIG. 19 is a flow chart illustrating a method of dimming a light emitted by lighting sources of a lighting device in a lighting system, in accordance with one embodiment of the present invention.
Figure 20:
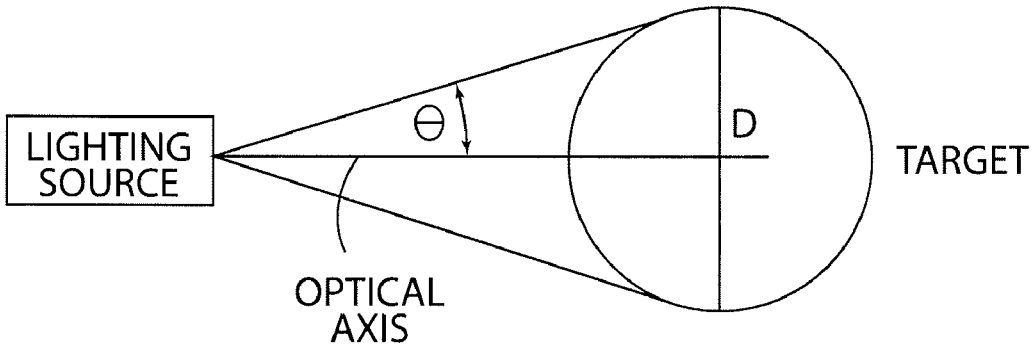
FIG. 20 is an exemplary illustration of an illumination pattern emitted by a lighting source of a lighting device in a lighting system, in accordance with one embodiment of the present invention.

According to one embodiment, a method of dimming the lighting sources 18A,18B,18C to increase or decrease the intensity of the light emitted by the lighting source 18A,18B, 18C is generally shown in FIG. 19 at reference identifier 1100. The method 1100 starts at step 1102, and proceeds to decision step 1104, wherein it is determined if a dimming state value (Dim_state) is equal to a first predetermined dimming value (DIM). According to one embodiment, the first predetermined dimming value (DIM) is a value that is not at the minimum or maximum end of the dimming spectrum, but instead is an intermediate position in the dimming spectrum. If it is determined at decision step 1104 that the dimming state value (DIM_state) is equal to the first predetermined dimming value (DIM), then the method 1100 proceeds to decision step 1106.

At decision step 1106 it is determined if the Percent On Time (% On_Time) is greater than zero percent (0%). According to one embodiment, the Percent On Time (% On_Time) related to the total light intensity of the light emitted by the lighting source 18A,18B,18C. Thus, the Percent On Time (% On_Time) is equal to a percentage of the total PWM period, according to one embodiment. If it is determined at decision step 1106 that the Percent On Time (% On_Time) is greater than zero percent (0%), then the method 1100 proceeds to step 1108, wherein the Percent On Time (% On_Time) is decremented. Typically, when the Percent On Time (% On_Time) is decremented, the intensity of the light emitted by the lighting source 18A,18B,18C is decreased. At step 1110, the On Time is calculated, wherein the calculated On Time represents the total time that the lighting source 18A,18B,18C is on, which relates to the intensity of the light emitted by the lighting source 18A,18B,18C. At step 1112, the dimming state value (Dim_state) is set to equal the first predetermined dimming value (DIM), and the method 1100 then ends at step 1114.

However, if it is determined at decision step 1106 that the Percent On Time (% On_Time) is not greater than zero percent (0%), then the method 1100 proceeds to step 1116. At step 1116, the dimming state value (Dim_state) is set to equal a second predetermined dimming value (DIM_DELAY). According to one embodiment, the second predetermined dimming value (DIM_DELAY) is a value at substantially the minimum end of the dimming spectrum, and thus, the dimming state of the lighting sources 18A,18B,18C will be maintained for a predetermined period of time when the switch SW1,SW4 is depressed. Generally, the minimum end of the dimming spectrum is the end of the dimming spectrum where the light emitted by the lighting sources 18A,18B,18C is at an approximately minimum value. The method 1100 then ends at step 1114.

When it is determined at decision step 1104 that the dimming state value (Dim_state) is not equal to the first predetermined dimming value (DIM), then the method 1100 proceeds to decision step 1118. At decision step 1118, it is determined if the dimming state value (Dim_state) is equal to the second predetermined dimming value (DIM_DELAY). If it is determined at decision step 1118 that the dimming state value (Dim_state) is equal to the second predetermined dimming value (DIM_DELAY) then the method 1100 proceeds to decision step 1120. At decision step 1120, it is determined if a delay counter value (Delay_counter) is less than a predetermined delay value (DELAY_LIMIT). According to one embodiment, the predetermined delay value (DELAY_LIMIT) is the time that the dimming state will be maintained at the minimum and maximum ends of the dimming spectrum when the switch SW1,SW4 is depressed.

If it is determined at decision step 1120 that the delay counter value (Delay_counter) is less than the predetermined delay value (DELAY_LIMIT), then the method 1100 proceeds to step 1122, wherein the delay counter value (Delay_counter) is incremented. Typically, the delay counter value (Delay_counter) continues to be incremented to represent the increase in time that the dimming state has been maintained at the minimum or maximum end of the dimming spectrum. At step 1124, the dimming state value (Dim_state) is set to equal the second predetermined dimming value (DIM_DELAY), and the method 1100 ends at step 1114.

However, if it is determined at decision step 1120 that the delay counter value (Delay_counter) not less than the predetermined delay value (DELAY_LIMIT), then the method 1100 proceeds to step 1126, wherein the delay counter value (Delay_counter) is reset to zero (0). At step 1128, the dimming state value (Dim_state) is set to equal a third predetermined dimming value (BRIGHTEN), and the method 1100 then ends at step 1114. Thus, the dimming state has been maintained at the minimum end of the dimming spectrum for the predetermined period of time, and the delay counter value (Delay_counter) is reset, and the light intensity of the light emitted by the lighting source 18A,18B,18C is increased.

When it is determined that the dimming state value (Dim_state) is not equal to the second predetermined dimming value (DIM_DELAY), then the method 1100 proceeds decision step 1130. At decision step 1130, it is determined if the dimming state value (Dim_state) is equal to the third predetermined dimming value (BRIGHTEN). If it is determined at decision step 1130 that the dimming state value (Dim_state) is equal to the third predetermined dimming value (BRIGHTEN), then the method 1100 proceeds to decision step 1132. At decision step 1132, it is determined if the Percent On Time (% On_Time) is less than one hundred percent (100%). When it is determined that that the Percent On Time (% On_Time) is less than one hundred percent (100%), then the method 1100 proceeds to step 1134, wherein the Percent On Time (% On_Time) is incremented. Typically, when the Percent On Time (% On_Time) is incremented, the intensity of the light emitted by the lighting source 18A,18B, 18C is increased. At step 1136, the On Time is calculated, and at step 1138, the dimming state value (Dim_state) is set to equal the third predetermined dimming value (BRIGHTEN). The method 1100 then ends at step 1114. Generally, the maximum end of the dimming spectrum is the end of the dimming spectrum where the light emitted by the lighting sources 18A,18B,18C is at an approximately maximum value.

However, if it is determined at decision step 1132 that the Percent On Time (% On_Time) is not less than one hundred percent (100%), then the method 1100 proceeds to step 1140. At step 1140, the dimming state value (Dim_state) is set to equal a fourth predetermined dimming value (BRIGHTEN DELAY). According to one embodiment, the fourth predetermined dimming value (BRIGHTEN DELAY) represents the maximum end of the dimming spectrum. The method 1100 then ends at step 1114. Generally, the minimum end of the dimming spectrum is the end of the dimming spectrum where the light emitted by the lighting sources 18A,18B,18C is at an approximately maximum value.

When it is determined at decision step 1130 that the dimming state value (Dim_state) is not equal to the third predetermined dimming value (BRIGHTEN), then the method 1100 proceeds to decision step 1142. At decision step 1142, it is determined if the dimming state value (Dim_state) is equal to the fourth predetermined dimming value (BRIGHTEN DELAY). If it is determined at decision step 1142 that the dimming state value (Dim_state) is equal to the fourth predetermined dimming value (BRIGHTEN DELAY) then the method proceeds to decision step 1144. At decision step 1144, it is determined if the delay counter value (Delay_counter) is less than the predetermined delay value (DELAY_LIMIT). If it is determined at decision step 1144 that the delay counter value (Delay_counter) is less than the predetermined delay value (DELAY_LIMIT), then the delay counter value (Delay_counter) is incremented at step 1146. At step 1148, the dimming state value (Dim_state) is set to equal the fourth predetermined dimming value (BRIGHTEN DELAY), and the method 1100 then ends at step 1114.

However, if it is determined at decision step 1144 that the delay counter value (Delay_counter) is not less than the predetermined delay value (DELAY_LIMIT), then the method 1100 proceeds to step 1150, wherein the delay counter value (Delay_counter) is reset to zero (0). At step 1152, the dimming state value (Dim_state) is set to the first predetermined dimming value (DIM), and the method 1100 then ends at step 1114. When it is determined at decision step 1142 that the dimming state value (Dim_state) is not equal to the fourth predetermined dimming value (BRIGHTEN DELAY), then the method 1100 ends at step 1114. It should be appreciated by those skilled in the art, that the method 1100 can continuously run while the lighting device 14A,14B,14C is on, such that when the method 1100 ends at step 1114, the method 1100 starts again at step 1102.

Additionally or alternatively, the controller 36 can receive the measured temperature from the temperature monitoring device 50, and alter or limit the available cross-fading levels and/or dimming levels that can be implemented. Thus, if the temperature monitoring device 50 measures the temperature of the LED circuit board 19, and it is determined that the measured temperature is at or approaching an undesirable level, than one or more of the cross-fading and/or dimming levels can be deactivated so that the user cannot control the lighting sources 18A,18B,18C to be supplied with the needed electrical power to illuminate the lighting sources 18A,18B, 18C at the greater intensities, according to one embodiment. In such an embodiment, where the temperature of the lighting device 14A,14B,14C is being maintained by minimizing the electrical power supplied to the lighting sources 18A,18B, 18C, the user does not have the ability to increase the intensity (e.g., supply electrical power) to levels that would otherwise increase the temperature of the lighting device 14A,14B,14C.

The above description is considered that of preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A hand-held lighting device comprising:

a plurality of lighting sources comprising:

a first lighting source, wherein the first lighting source emits light in a first illumination pattern; and a second lighting source, wherein the second lighting source emits light in a second illumination pattern that is different than the first illumination pattern, and the first and second illumination patterns at least partially overlap to yield a third illumination pattern; and a controller that proportionally shifts available power between the first lighting source and the second lighting source to control an intensity of the first illumination pattern and the second illumination pattern, wherein the first lighting source is a flood lighting source and the first illumination pattern is a flood illumination pattern and the second lighting source is a spot lighting source and the second illumination pattern is a spot illumination pattern, wherein the third illumination patern is altered when the controler alters the intensity associated with at least one of the first illumination pattern or the second illumination pattern.

2. The device of claim 1, wherein the controller utilizes pulse width modulation to shift the available power.

3. The device of claim 1, wherein the controller controls current to the first lighting source and the second lighting source to shift the available power between the first lighting source and the second lighting source.

4. The device of claim 1, further comprising a default state where fifty percent of the available power is provided to the first lighting source and fifty percent of the available power is provided to the second lighting source.

5. The device of claim 4, further comprising a level where twenty percent of the available power is provided to the first lighting source and eighty percent of the available power is provided to the second lighting source.

6. The device of claim 1, wherein the controller alters the first and second electrical powers supplied to the first and second lighting sources linearly.

7. The device of claim 1, wherein the controller further comprises a plurality of dimming levels that are obtained by adjusting the available power.

8. The device of claim 7, wherein the controller further comprises a plurality of cross fading levels and the controller maintains a selected cross fading level of the plurality of cross fading levels for the plurality of dimming levels.

9. The device of claim 8, wherein the selected cross fading level is fifty percent of the available power to the first lighting source and fifty percent of the available power to the second lighting source.

10. The device of claim 1, wherein the controller utilizes pulse width modulation to shift the available power.

11. A hand-held lighting device comprising:

a plurality of lighting sources comprising:

a first lighting source, wherein the first lighting source emits light in a first illumination pattern; and a second lighting source, wherein the second lighting source emits light in a second illumination pattern that is different than the first illumination pattern, and the first and second illumination patterns at least partially overlap to yield a third illumination pattern; and a controller that proportionally shifts available power between the first lighting source and the second lighting source to control an intensity of the first illumination pattern and the second illumination pattern, wherein the first lighting source is a flood lighting source having a half angle of greater than approximately twelve degrees (12°), and the second lighting source is a spot lighting source having a half angle of less than approximately twelve degrees (12°), wherein the third illumination pattern is altered when the controller alters the intensity associated with at least one of the first illumination pattern or the second illumination pattern.

12. The device of claim 11, wherein the controller controls current to the first lighting source and the second lighting source to shift the available power between the first lighting source and the second lighting source.

13. The device of claim 11, further comprising a default state where fifty percent of the available power is provided to the first lighting source and fifty percent of the available power is provided to the second lighting source.

14. The device of claim 13, further comprising a level where twenty percent of the available power is provided to the first lighting source and eighty percent of the available power is provided to the second lighting source.

15. The device of claim 11, wherein the controller alters the first and second electrical powers supplied to the first and second lighting sources linearly.

16. The device of claim 11, wherein the controller further comprises a plurality of dimming levels that are obtained by adjusting the available power.

17. The device of claim 16, wherein the controller further comprises a plurality of cross fading levels and the controller maintains a selected cross fading level of the plurality of cross fading levels for the plurality of dimming levels.

18. The device of claim 17, wherein the selected cross fading level is fifty percent of the available power to the first lighting source and fifty percent of the available power to the second lighting source.

* * * * *